US009430968B2

(12) United States Patent
Kishi et al.

(10) Patent No.: US 9,430,968 B2
(45) Date of Patent: Aug. 30, 2016

(54) DISPLAY DEVICE AND DRIVE METHOD FOR SAME

(71) Applicant: Sharp Kabushiki Kaisha, Osaka-shi, Osaka (JP)

(72) Inventors: Noritaka Kishi, Osaka (JP); Noboru Noguchi, Osaka (JP); Masanori Ohara, Osaka (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 0 days.

(21) Appl. No.: 14/787,793

(22) PCT Filed: Jun. 20, 2014

(86) PCT No.: PCT/JP2014/066403
§ 371 (c)(1),
(2) Date: Oct. 29, 2015

(87) PCT Pub. No.: WO2014/208459
PCT Pub. Date: Dec. 31, 2014

(65) Prior Publication Data

US 2016/0111044 A1 Apr. 21, 2016

(30) Foreign Application Priority Data

Jun. 27, 2013 (JP) ..... 2013-134638

(51) Int. Cl.
*G09G 5/10* (2006.01)
*G09G 3/32* (2016.01)

(52) U.S. Cl.
CPC .... *G09G 3/3233* (2013.01); *G09G 2300/0819* (2013.01); *G09G 2310/0291* (2013.01);

(Continued)

(58) Field of Classification Search
CPC ..... G09G 3/3233; G09G 3/3258; G09G 2300/0819; G09G 2320/0626; G09G 2320/0233; G09G 2320/041; G09G 2320/045; G09G 2330/021
USPC ..... 345/76–82, 87–100, 206–215, 690
See application file for complete search history.

(56) References Cited

U.S. PATENT DOCUMENTS 7,317,429 B2 * 1/2008 Shirasaki ..... G09G 3/325 345/36
7,414,599 B2 * 8/2008 Chung ..... G09G 3/3233 315/169.3

(Continued)

FOREIGN PATENT DOCUMENTS

JP 2003195810 A 7/2003
JP 2005-031630 A 2/2005

(Continued)

OTHER PUBLICATIONS

International Search Report PCT/ISA/210 for International Application No. PCT/JP2014/066403 dated Sep. 8, 2014.

(Continued)

*Primary Examiner* — Vijay Shankar
(74) *Attorney, Agent, or Firm* — Harness, Dickey & Pierce, P.L.C.

(57) ABSTRACT

There is realized a display device capable of compensating for a deterioration of a circuit element while suppressing an increase of a circuit scale. One horizontal scanning period for a monitor row is composed of: a detection preparation period where preparation for detecting TFT characteristics and OLED characteristics is performed in the monitor row; a TFT characteristic detection period where current measurement for detecting the TFT characteristics is performed; an OLED characteristic detection period where current measurement for detecting the OLED characteristics is performed; and a light emission preparation period where preparation for allowing an organic EL element to emit light is performed in the monitor row. Data lines are used not only as signal lines that transfer a signal for allowing an organic EL element in each pixel circuit to emit light at desired brightness, but also as characteristic detecting signal lines.

17 Claims, 36 Drawing Sheets

(52) U.S. Cl.
CPC *G09G2320/029* (2013.01); *G09G 2320/0233* (2013.01); *G09G 2320/041* (2013.01); *G09G 2320/045* (2013.01); *G09G 2320/0626* (2013.01); *G09G 2330/021* (2013.01)

(56) References Cited

U.S. PATENT DOCUMENTS

| | | | | |
|---|---|---|---|---|
| 7,619,597 | B2 * | 11/2009 | Nathan | G09G 3/3233 315/169.3 |
| 7,834,826 | B2 * | 11/2010 | Kwon | G09G 3/2014 345/77 |
| 8,269,803 | B2 * | 9/2012 | Yoo | G09G 3/3233 345/690 |
| 8,669,556 | B2 * | 3/2014 | Yamazaki | H01L 29/7869 257/43 |
| 2004/0113873 | A1 | 6/2004 | Shirasaki et al. | |
| 2005/0017934 | A1 | 1/2005 | Chung et al. | |
| 2006/0158402 | A1 | 7/2006 | Nathan et al. | |
| 2007/0200804 | A1 | 8/2007 | Kwon | |
| 2011/0254871 | A1 | 10/2011 | Yoo et al. | |
| 2012/0138922 | A1 | 6/2012 | Yamazaki et al. | |

FOREIGN PATENT DOCUMENTS

| | | | |
|---|---|---|---|
| JP | 2007128103 | A | 5/2007 |
| JP | 2007233326 | A | 9/2007 |
| JP | 2008523448 | A | 7/2008 |
| JP | 2010-281874 | A | 12/2010 |
| JP | 2011-221480 | A | 11/2011 |
| JP | 2012134475 | A | 7/2012 |

OTHER PUBLICATIONS

Written Opinion of the International Searching Authority PCT/ISA/237 for International Application No. PCT/JP2014/066403 dated Sep. 8, 2014.

* cited by examiner

Fig.8

| | CHARACTERISTIC DETECTION OPERATION | USUAL OPERATION |
|---|---|---|
| (K+1)-TH FRAME | FIRST ROW | SECOND TO n-TH ROW |
| (K+2)-TH FRAME | SECOND ROW | FIRST ROW, THIRD TO n-TH ROW |
| (K+3)-TH FRAME | THIRD ROW | FIRST ROW, SECOND ROW, FORTH TO n-TH ROW |
| ⋮ | ⋮ | ⋮ |
| (K+n)-TH FRAME | n-TH ROW | FIRST TO (n-1)-TH ROW |

Fig.30

| | OLED CHARACTERISTIC DETECTION OPERATION | TFT CHARACTERISTIC DETECTION OPERATION | USUAL OPERATION |
|---|---|---|---|
| (K+1)-TH FRAME | FIRST ROW | | SECOND TO n-TH ROW |
| (K+2)-TH FRAME | SECOND ROW | | FIRST ROW, THIRD TO n-TH ROW |
| (K+3)-TH FRAME | THIRD ROW | | FIRST ROW, SECOND ROW, FORTH TO n-TH ROW |
| ⋮ | ⋮ | | ⋮ |
| (K+n)-TH FRAME | n-TH ROW | | FIRST TO (n-1)-TH ROW |
| (K+n+1)-TH FRAME | | FIRST ROW | SECOND TO n-TH ROW |
| (K+n+2)-TH FRAME | | SECOND ROW | FIRST ROW, THIRD TO n-TH ROW |
| (K+n+3)-TH FRAME | | THIRD ROW | FIRST ROW, SECOND ROW, FORTH TO n-TH ROW |
| ⋮ | | ⋮ | ⋮ |
| (K+2n)-TH FRAME | | n-TH ROW | FIRST TO (n-1)-TH ROW |

DISPLAY DEVICE AND DRIVE METHOD FOR SAME

TECHNICAL FIELD

The present invention relates to a display device and a drive method for the same, and more specifically, relates to a display device including a pixel circuit having an electro-optical element such as an organic EL (Electro Luminescence) element, and to a drive method for the same.

BACKGROUND ART

Heretofore, as a display element which the display device includes, there are: an electro-optical element in which brightness is controlled by a voltage applied thereto; and an electro-optical element in which brightness is controlled by a current flowing therethrough. As a representative example of the electro-optical element in which the brightness is controlled by the voltage applied thereto, a liquid crystal display element is mentioned. Meanwhile, as a representative example of the electro-optical element in which the brightness is controlled by the current flowing therethrough, an organic EL element is mentioned. The organic EL element is also referred to as an OLED (Organic Light-Emitting Diode). In comparison with the liquid crystal display device that requires a backlight, color filters and the like, an organic EL display device using the organic EL element that is a light emission-type electro-optical element can easily achieve thinning, reduction of electric power consumption, enhancement of the brightness, and the like. Hence, in recent years, development of the organic EL display device has been progressed positively.

As a drive method for the organic EL display device, a passive matrix method (also referred to as a simple matrix method) and an active matrix method are known. An organic EL display device that adopts the passive matrix method has a simple structure; however, a size increase and definition enhancement thereof are difficult. In contrast, an organic EL display device that adopts the active matrix method (hereinafter, referred to as an "active matrix-type organic EL display device") can easily realize the size increase and the definition enhancement in comparison with the organic EL display device that adopts the passive matrix method.

In the active matrix-type organic EL display device, a plurality of pixel circuits is formed in a matrix fashion. Typically, each of the pixel circuits of the active matrix-type organic EL display device includes: an input transistor that selects a pixel; and a drive transistor that controls supply of a current to the organic EL element. Note that, in the following, the current flowing from the drive transistor to the organic EL element is sometimes referred to as a "drive current".

FIG. 37 is a circuit diagram showing a configuration of a conventional general pixel circuit 91. This pixel circuit 91 is provided so as to correspond to each of crossing points of a plurality of data lines S and a plurality of scanning lines G, which are arranged on a display unit. As shown in FIG. 37, this pixel circuit 91 includes: two transistors T1 and T2; one capacitor Cst; and one organic EL element OLED. The transistor T1 is an input transistor, and the transistor T2 is a drive transistor.

The transistor T1 is provided between the data line S and a gate terminal of the transistor T2. With regard to the transistor T1, a gate terminal thereof is connected to the scanning line G, and a source terminal thereof is connected to the data line S. The transistor T2 is provided in series to the organic EL element OLED. With regard to the transistor T2, a drain terminal thereof is connected to a power supply line that supplies a high-level power supply voltage ELVDD, and a source terminal thereof is connected to an anode terminal of the organic EL element OLED. Note that the power supply line that supplies the high-level power supply voltage ELVDD is hereinafter referred to as a "high-level power supply line", and the high-level power supply line is denoted by the same reference symbol ELVDD as that of the high-level power supply voltage. With regard to the capacitor Cst, one end thereof is connected to the gate terminal of the transistor T2, and other end thereof is connected to the source terminal of the transistor T2. A cathode terminal of the organic EL element OLED is connected to a power supply line that supplies a low-level power supply voltage ELVSS. Note that the power supply line that supplies the low-level power supply voltage ELVSS is hereinafter referred to as a "low-level power supply line", and the low-level power supply line is denoted by the same reference symbol ELVSS as that of the low-level power supply voltage. Moreover, here, a connecting point of the gate terminal of the transistor T2, the one end of the capacitor Cst and the drain terminal of the transistor T1 is referred to as a "gate node VG" for the sake of convenience. Note that, in general, either one of the drain and the source, which has a higher potential, is referred to as the drain. However, in the explanation of this description, one thereof is defined as the drain, and the other thereof is defined as the source. Accordingly, in some case, a source potential becomes higher than a drain potential.

FIG. 38 is a timing chart for explaining operations of the pixel circuit 91 shown in FIG. 37. Before a time t1, the scanning line G is in a non-selection state. Hence, before the time t1, the transistor T1 is in an OFF state, and a potential of the gate node VG maintains an initial level (for example, a level corresponding to a write in an immediately previous frame). When the time t1 comes, the scanning line G turns to a selection state, and the transistor T1 turns ON. Thus, a data voltage Vdata corresponding to brightness of a pixel (sub-pixel), which is formed by this pixel circuit 91, is supplied to the gate node VG via the data line S and the transistor T1. Thereafter, during a period until a time t2, the potential of the gate node VG changes in response to the data voltage Vdata. At this time, the capacitor Cst is charged with a gate-source voltage Vgs that is a difference between the potential of the gate node Vg and the source potential of the transistor T2. When the time t2 comes, the scanning line G turns to the non-selection state. Thus, the transistor T1 turns OFF, and the gate-source voltage Vgs held by the capacitor Cst is determined. The transistor T2 supplies a drive current to the organic EL element OLED in response to the gate-source voltage Vgs held by the capacitor Cst. As a result, the organic EL element OLED emits light with brightness corresponding to the drive current.

Incidentally, in the organic EL display device, typically, a thin film transistor (TFT) is adopted as the drive transistor. However, the thin film transistor is prone to cause variations in a threshold voltage. When the variations of the threshold voltage occur in the drive transistor provided in the display unit, variations of the brightness occur, and accordingly, display quality is decreased. Accordingly, heretofore, there has been proposed a technology for suppressing the decrease of the display quality in the organic EL display device. For example, Japanese Patent Application Laid-Open No. 2005-31630 discloses a technology for compensating the variations of the threshold voltage of the drive transistor. Moreover, Japanese Patent Application Laid-Open No. 2003-

195810 and Japanese Patent Application Laid-Open No. 2007-128103 disclose a technology for constantly maintaining a current flowing from the pixel circuit to the organic EL element OLED. Furthermore, Japanese Patent Application Laid-Open No. 2007-233326 discloses a technology for displaying an image with uniform brightness irrespective of the threshold voltage and electron mobility of the drive transistor.

In accordance with the above-mentioned prior arts, even when the variations of the threshold voltage occur in the drive transistor provided in the display unit, it becomes possible to supply a constant current to the organic EL element (light-emitting element) in response to desired brightness (target brightness). However, with regard to the organic EL element, current efficiency thereof is decreased with the elapse of time. That is to say, even when the constant current is supplied to the organic EL element, the brightness is gradually decreased with the elapse of time. As a result, the burn-in occurs.

As stated above, if no compensation is made for such a deterioration of the drive transistor and such a deterioration of the organic EL element, then as shown in FIG. 39, a current decrease resulting from the deterioration of the drive transistor occurs, and in addition, a brightness decrease resulting from the deterioration of the organic EL element occurs. Moreover, even if the compensation is made for the deterioration of the drive transistor, the brightness decrease resulting from the deterioration of the organic EL element occurs as the time elapses as shown in FIG. 40. So, Japanese Unexamined Patent Application Publication No. 2008-523448 discloses a technology for making correction for data based on characteristics of the organic EL element OLED in addition to a technology for making correction for the data based on characteristics of the drive transistor.

PRIOR ART DOCUMENTS

Patent Documents

[Patent Document 1] Japanese Patent Application Laid-Open No. 2005-31630

[Patent Document 2] Japanese Patent Application Laid-Open No. 2003-195810

[Patent Document 3] Japanese Patent Application Laid-Open No. 2007-128103

[Patent Document 4] Japanese Patent Application Laid-Open No. 2007-233326

[Patent Document 5] Japanese Unexamined Patent Application Publication No. 2008-523448

SUMMARY OF THE INVENTION

Problems to be Solved by the Invention

However, in accordance with the technology disclosed in Japanese Unexamined Patent Application Publication No. 2008-523448, only either one of the characteristics of the drive transistor and the characteristics of the organic EL element can be detected during a selection period. Therefore, the compensation cannot be made simultaneously for both of the deterioration of the drive transistor and the deterioration of the organic EL element. Moreover, it is necessary to elongate the selection period in order to detect the characteristics of both of the drive transistor and the organic EL element. With regard to this, in the technology disclosed in Japanese Unexamined Patent Application Publication No. 2008-523448, in a case where such a selection period for a row for which the detection of the characteristics is performed is elongated, a duration of a light-emitting time differs between the row for which the detection of the characteristics is performed and other rows, and display with desired brightness is not performed. Moreover, in a case of attempting to configure the display device so as to make it possible to detect the characteristics of the drive transistor and the characteristics of the organic EL element, it is desired that a circuit scale should not be increased as much as possible. This is because the increase of the circuit scale brings a disadvantage, for example, in terms of achieving the reduction of the electric power consumption, miniaturization and the like.

In this connection, it is an object of the present invention to provide a display device capable of compensating for a deterioration of a circuit element while suppressing an increase of a circuit scale (in particular, a display device capable of simultaneously compensating for both of the deterioration of the drive transistor and the deterioration of the organic EL element).

Means for Solving the Problems

A first aspect of the present invention is directed to an active matrix-type display device comprising:

a display unit including: a pixel matrix of n rows and m columns (n and m are integers of 2 or more), which is composed of n×m pieces of pixel circuits each including an electro-optical element in which brightness is controlled by a current and including a drive transistor for controlling a current to be supplied to the electro-optical element; scanning lines provided to correspond to respective rows of the pixel matrix; monitor control lines provided to correspond to the respective rows of the pixel matrix; and data lines provided to correspond to respective columns of the pixel matrix;

a pixel circuit drive unit configured to drive the scanning lines, the monitor control lines and the data lines so that characteristic detection processing for detecting characteristics of characteristic detection-target circuit elements including at least either of the electro-optical element and the drive transistor is performed in a frame period, and that each electro-optical element emits light in response to target brightness;

a correction data storage unit configured to store characteristic data, which are obtained based on results of the characteristic detection processing, as correction data for correcting video signals; and a video signal correction unit configured to correct the video signals based on the correction data stored in the correction data storage unit, and to generate data signals to be supplied to the n×m pieces of pixel circuits, wherein each of the pixel circuits includes:

the electro-optical element;

an input transistor, in which a control terminal is connected to one of the scanning lines, a first conductive terminal is connected to one of the data lines, and a second conductive terminal is connected to the control terminal of the drive transistor;

a monitor control transistor, in which a control terminal is connected to one of the monitor control lines, a first conductive terminal is connected to the second conductive terminal of the drive transistor and to the anode of the electro-optical element, and a second conductive terminal is connected to one of the data lines;

the drive transistor in which a first conductive terminal is given a drive power supply potential; and a first capacitor in which one end is connected to a control terminal of the drive transistor in order to hold a potential of the control terminal of the drive transistor, wherein, when a row in which the characteristic detection processing is performed in the frame period is defined as a monitor row, and each of rows other than the monitor row is defined as a non-monitor row, the frame period includes a characteristic detection processing period composed of: a detection preparation period where a preparation for detecting characteristics of the characteristic detection-target circuit elements is performed in the monitor row; a current measurement period where the characteristics of the characteristic detection-target circuit elements are detected by measuring currents flowing through the data lines; and a light emission preparation period where a preparation for allowing the electro-optical element to emit light is performed in the monitor row, the pixel circuit drive unit drives the scanning lines so that the input transistor becomes an ON state during the detection preparation period and the light emission preparation period, and that the input transistor becomes an OFF state during the current measurement period, the pixel circuit drive unit drives the monitor control lines so that the monitor control transistor becomes an OFF state during the detection preparation period and the light emission preparation period, and that the monitor control transistor becomes an ON state during the current measurement period, the pixel circuit drive unit gives the data lines a first predetermined potential during the detection preparation period, the first predetermined potential being determined based on the characteristics of the electro-optical element and the characteristics of the drive transistor, the pixel circuit drive unit gives the data lines a second predetermined potential during the current measurement period, the second predetermined potential serving for allowing a current in accordance with the characteristics of each of the characteristic detection-target circuit elements to flow through each of the data lines, and the pixel circuit drive unit gives the data lines a potential in accordance with a target brightness of the electro-optical element during the light emission preparation period.

According to a second aspect of the present invention, in the first aspect of the present invention, the pixel circuit drive unit includes output and current-monitor circuits having a function to apply the data signals to the data lines, and a function to measure the currents flowing through the data lines, each of the output and current-monitor circuits includes:

an operational amplifier, in which a non-inverting input terminal is given one of the data signals, and an inverting input terminal is connected to one of the data lines;

a second capacitor, in which one end is connected to one of the data lines, and other end is connected to an output terminal of the operational amplifier; and a switch, in which one end is connected to one of the data lines, and other end is connected to the output terminal of the operational amplifier, and each of the output and current-monitor circuits measure currents flowing through the data lines by allowing the switch to be turned to OFF state after giving the data lines the second predetermined potential by allowing the switch to be turned to ON state, in the current measurement period.

According to a third aspect of the present invention, in the second aspect of the present invention, one output and current-monitor circuit is provided for a plurality of the data lines, and the plurality of data lines are electrically connected sequentially to the output and current-monitor circuits every predetermined period.

According to a fourth aspect of the present invention, in the first aspect of the present invention, the characteristic detection processing period is provided in a vertical scanning period.

According to a fifth aspect of the present invention, in the fourth aspect of the present invention, when any electro-optical element is defined as a focus-target electro-optical element, in a case where the focus-target electro-optical element is included in the monitor row, the pixel circuit drive unit gives the data lines a potential of a data signal during the light emission preparation period, the potential being equivalent to a gradation voltage larger than a gradation voltage in a case where the focus-target electro-optical element is included in the non-monitor row.

According to a sixth aspect of the present invention, in the first aspect of the present invention, the characteristic detection processing period is provided in a vertical retrace line period.

According to a seventh aspect of the present invention, in the sixth aspect of the present invention, when any electro-optical element is defined as a focus-target electro-optical element, in a case where the focus-target electro-optical element is included in the monitor row, the pixel circuit drive unit gives the data lines a potential of a data signal in an event of performing writing of the data signals to pixel circuits included in the monitor row in a vertical scanning period, the potential being equivalent to a gradation voltage larger than a gradation voltage in a case where the focus-target electro-optical element is included in the non-monitor row.

According to an eighth aspect of the present invention, in the first aspect of the present invention, the characteristic detection processing is performed for only one row of the pixel matrix for one frame period.

According to a ninth aspect of the present invention, in the first aspect of the present invention, there are: a frame in which detection of the characteristics of only the drive transistor as the characteristic detection-target circuit elements is performed: and a frame in which detection of the characteristics of only the electro-optical element as the characteristic detection-target circuit elements is performed.

According to a tenth aspect of the present invention, in the first aspect of the present invention, the current measurement period is composed of: a drive transistor characteristic detection period where a current measurement for detecting the characteristics of the drive transistor is performed; and an electro-optical element characteristic detection period where a current measurement for detecting the characteristics of the electro-optical element is performed, and the pixel circuit drive unit gives the data lines different potentials between the drive transistor characteristic detection period and the electro-optical element characteristic detection period, as the second predetermined potential.

According to an eleventh aspect of the present invention, in the tenth aspect of the present invention, when a potential given to one of the data lines in the detection preparation period is defined as Vmg, a potential given to one of the data lines in the drive transistor characteristic detection period is defined as Vm_TFT, and a potential given to one of the data lines in the electro-optical element characteristic detection period is defined as Vm_oled, a value of Vmg is determined to satisfy following expressions:

$$Vmg > Vm_TFT + Vth(T2)$$

$$Vmg < Vm_oled + Vth(T2)$$

where Vth(T2) is a threshold voltage of the drive transistor.

According to a twelfth aspect of the present invention, in the tenth aspect of the present invention, when a potential given to one of the data lines in the detection preparation period is defined as Vmg, and a potential given to one of the data lines in the drive transistor characteristic detection period is defined as Vm_TFT, a value of Vm_TFT is determined to satisfy following expressions:

$$Vm_TFT < Vmg - Vth(T2)$$

$$Vm_TFT < ELVSS + Vth(oled)$$

where Vth(T2) is a threshold voltage of the drive transistor, Vth(oled) is a light emission threshold voltage of the electro-optical element, and ELVSS is a potential of a cathode of the electro-optical element.

According to a thirteenth aspect of the present invention, in the tenth aspect of the present invention, when a potential given to one of the data lines in the detection preparation period is defined as Vmg, and a potential given to one of the data lines in the electro-optical element characteristic detection period is defined as Vm_oled, a value of Vm_oled is determined to satisfy following expressions:

$$Vm_oled > Vmg - Vth(T2)$$

$$Vm_oled > ELVSS + Vth(oled)$$

where Vth(T2) is a threshold voltage of the drive transistor, Vth(oled) is a light emission threshold voltage of the electro-optical element, and ELVSS is a potential of a cathode of the electro-optical element.

According to a fourteenth aspect of the present invention, in the tenth aspect of the present invention, when a potential given to one of the data lines in the detection preparation period is defined as Vmg, a potential given to one of the data lines in the drive transistor characteristic detection period is defined as Vm_TFT, and a potential given to one of the data lines in the electro-optical element characteristic detection period is defined as Vm_oled, values of Vmg, Vm_TFT and Vm_oled are determined to satisfy following relationships:

$$Vm_TFT < Vmg - Vth(T2)$$

$$Vm_TFT < ELVSS + Vth(oled)$$

$$Vm_oled > Vmg - Vth(T2)$$

$$Vm_oled > ELVSS + Vth(oled)$$

where Vth(T2) is a threshold voltage of the drive transistor, Vth(oled) is a light emission threshold voltage of the electro-optical element, and ELVSS is a potential of a cathode of the electro-optical element.

According to a fifteenth aspect of the present invention, in the first aspect of the present invention, the display device further comprises:

a temperature detection unit configured to detect a temperature; and a temperature change compensation unit configured to implement, for the characteristic data, a correction that is based on the temperature detected by the temperature detection unit, wherein data subjected to the correction by the temperature change compensation unit is stored as the correction data in the correction data storage unit.

According to a sixteenth aspect of the present invention, in the first aspect of the present invention, the display device further comprises a monitor region storage unit configured to store information for identifying a region where the characteristic detection processing is performed last in an event where a power supply is turned OFF, wherein, after the power supply is turned ON, the characteristic detection processing is performed from a region in a vicinity of a region obtained based on information stored in the monitor region storage unit.

A seventeenth aspect of the present invention is directed to a drive method of a display device including: a pixel matrix of n rows and m columns (n and m are integers of 2 or more), which is composed of n×m pieces of pixel circuits each including an electro-optical element in which brightness is controlled by a current and including a drive transistor for controlling a current to be supplied to the electro-optical element; scanning lines provided to correspond to respective rows of the pixel matrix; monitor control lines provided to correspond to the respective rows of the pixel matrix; and data lines provided to correspond to respective columns of the pixel matrix, the drive method comprising:

a pixel circuit driving step of driving the scanning lines, the monitor control lines and the data lines so that characteristic detection processing for detecting characteristics of characteristic detection-target circuit elements including at least either of the electro-optical element and the drive transistor is performed in a frame period, and that each electro-optical element emits light in response to target brightness;

a correction data storing step of storing characteristic data, which are obtained based on results of the characteristic detection processing, as correction data for correcting video signals, in a correction data storage unit prepared in advance; and a video signal correction step of correcting the video signals based on the correction data stored in the correction data storage unit, and generating data signals to be supplied to the n×m pieces of pixel circuits, wherein each of the pixel circuits includes:

the electro-optical element;

an input transistor, in which a control terminal is connected to one of the scanning lines, a first conductive terminal is connected to one of the data lines, and a second conductive terminal is connected to the control terminal of the drive transistor; a monitor control transistor, in which a control terminal is connected to one of the monitor control lines, a first conductive terminal is connected to the second conductive terminal of the drive transistor and to the anode of the electro-optical element, and a second conductive terminal is connected to one of the data lines;

the drive transistor in which a first conductive terminal is given a drive power supply potential; and a first capacitor in which one end is connected to a control terminal of the drive transistor in order to hold a potential of the control terminal of the drive transistor, wherein, when a row in which the characteristic detection processing is performed in the frame period is defined as a monitor row, and each of rows other than the monitor row is defined as a non-monitor row, the frame period includes a characteristic detection processing period composed of: a detection preparation period where a preparation for detecting characteristics of the characteristic detection-target circuit elements is performed in the monitor row; a current measurement period where the characteristics of the characteristic detection-target circuit elements are detected by measuring currents flowing through the data lines; and a light emission preparation period where a preparation for allowing the electro-optical element to emit light is performed in the monitor row, in the pixel circuit driving step, the scanning lines are driven so that the input transistor becomes an ON state during the detection preparation period and the light emission preparation period, and that the input transistor becomes an OFF state during the current measurement period, the monitor control lines are driven so that the monitor control transistor becomes an OFF state during the detection preparation period and the light emission preparation period, and that the monitor control transistor becomes an ON state during the current measurement period, the data lines are given a first predetermined potential during the detection preparation period, the first predetermined potential being determined based on the characteristics of the electro-optical element and the characteristics of the drive transistor, the data lines are given a second predetermined potential during the current measurement period, the second predetermined potential serving for allowing a current in accordance with the characteristics of each of the characteristic detection-target circuit elements to flow through each of the data lines, and the data lines are given a potential in accordance with a target brightness of the electro-optical element during the light emission preparation period.

Effects of the Invention

According to the first aspect of the present invention, in a display device that has the pixel circuits, each including the electro-optical element (for example, an organic EL element) in which the brightness is controlled by the current, and including the drive transistor for controlling the current to be supplied to the electro-optical element, the characteristics of the circuit elements (at least either one of the electro-optical element and the drive transistor) are detected in the frame period. Then, the video signals are corrected by using the correction data obtained in consideration of a result of the detection. The data signals which are based on the video signals thus corrected are supplied to the pixel circuits, and accordingly, a drive current with such a magnitude that compensates for the deterioration of the circuit elements is supplied to the electro-optical element. Here, the characteristics of the circuit elements are detected by measuring the currents flowing through the data lines. That is to say, the data lines are not only used as signal lines which transfer signals for allowing the electro-optical elements in the respective pixel circuits to emit light at desired brightness, but are also used as characteristic detecting signal lines. Therefore, it is not necessary to provide new signal lines in the display unit in order to detect the characteristics of the circuit elements. Hence, it becomes possible to compensate for the deterioration of the circuit elements while suppressing the increase of the circuit scale.

According to the second aspect of the present invention, without complicating the configuration of the pixel circuit drive unit, it becomes possible to use the data lines as the characteristic detecting signal lines as well as the signal lines which transfer the signals for allowing the electro-optical elements in the respective pixel circuits to emit light at the desired brightness.

According to the third aspect of the present invention, in the display device adopting the source share driving (SSD) method, it becomes possible to compensate for the deterioration of the circuit elements while suppressing the increase of the circuit scale.

According to the fourth aspect of the present invention, unlike the configuration in which the characteristic detection processing period is provided in the vertical retrace line period, it is sufficient to perform the writing in the monitor row, which corresponds to the target brightness, only once for a frame period.

According to the fifth aspect of the present invention, the potential of each of the data signals is adjusted in consideration that a length of the light emission period of the electro-optical element in the monitor row becomes shorter than a length of the light emission period of the electro-optical element in the non-monitor row. Therefore, the decrease of the display quality is suppressed.

According to the sixth aspect of the present invention, for the monitor row, after the writing in the vertical scanning period, the writing is performed one more time in the light emission preparation period during the vertical retrace line period. With regard to this, in order that the writing in the light emission preparation period can be enabled, it is necessary to hold the corresponding data after the writing in the vertical scanning period. With regard to this, the data to be held is no more than data equivalent to one line, and accordingly, an increase of a memory capacity is slight. In contrast, in the configuration in which the characteristic detection processing period is provided in the vertical scanning period, a line memory equivalent to several ten lines are sometimes required. Accordingly, a required memory capacity is reduced in comparison with the configuration in which the characteristic detection processing period is provided in the vertical scanning period.

According to the seventh aspect of the present invention, the potential of each of the data signals is adjusted in consideration that the electro-optical element is temporarily turned OFF in the vertical retrace line period in the monitor row. Therefore, the decrease of the display quality is suppressed.

According to the eighth aspect of the present invention, it is sufficient to include the characteristic detection processing period for only one row in the frame period. Therefore, a vertical retrace line period with a sufficient length for the frame period is ensured.

According to the ninth aspect of the present invention, it is sufficient to include the characteristic detection processing period for detecting either one of the characteristics of the electro-optical element and the characteristics of the drive transistor in the frame period. Therefore, a vertical retrace line period with a sufficient length for the frame period is ensured.

According to the tenth aspect of the present invention, the characteristics of the electro-optical element and the drive transistor are detected in the frame period. Therefore, it becomes possible to compensate for both of the deterioration of the electro-optical element and the deterioration of the drive transistor while suppressing the increase of the circuit scale.

According to the eleventh aspect of the present invention, the drive transistor surely turns to the ON state in the drive transistor characteristic detection period, and the electro-optical element surely turns to the ON state in the electro-optical element characteristic detection period.

According to the twelfth aspect of the present invention, in the drive transistor characteristic detection period, the drive transistor surely turns to the ON state, and in addition, the electro-optical element surely turns to the OFF state.

According to the thirteenth aspect of the present invention, in the electro-optical element characteristic detection period, the drive transistor surely turns to the OFF state, and in addition, the electro-optical element surely turns to the ON state.

According to the fourteenth aspect of the present invention, in the drive transistor characteristic detection period, the drive transistor surely turns to the ON state, and in addition, the electro-optical element surely turns to the OFF state. Moreover, in the electro-optical element characteristic detection period, the drive transistor surely turns to the OFF state, and in addition, the electro-optical element surely turns to the ON state.

According to the fifteenth aspect of the present invention, the video signals are corrected by using the correction data in which the temperature change is taken into consideration. Therefore, it becomes possible to compensate for both of the deterioration of the drive transistor and the deterioration of the electro-optical element irrespective of the change of the temperature.

According to the sixteenth aspect of the present invention, a difference in number of detection times of the characteristics of the characteristic detection-target circuit element is prevented from occurring between the upper rows and the lower rows. Therefore, it becomes possible to perform the compensation, which is made for the deterioration of such characteristic detection-target circuit elements, uniformly on the entire screen, and the occurrence of the brightness variations is prevented effectively.

According to the seventeenth aspect of the present invention, similar effects to those of the first aspect of the present invention can be exerted in the invention of the drive method for the display device.

BRIEF DESCRIPTION OF THE DRAWINGS

FIG. 8 is a table for explaining a transition of the operations in respective rows in the embodiment.

FIG. 30 is a table for explaining a transition of operations in respective rows in a fourth modification example of the embodiment.

MODES FOR CARRYING OUT THE INVENTION

A description is made below of an embodiment of the present invention while referring to the accompanying drawings. Note that, in the following, it is assumed that m and n are integers of 2 or more, that i is an integer of 1 or more to n or less, and that j is an integer of 1 or more to m or less. Moreover, in the following, characteristics of a drive transistor provided in a pixel circuit are referred to as "TFT characteristics", and characteristics of an organic EL element provided in the pixel circuit are referred to as "OLED characteristics".

<1. Overall Configuration>

Figure 2:
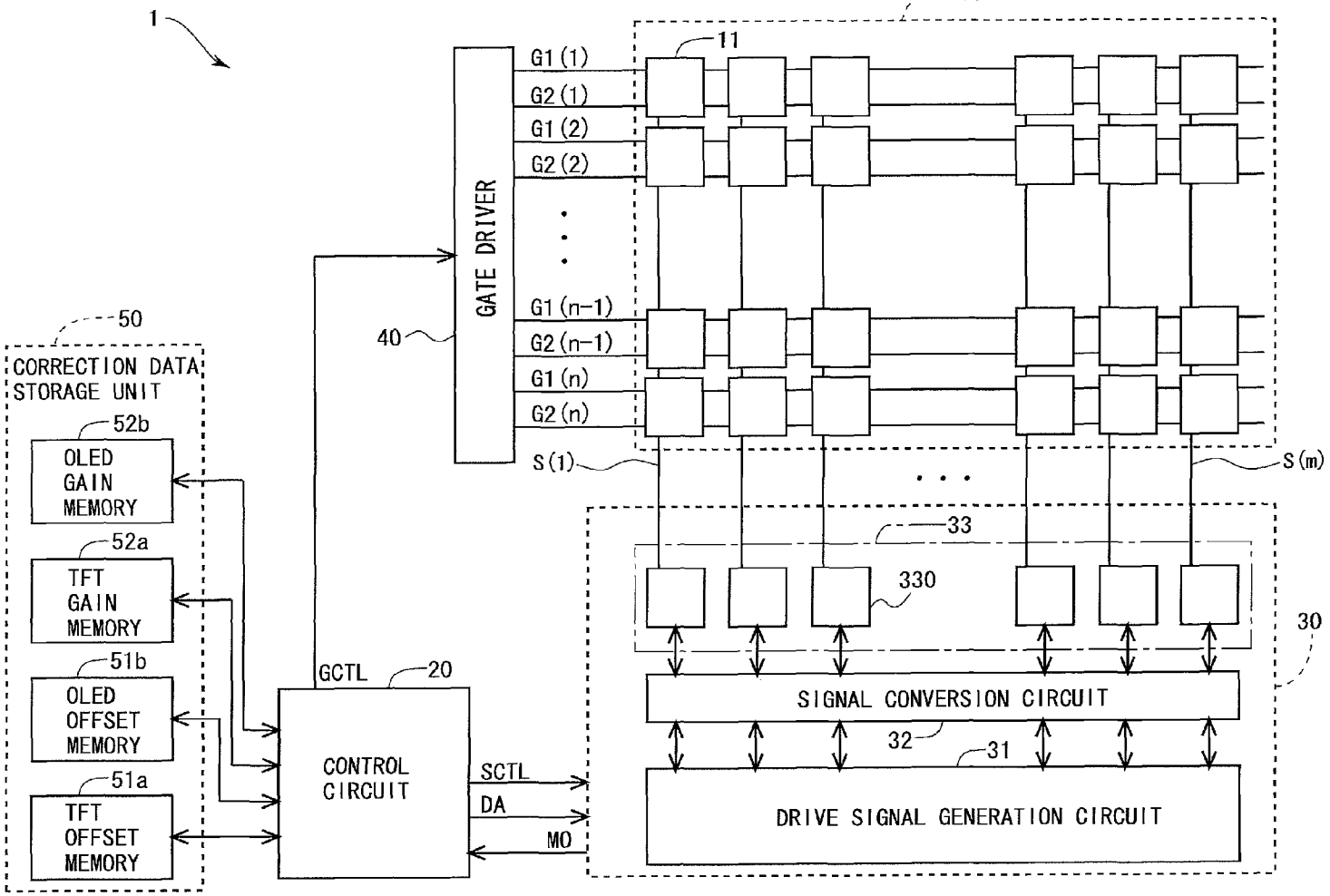
FIG. 2 is a block diagram showing an overall configuration of an active matrix-type organic EL display device according to the embodiment.

FIG. 2 is a block diagram showing an overall configuration of an active matrix-type organic EL display device 1 according to an embodiment of the present invention. This organic EL display device 1 includes: a display unit 10; a control circuit 20; a source driver (a data line drive circuit) 30; a gate driver (a scanning line drive circuit) 40; and a correction data storage unit 50. In this embodiment, a pixel circuit drive unit is realized by the source driver 30 and the gate driver 40. Note that a configuration in which either one or both of the source driver 30 and the gate driver 40 are formed integrally with the display unit 10 may be adopted.

In the display unit 10, m pieces of data lines S(1) to S(m) and n pieces of scanning lines G1(1) to G1(n) perpendicular thereto are arranged. In the following, an extending direction of the data lines is defined as a Y-direction, and an extending direction of the scanning lines is defined as an X-direction. Constituents which go along the Y-direction are sometimes referred to as "columns", and constituents which go along the X-direction are sometimes referred to as "rows". Moreover, in the display unit 10, n pieces of monitor control lines G2(1) to G2(n) are arranged so as to correspond to the n pieces of scanning lines G1(1) to G1(n) in a one-to-one relationship. The scanning lines G1(1) to G1(n) and the monitor control lines G2(1) to G2(n) are parallel to each other. Moreover, in the display unit 10, n×m pieces of pixel circuits 11 are provided so as to correspond to crossing points of the n pieces of scanning lines G1(1) to G1(n) and the m pieces of data lines S(1) to S(m). The n×m pieces of pixel circuits 11 are provided as described above, whereby a pixel matrix with n rows and m columns is formed in the display unit 10. Moreover, in the display unit 10, there are arranged: high-level power supply lines which supply a high-level power supply voltage; and low-level power supply lines which supply a low-level power supply voltage.

Note that, in the following, in a case where it is not necessary to distinguish the m pieces of data lines S(1) to S(m) from one another, the data lines are simply denoted by reference symbol S. In a similar way, in a case where it is not necessary to distinguish the n pieces of scanning lines G1(1) to G1(n) from one another, the scanning lines are simply denoted by reference symbol G1, and in a case where it is not necessary to distinguish the n pieces of monitor control lines G2(1) to G2(n) from one another, the monitor control lines are simply denoted by reference symbol G2.

The data lines S in this embodiment are not only used as signal lines which transfer brightness signals for allowing organic EL elements in the pixel circuits 11 to emit light at desired brightness, but are also used as signal lines for giving the pixel circuits 11 control potentials for detecting TFT characteristics and OLED characteristics and as signal lines which become routes of currents indicating the TFT characteristics and the OLED characteristics and being measurable by output and current-monitor circuits 330 to be described later.

The control circuit 20 controls operations of the source driver 30 by giving a data signal DA and a source control signal SCTL to the source driver 30, and controls operations of the gate driver 40 by giving a gate control signal GCTL to the gate driver 40. The source control signal SCTL includes, for example, a source start pulse, a source clock, and a latch strobe signal. The gate control signal GCTL includes, for example, a gate start pulse, a gate clock and an output enable signal. Moreover, the control circuit 20 receives monitor data MO given from the source driver 30, and updates correction data stored in the correction data storage unit 50. Note that the monitor data MO is data measured in order to obtain the TFT characteristics and the OLED characteristics.

The gate driver 40 is connected to the n pieces of scanning lines G1(1) to G1(n) and the n pieces of monitor control lines G2(1) to G2(n). The gate driver 40 is composed of a shift register, a logic circuit and the like. Incidentally, in the organic EL display device 1 according to this embodiment, a video signal (data serving as an origin of the above-described data signal DA), which is sent from an outside, is corrected based on the TFT characteristics and the OLED characteristics. With regard to this, in this embodiment, in each of frames, detection of the TFT characteristics and the OLED characteristics is performed for one row. That is to say, when the detection of the TFT characteristics and the OLED characteristics for a first row is performed in a certain frame, detection of the TFT characteristics and the OLED characteristics for a second row is performed in a next frame, and detection of the TFT characteristics and the OLED characteristics for a third row is performed in a frame next to the next frame. In such a way, during an n frame period, detection of the TFT characteristics and the OLED characteristics for n rows is performed. Note that, in this description, a row for which the detection of the TFT characteristics and the OLED characteristics is performed at a time of focusing on any frame is referred to as a "monitor row", and rows other than the monitor row are referred to as "non-monitor rows".

Figure 3:
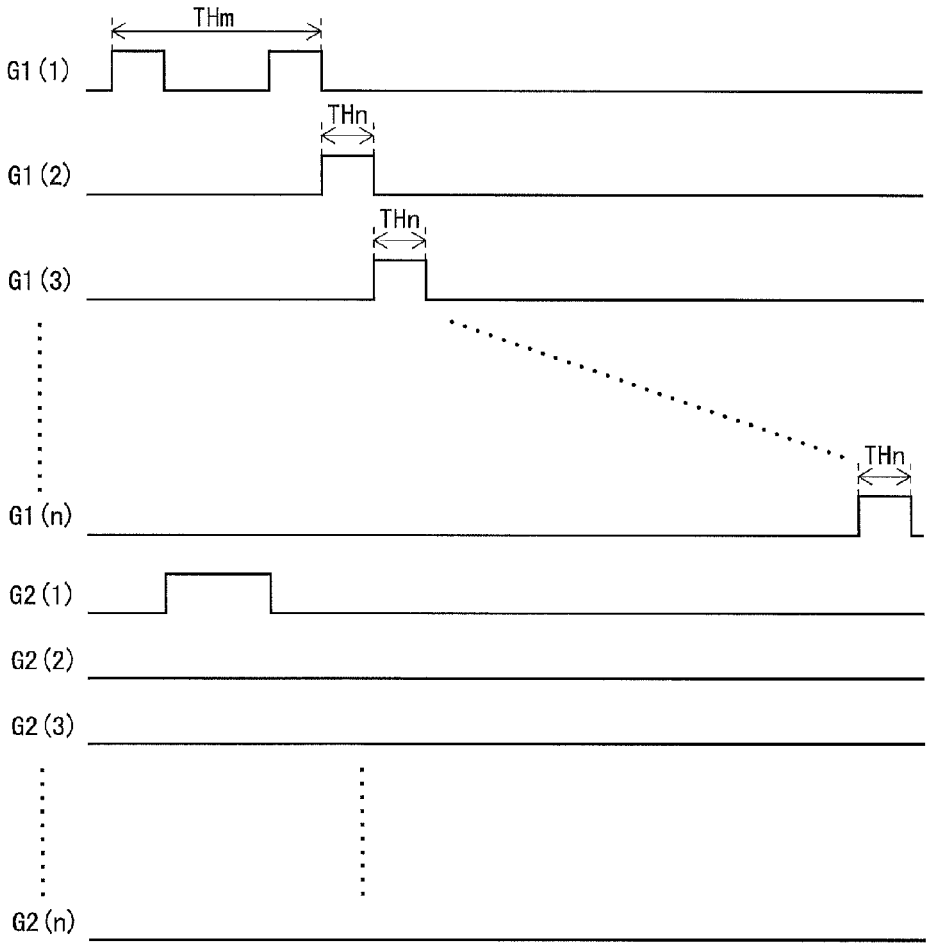
FIG. 3 is a timing chart for explaining operations of a gate driver in the embodiment.
Figure 4:
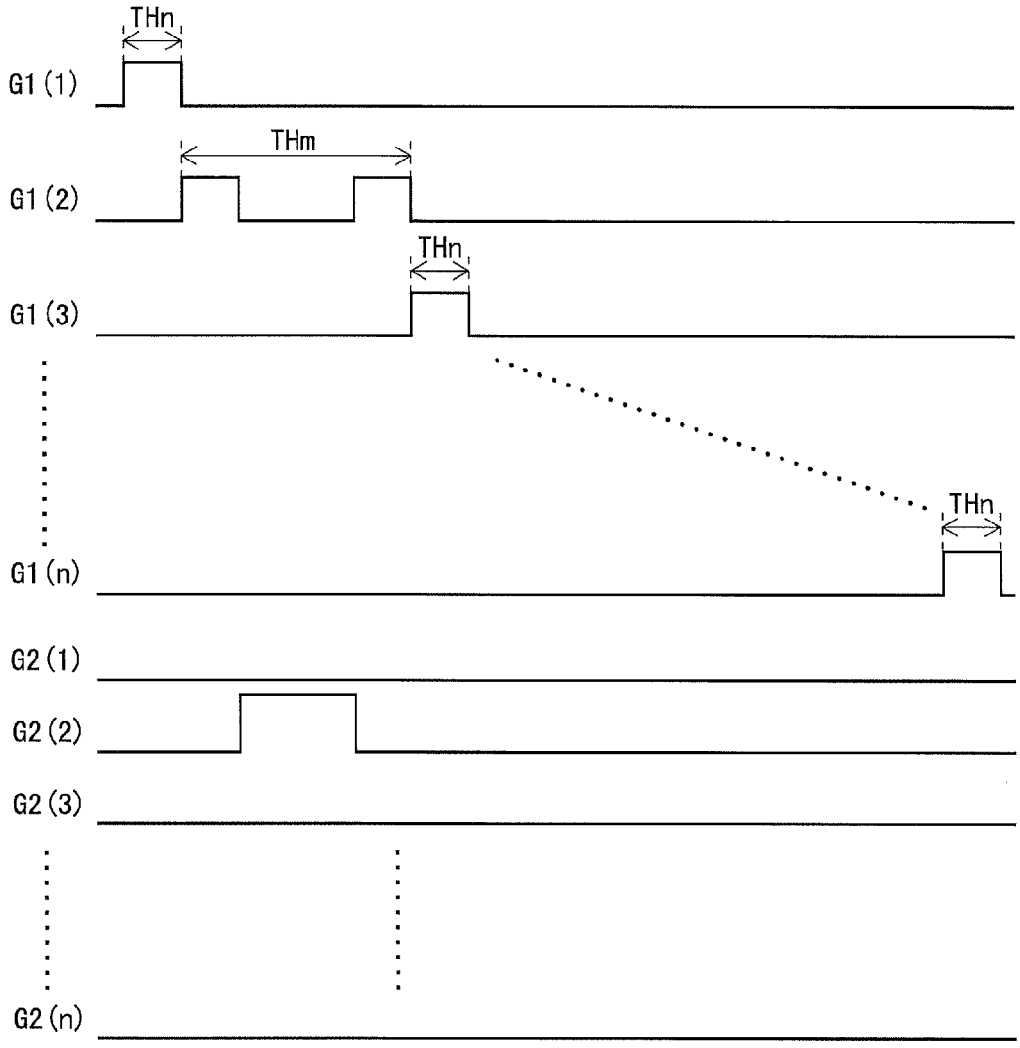
FIG. 4 is a timing chart for explaining the operations of the gate driver in the embodiment.
Figure 5:
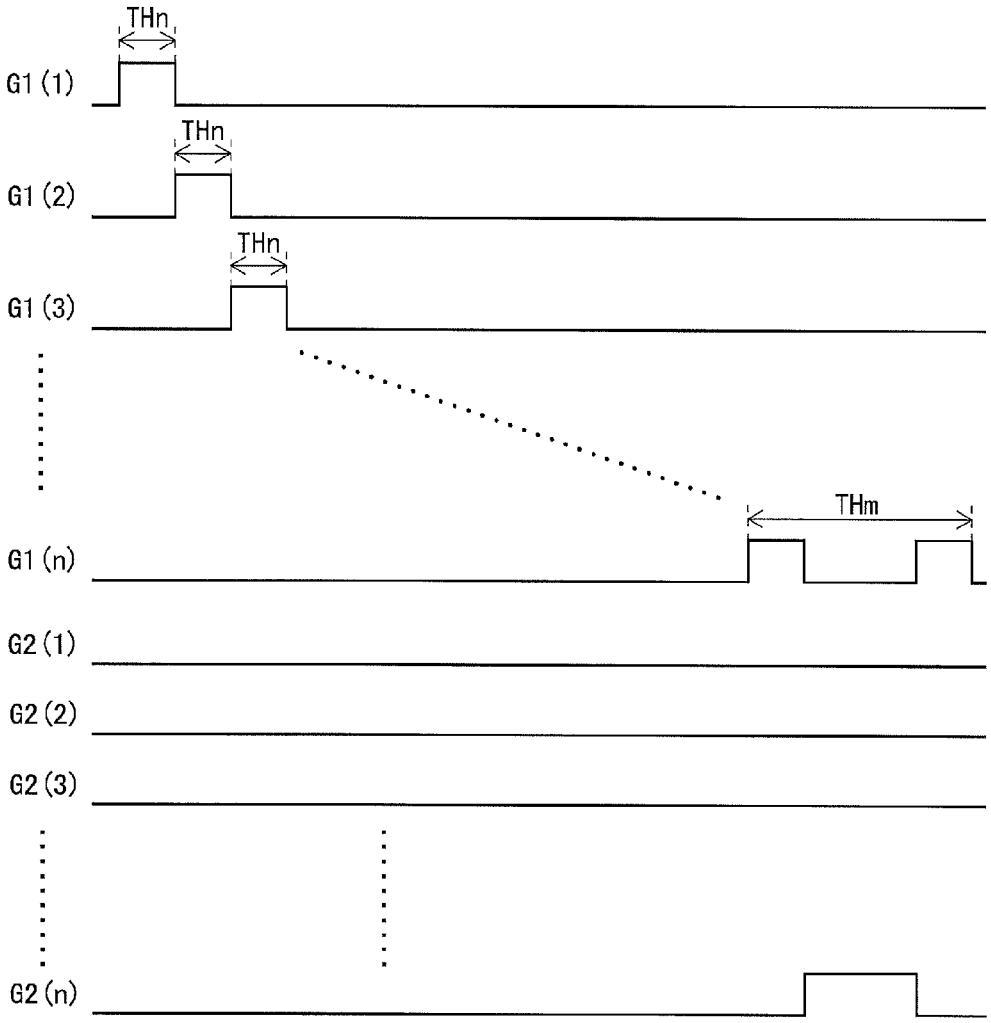
FIG. 5 is a timing chart for explaining the operations of the gate driver in the embodiment.

Here, when the frame in which the detection of the TFT characteristics and the OLED characteristics for the first row is performed is defined as a (k+1)-th frame, then the n pieces of scanning lines G1(1) to G1(n) and the n pieces of monitor control lines G2(1) to G2(n) are driven as shown in FIG. 3 in the (k+1)-th frame, are driven as shown in FIG. 4 in a (k+2)-th frame, and are driven as shown in FIG. 5 in a (k+n)-th frame. Note that, with regard to FIG. 3 to FIG. 5, a high-level state is an active state. Moreover, in FIG. 3 to FIG. 5, one horizontal scanning period for the monitor row is denoted by reference symbol THm, and one horizontal scanning period for each of the non-monitor rows is denoted by reference symbol THn.

As grasped from FIG. 3 to FIG. 5, a length of one horizontal scanning period differs between the monitor row and the non-monitor row. Specifically, a length of one horizontal scanning period for the monitor row is four times a length of one horizontal scanning period for the non-monitor row. However, the present invention is not limited to this. With regard to the non-monitor row, there is one selection period during one frame period in a similar way to a general display device. With regard to the monitor row, there are two selection periods during one frame period unlike the general display device. A first selection period is a first one-fourth period in the one horizontal scanning period THm, and a second selection period is a last one-fourth period in the one horizontal scanning period THm. Note that a more detailed description of the one horizontal scanning period THm for the monitor row will be made later.

As shown in FIG. 3 to FIG. 5, in each of the frames, the monitor control lines G2 corresponding to the non-monitor rows are maintained in an inactive state. The monitor control line G2 corresponding to the monitor row is maintained in an active state during a period other than the selection period in the one horizontal scanning period THm (that is, a period while the scanning line G1 is in the inactive state). In this embodiment, the gate driver 40 is configured so that the n pieces of scanning lines G1(1) to G1(n) and the n pieces of monitor control lines G2(1) to G2(n) can be driven in such a way as described above. Note that, in order to generate two pulses in the scanning line G1 during one frame period in the monitor row, a waveform of the output enable signal sent from the control circuit 20 to the gate driver 40 just needs to be controlled by using a method known in public.

The source driver 30 is connected to the m pieces of data lines S(1) to S(m). The source driver 30 is composed of: a drive signal generation circuit 31; a signal conversion circuit 32; and an output unit 33 made of m pieces of output and current-monitor circuits 330. The m pieces of output and current-monitor circuits 330 in the output unit 33 are individually connected to the corresponding data lines S among the m pieces of data lines S(1) to S(m).

The drive signal generation circuit 31 includes a shift register, a sampling circuit and a latch circuit. In the drive signal generation circuit 31, the shift register sequentially transfers the source start pulse from an input end to an output end in synchronization with the source clock. In response to this transfer of the source start pulse, sampling pulses corresponding to the respective data lines S are outputted to the data lines S from the shift register. The sampling circuit sequentially stores such data signals DA, which are equivalent to one row, in accordance with timing of the sampling pulses. The latch circuit captures and holds the data signals DA for one row which are stored in the sampling circuit, in response to the latch strobe signal.

Note that, in this embodiment, each of the data signals DA includes: a brightness signal for allowing the organic EL element of each pixel to emit light at desired brightness; and a monitor control signal for controlling the operations of the pixel circuit 11 in an event of detecting the TFT characteristics and the OLED characteristics.

The signal conversion circuit 32 includes: a D/A converter and an A/D converter. The data signals DA for one row which are held in the latch circuit in the drive signal generation circuit 31 as mentioned above, are converted into analog voltages by the D/A converter in the signal conversion circuit 32. The analog voltages thus converted are given to the output and current-monitor circuits 330 in the output unit 33. Moreover, the signal conversion circuit 32 is given monitor data MO from the output and current-monitor circuits 330 in the output unit 33. The monitor data MO are converted from the analog voltages into digital signals in the A/D converter in the signal conversion circuit 32. Then, the monitor data MO converted into the digital signals are given to the control circuit 20 via the drive signal generation circuit 31.

Figure 6:
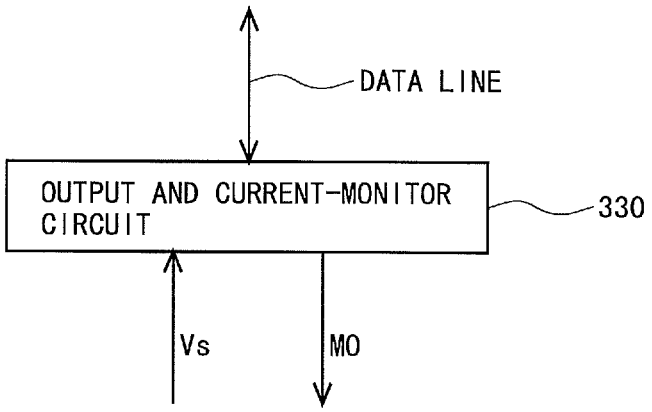
FIG. 6 is a diagram for explaining input-output signals of an output and current-monitor circuit in an output unit in the embodiment.

FIG. 6 is a diagram for explaining input-output signals of the output and current-monitor circuit 330 in the output unit 33. Each of the output and current-monitor circuits 330 is given an along voltage Vs as the data signal DA from the signal conversion circuit 32. The analog voltage Vs is applied to the data line S via a buffer in the output and current-monitor circuit 330. Moreover, the output and current-monitor circuit 330 has a function to measure the current flowing through the data line S. Data measured by the output and current-monitor circuit 330 is given as the monitor data MO to the signal conversion circuit 32. Note that a detailed configuration of the output and current-monitor circuit 330 will be described later (refer to FIG. 7).

The correction data storage unit 50 includes: a TFT offset memory 51*a*; an OLED offset memory 51*b*; a TFT gain memory 52*a*; and an OLED gain memory 52*b*. Note that these four memories may be a physically single memory, or maybe physically different memories. The correction data storage unit 50 stores the correction data for use in correcting the video signal sent from the outside. Specifically, the TFT offset memory 51*a* stores an offset value, which is based on a detection result of the TFT characteristics, as the correction data. The OLED offset memory 51*b* stores an offset value, which is based on a detection result of the OLED characteristics, as the correction data. The TFT gain memory 52*a* stores a gain value, which is based on a detection result of the TFT characteristics, as the correction data. The OLED gain memory 52*b* stores a deterioration correction coefficient, which is based on a detection result of the OLED characteristics, as the correction data. Note that, typically, such offset values, the number of which is equal to the number of pixels in the display unit 10, and such gain values, the number of which is equal thereto, are stored as the correction data, which are based on the detection results of the TFT characteristics, in the TFT offset memory 51*a* and the TFT gain memory 52*a*, respectively. Moreover, typically, such offset values, the number of which is equal to the number of pixels in the display unit 10, and such deterioration correction coefficients, the number of which is equal thereto, are stored as the correction data, which are based on the detection results of the OLED characteristics, in the OLED offset memory 51*b* and the OLED gain memory 52*b*, respectively. However, in each of the memories, a single value may be stored for each unit of a plurality of the pixels.

Based on the monitor data MO given from the source driver 30, the control circuit 20 updates the offset values in the TFT offset memory 51*a*, the offset values in the OLED offset memory 51*b*, the gain values in the TFT gain memory 52*a* and the deterioration correction coefficients in the OLED gain memory 52*b*. Moreover, the control circuit 20 reads out the offset values in the TFT offset memory 51*a*, the offset values in the OLED offset memory 51*b*, the gain values in the TFT gain memory 52*a* and the deterioration correction coefficients in the OLED gain memory 52*b*, and corrects the video signal. Data obtained by the correction is sent as the data signal DA to the source driver 30.

<2. Configurations of Pixel circuit and Output and Current-Monitor Circuit>

<2.1 Pixel Circuit>

Figure 7:
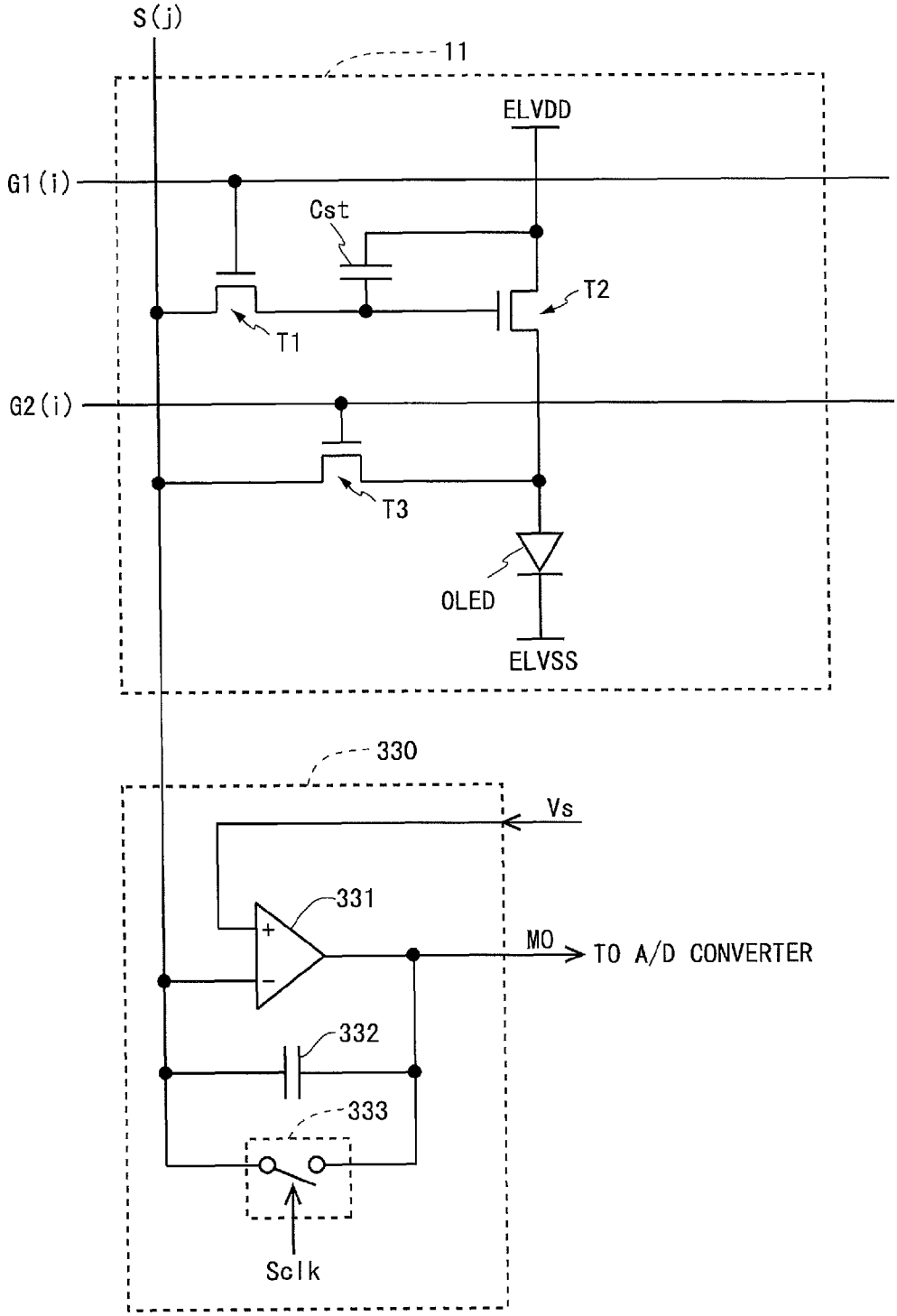
FIG. 7 is a circuit diagram showing configurations of a pixel circuit and the output and current-monitor circuit in the embodiment.

FIG. 7 is a circuit diagram showing configurations of the pixel circuit 11 and the output and current-monitor circuit 330. Note that the pixel circuit 11 shown in FIG. 7 is the pixel circuit 11 on the i-th row and the j-th column. This pixel circuit 11 includes: one organic EL element OLED: three transistors T1 to T3; and one capacitor Cst. The transistor T1 functions as an input transistor that selects the pixel, the transistor T2 functions as a drive transistor that controls the supply of the current to the organic EL element OLED, and the transistor T3 functions as a monitor control transistor that controls whether or not to detect the TFT characteristics and the OLED characteristics.

The transistor T1 is provided between the data line S(j) and a gate terminal of the transistor T2. With regard to the transistor T1, a gate terminal thereof is connected to the scanning line G1(i), and a source terminal thereof is connected to the data line S(j). The transistor T2 is provided in series to the organic EL element OLED. With regard to the transistor T2, a gate terminal thereof is connected to a drain terminal of the transistor T1, a drain terminal thereof is connected to the high-level power supply line ELVDD, and a source terminal thereof is connected to the anode terminal of the organic EL element OLED. With regard to the transistor T3, a gate terminal thereof is connected to the monitor control line G2(i), a drain terminal thereof is connected to the anode terminal of the organic EL element OLED, and a source terminal thereof is connected to the data line S(j). With regard to the capacitor Cst, one end thereof is connected to the gate terminal of the transistor T2, and other end thereof is connected to the drain terminal of the transistor T2. Note that a first capacitor is realized by this capacitor Cst. A cathode terminal of the organic EL element OLED is connected to the low-level power supply line ELVSS.

Figure 37:
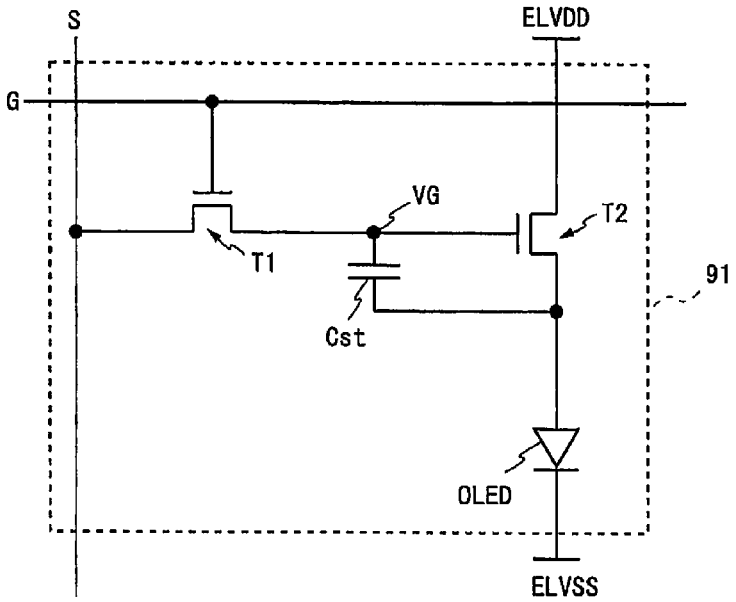
Fig.37 Conventional Art
FIG. 37 is a circuit diagram showing a configuration of a conventional general pixel circuit.
Figure 38:
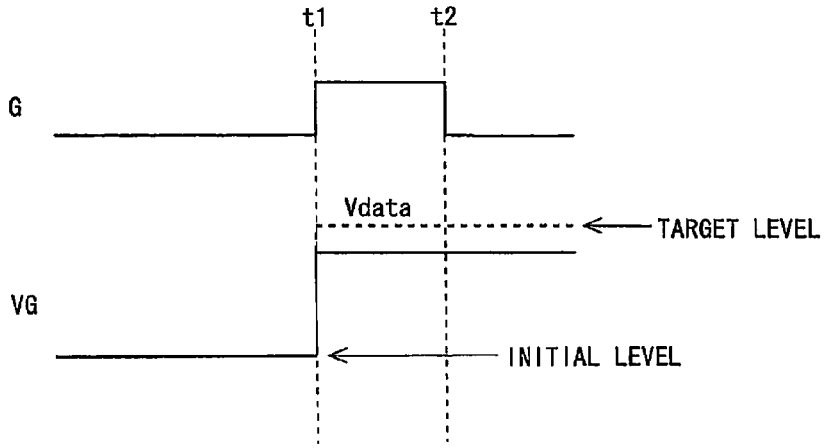
Fig.38 Conventional Art
FIG. 38 is a timing chart for explaining operations of the pixel circuit shown in FIG. 37.
Figure 39:
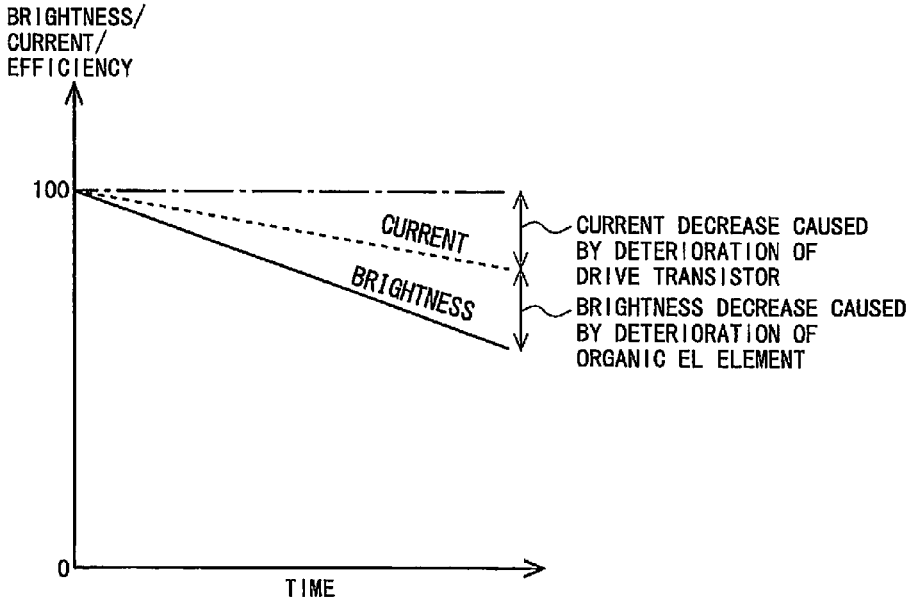
Fig.39 Conventional Art
FIG. 39 is a graph for explaining a case where no compensation is made for a deterioration of a drive transistor and a deterioration of an organic EL element.
Figure 40:
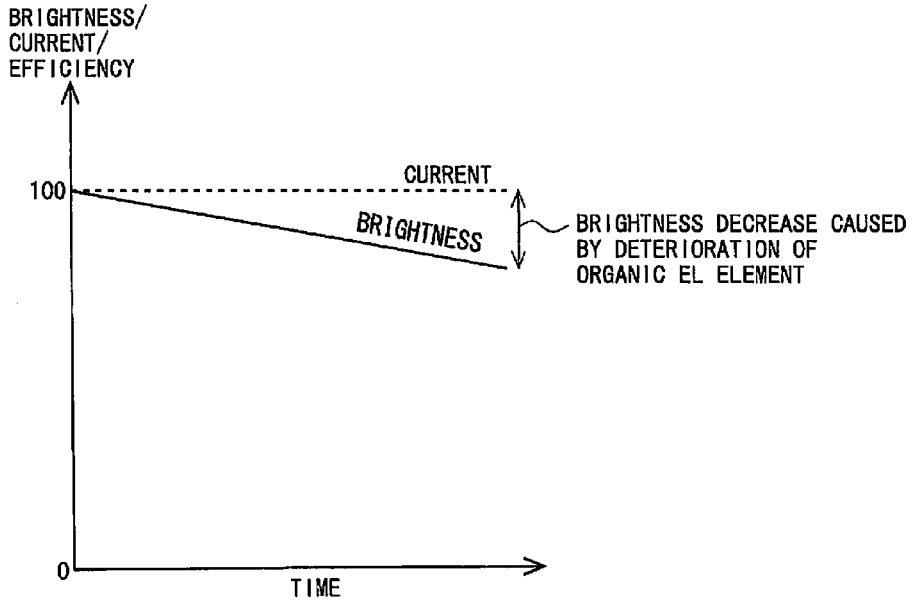
Fig.40 Conventional Art
FIG. 40 is a graph for explaining a case where the compensation is made only for the deterioration of the drive transistor.

Incidentally, in the configuration shown in FIG. 37, the capacitor Cst has been provided between the gate and source of the transistor T2. In contrast, in this embodiment, the capacitor Cst is provided between the gate and drain of the transistor T2. A reason for this is as follows. In this embodiment, during one frame period, a control to vary a potential of the data line S(j) in a state where the transistor T3 is turned ON is performed. Supposing that the capacitor Cst is provided between the gate and source of the transistor T2, then a gate potential of the transistor T2 also varies in response to the variation of the potential of the data line S(j). Then, there can occur a matter that an ON/OFF state of the transistor T2 does not become a desired state. Accordingly, in this embodiment, in order that the gate potential of the transistor T2 cannot vary in response to the variation of the potential of the data line S(j), the capacitor Cst is provided between the gate and drain of the transistor T2 as shown in FIG. 7. However, in a case where an influence given from the variation of the potential of the data line S(j) to the gate potential of the transistor T2 is small, the capacitor Cst may be provided between the gate and source of the transistor T2.

<2.2 Regarding Transistor in Pixel Circuit>

In this embodiment, all of the transistors T1 to T3 in the pixel circuit 11 are of the n-channel type. Moreover, in this embodiment, for the transistors T1 to T3, oxide TFTs (thin film transistors using an oxide semiconductor for channel layers) are adopted.

A description is made below of an oxide semiconductor layer included in each of the oxide TFTs. The oxide semiconductor layer is, for example, an In—Ga—Zn—O-based semiconductor layer. The oxide semiconductor layer contains, for example, an In—Ga—Zn—O-based semiconductor. The In—Ga—Zn—O-based semiconductor is a ternary oxide of In (indium), Ga (gallium) and Zn (zinc). A ratio (composition ratio) of In, Ga and Zn is not particularly limited. For example, the composition ratio may be In:Ga:Zn=2:2:1, In:Ga:Zn=1:1:1, In:Ga:Zn=1:1:2, and the like.

Such a TFT including the In—Ga—Zn—O-based semiconductor layer has high mobility (mobility exceeding 20 times that of an amorphous silicon TFT) and a low leak current (leak current of less than 1/100 of that of the amorphous silicon TFT). Accordingly, this TFT is suitably used as a drive TFT (the above-described transistor T2) in the pixel circuit and a switching TFT (the above-described transistor T1) therein. When the TFT including the In—Ga—Zn—O-based semiconductor layer is used, electric power consumption of the display device can be reduced to a great extent.

The In—Ga—Zn—O-based semiconductor may be amorphous, or may include a crystalline portion and have crystallinity. As the crystalline In—Ga—Zn—O-based semiconductor, a crystalline In—Ga—Zn—O-based semiconductor, in which a c-axis is oriented substantially perpendicularly to a layer surface, is preferable. A crystal structure of the In—Ga—Zn—O-based semiconductor as described above is disclosed, for example, in Japanese Patent Application Laid-Open No. 2012-134475.

The oxide semiconductor layer may contain other oxide semiconductors in place of the In—Ga—Zn—O-based semiconductor. For example, the oxide semiconductor layer may contain a Zn—O-based semiconductor (ZnO), an In—Zn—O-based semiconductor (IZO (registered trademark)), a Zn—Ti—O-based semiconductor (ZTO), a Cd—Ge—O-based semiconductor, a Cd—Pb—O-based semiconductor, a CdO (cadmium oxide), a Mg—Zn—O-based semiconductor, an In—Sn—Zn—O-based semiconductor (for example, $In_2O_3$—$SnO_2$—ZnO), an In—Ga—Sn—O-based semiconductor and the like.

<2.3 Output and Current-Monitor Circuit>

While referring to FIG. 7, a description is made of a detailed configuration of the output and current-monitor circuit 330 in this embodiment. This output and current-monitor circuit 330 includes an operational amplifier 331, a capacitor 332 and a switch 333. Note that a second capacitor is realized by the capacitor 332. With regard to the operational amplifier 331, an inverting input terminal thereof is connected to the data line S(j), and a non-inverting input terminal thereof is given the analog voltage Vs as the data signal DA. The capacitor 332 and the switch 333 are provided between an output terminal of the operational amplifier 331 and the data line S(j). As described above, this output and current-monitor circuit 330 is composed of an integrating circuit. In such a configuration, when the switch 333 is turned to an ON state by a control clock signal Sclk, an output terminal of the operational amplifier 331 and the inverting input terminal thereof turn to a short circuit state. In such a way, potentials of the output terminal of the operational amplifier 331 and the data line S(j) become equal to a potential of the analog voltage Vs. In an event where the current flowing through the data line S(j) is measured, the switch 333 is turned to an OFF state by the control clock signal Sclk. In such a way, due to the presence of the capacitor 332, the potential of the output terminal of the operational amplifier 331 changes in response to a magnitude of the current flowing through the data line S(j). An output from the operational amplifier 331 is sent as the monitor data MO to the A/D converter in the signal conversion circuit 32.

<3. Drive Method>

<3.1 Outline>

Next, a description is made of a drive method in this embodiment. As mentioned above, in this embodiment, in each of frames, the detection of the TFT characteristics and the OLED characteristics is performed for one row. In each frame, an operation for performing the detection of the TFT characteristics and the OLED characteristics (hereinafter, referred to as a "characteristic detection operation") is performed for the monitor row, and a usual operation is performed for the non-monitor row. That is to say, when the frame in which the detection of the TFT characteristics and the OLED characteristics for the first row is performed is defined as the (k+1)-th frame, then the operations in the respective rows change as shown in FIG. 8. Moreover, when the detection of the TFT characteristics and the OLED characteristics is performed, the correction data in the correction data storage unit 50 is updated by using a detection result thereof. Then, the video signal is corrected by using the correction data stored in the correction data storage unit 50.

Figure 1:
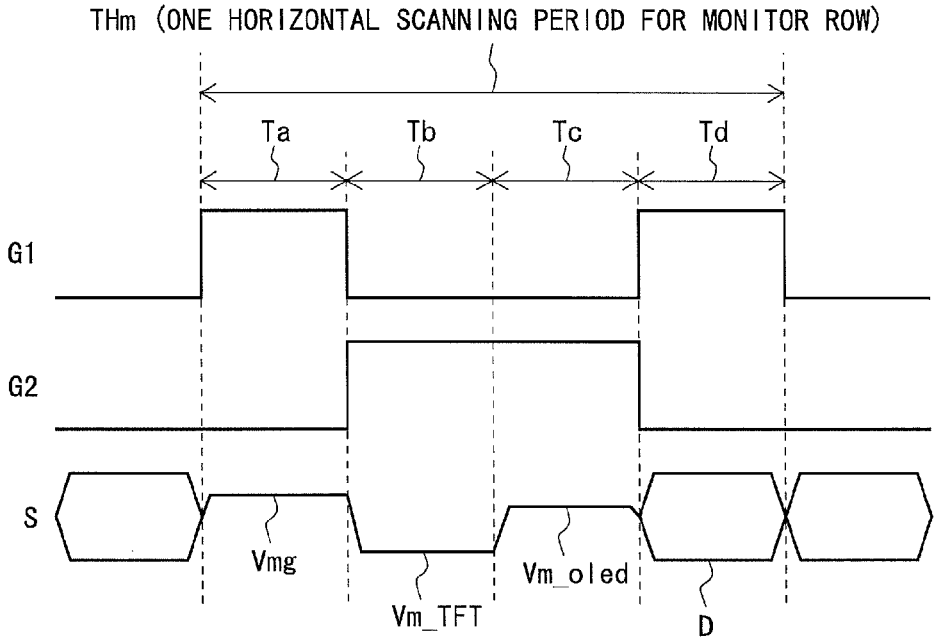
FIG. 1 is a timing chart for explaining details of one horizontal scanning period for a monitor row in an embodiment of the present invention.

FIG. 1 is a timing chart for explaining details of one horizontal scanning period THm for the monitor row. Note that a characteristic detection processing period is realized by this one horizontal scanning period THm. As shown in FIG. 1, the one horizontal scanning period THm for the monitor row is composed of: a period (hereinafter referred to as a "detection preparation period") Ta where preparation for detecting the TFT characteristics and the OLED characteristics is performed in the monitor row; a period (hereinafter referred to as a "TFT characteristic detection period") Tb where current measurement for detecting the TFT characteristics is performed; a period (hereinafter referred to as an "OLED characteristic detection period") Tc where current measurement for detecting the OLED characteristics is performed; and a period (hereinafter referred to as a "light emission preparation period) Td where preparation for allowing the organic EL element OLED to emit light is performed in the monitor row. Note that, in this embodiment, a current measurement period is realized by the TFT characteristic detection period and the OLED characteristic detection period.

During the detection preparation period Ta, the scanning line G1 is set to an active state, the monitor control line G2 is set to an inactive state, and the data line S is given a potential Vmg. During the TFT characteristic detection period Tb, the scanning line G1 is set to the inactive state, the monitor control line G2 is set to the active state, and the data line S is given a potential Vm_TFT. During the OLED characteristic detection period Tc, the scanning line G1 is set to the inactive state, the monitor control line G2 is set to the active state, and the data line S is given a potential Vm_oled. During the light emission preparation period Td, the scanning line G1 is set to the active state, the monitor control line G2 is set to the inactive state, and the data line S is given a data potential D corresponding to a target brightness of the organic EL element OLED included in the monitor row. In this embodiment, a first predetermined potential is realized by the potential Vmg, and a second predetermined potential is realized by the potential Vm_TFT and the potential Vm_oled. Note that the potential Vmg, the potential Vm_TFT and the potential Vm_oled will be described later in detail.

<3.2 Operations of Pixel Circuit>

<3.2.1 Usual Operation>

Figure 9:
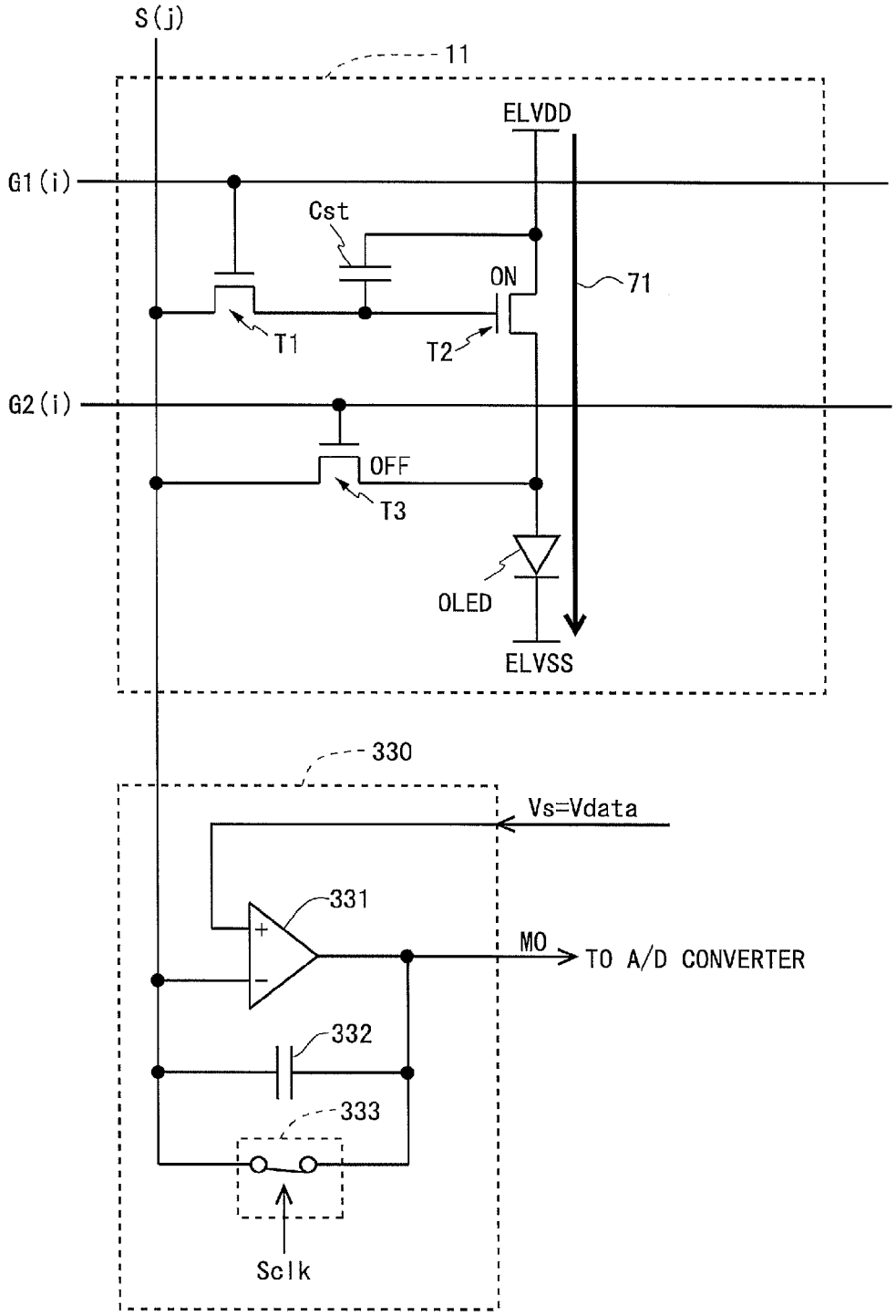
FIG. 9 is a diagram for explaining a flow of a current in an event where a usual operation is performed in the embodiment.

In each frame, the usual operation is performed in the non-monitor row. In the pixel circuit 11 included in the non-monitor row, after writing that is based on the data potential Vdata corresponding to the target brightness is performed in the selection period, the transistor T1 is maintained in the OFF state. The transistor T2 turns to the ON state by the writing that is based on the data potential Vdata. The transistor T3 is maintained in the OFF state. Thus, as shown by an arrow denoted by reference numeral 71 in FIG. 9, a drive current is supplied to the organic EL element OLED via the transistor T2. In such a way, the organic EL element OLED emits light with brightness in accordance with the drive current.

<3.2.2 Characteristic Detection Operation>

Figure 10:
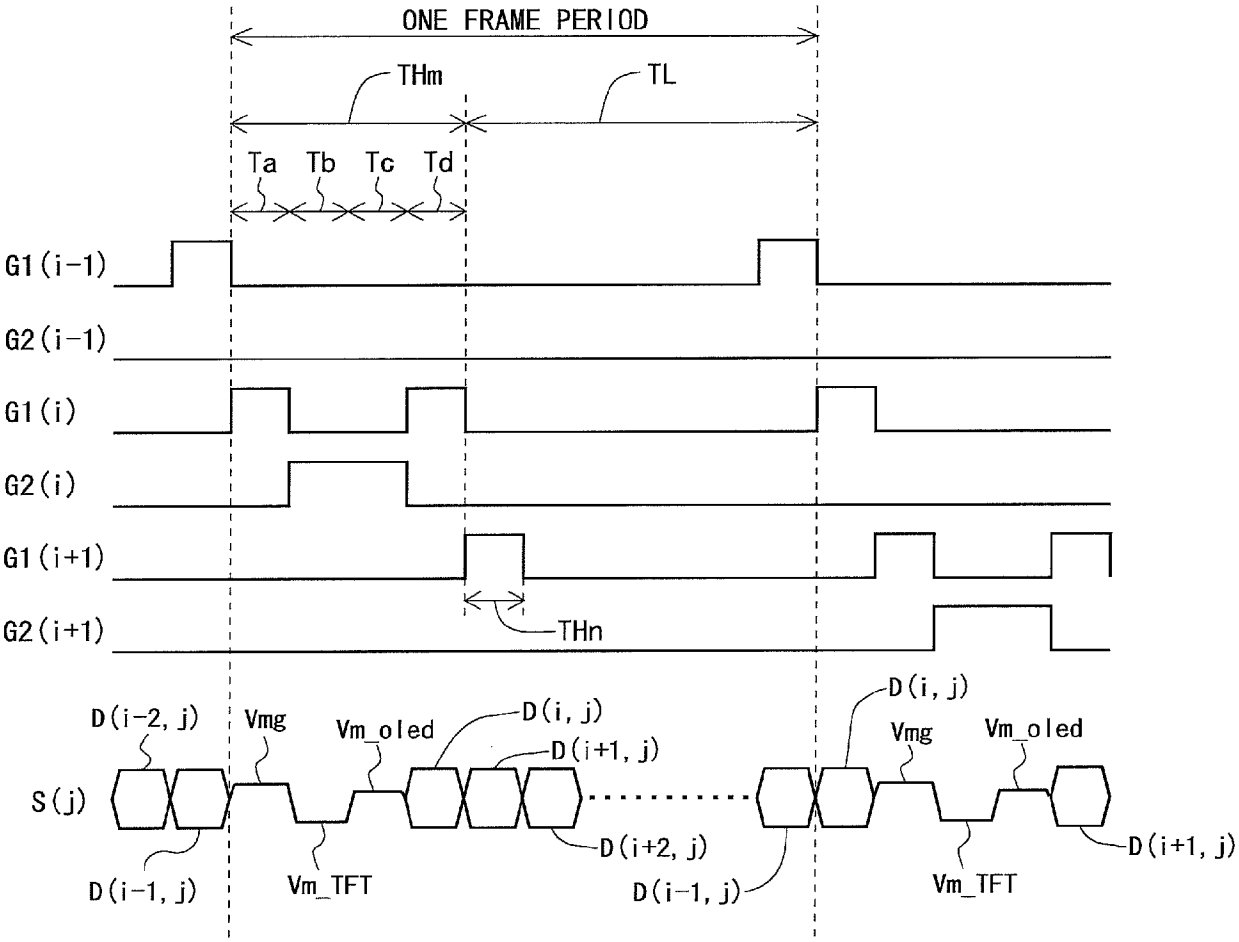
FIG. 10 is a timing chart for explaining operations of a pixel circuit (a pixel circuit on an i-th row and a j-th column) included in the monitor row in the embodiment.

In each frame, the characteristic detection operation is performed in the monitor row. FIG. 10 is a timing chart for explaining operations of the pixel circuit 11 (defined to be a pixel circuit 11 on the i-th row and the j-th column) included in the monitor row. Note that, in FIG. 10, the "one frame period" is shown while taking, as a reference, a starting point of time for a first selection period of the i-th row in the frame in which the i-th row is defined as the monitor row. Moreover, here, a period other than the above-mentioned one horizontal scanning period THm in the one frame period in the monitor row is referred to as a "light emission period". Reference symbol TL is assigned to the light emission period.

Figure 11:
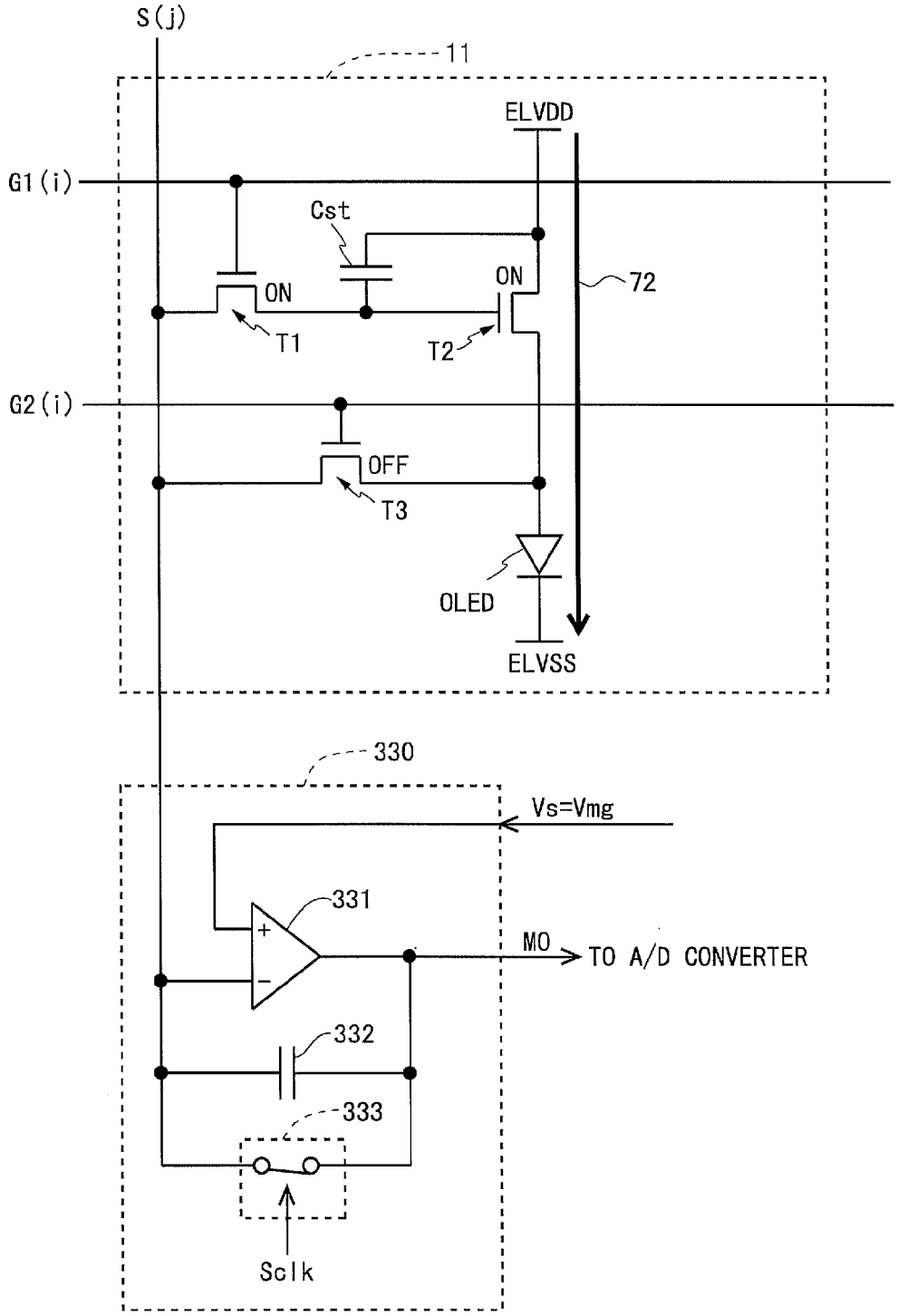
FIG. 11 is a diagram for explaining a flow of the current in a detection preparation period in the embodiment.

In the detection preparation period Ta, the scanning line G1(i) is set to the active state, and the monitor control line G2(i) is maintained in the inactive state. Thus, the transistor T1 becomes the ON state, and the transistor T3 is maintained in the OFF state. Moreover, in this period, the data line S(j) is given the potential Vmg. By writing that is based on this potential Vmg, the capacitor Cst is charged, and the transistor T2 turns to the ON state. Accordingly, in the detection preparation period Ta, as shown by an arrow denoted by reference numeral 72 in FIG. 11, a drive current is supplied to the organic EL element OLED via the transistor T2. In such a way, the organic EL element OLED emits light with the brightness in accordance with the drive current. However, it is for an extremely short time that the organic EL element OLED emits light.

In the TFT characteristic detection period Tb, the scanning line G1(i) is set to the inactive state, and the monitor control line G2(i) is set to the active state. Thus, the transistor T1 becomes the OFF state, and the transistor T3 becomes the ON state. Moreover, in this period, the data line S(j) is given the potential Vm_TFT. Note that, in the OLED characteristic detection period Tc to be described later, the data line S(j) is given the potential Vm_oled. Moreover, as mentioned above, in the detection preparation period Ta, the writing that is based on the potential Vmg is performed.

Here, when a threshold voltage of the transistor T2, which is obtained based on the offset value stored in the TFT offset memory 51*a*, is defined as Vth(T2), a value of the potential Vmg, a value of the potential Vm_TFT and a value of the potential Vm_oled are set so that the following Expressions (1) and (2) are established.

$$Vm_TFT+Vth(T2)<Vmg \quad (1)$$

$$Vmg<Vm_oled+Vth(T2) \quad (2)$$

Moreover, when a light emission threshold voltage of the organic EL element OLED, which is obtained based on the offset value stored in the OLED offset memory 51*b*, is defined as Vth(oled), the value of the potential Vm_TFT is set so that the following Expression (3) is established.

$$Vm_TFT<ELVSS+Vth(oled) \quad (3)$$

Moreover, when a breakdown voltage of the organic EL element OLED is defined as Vbr(oled), the value of the potential Vm_TFT is set so that the following Expression (4) is established.

$$Vm_TFT>ELVSS-Vbr(oled) \quad (4)$$

As described above, after the writing that is based on the potential Vmg that satisfies the above Expressions (1) and (2) is performed in the detection preparation period Ta, the data line S(j) is given the potential Vm_TFT that satisfies the above Expressions (1), (3) and (4) in the TFT characteristic detection period Tb. Based on the above Expression (1), the transistor T2 becomes the ON state in the TFT characteristic detection period Tb. Moreover, based on the above Expressions (3) and (4), a current does not flow through the organic EL element OLED in the TFT characteristic detection period Tb.

Figure 12:
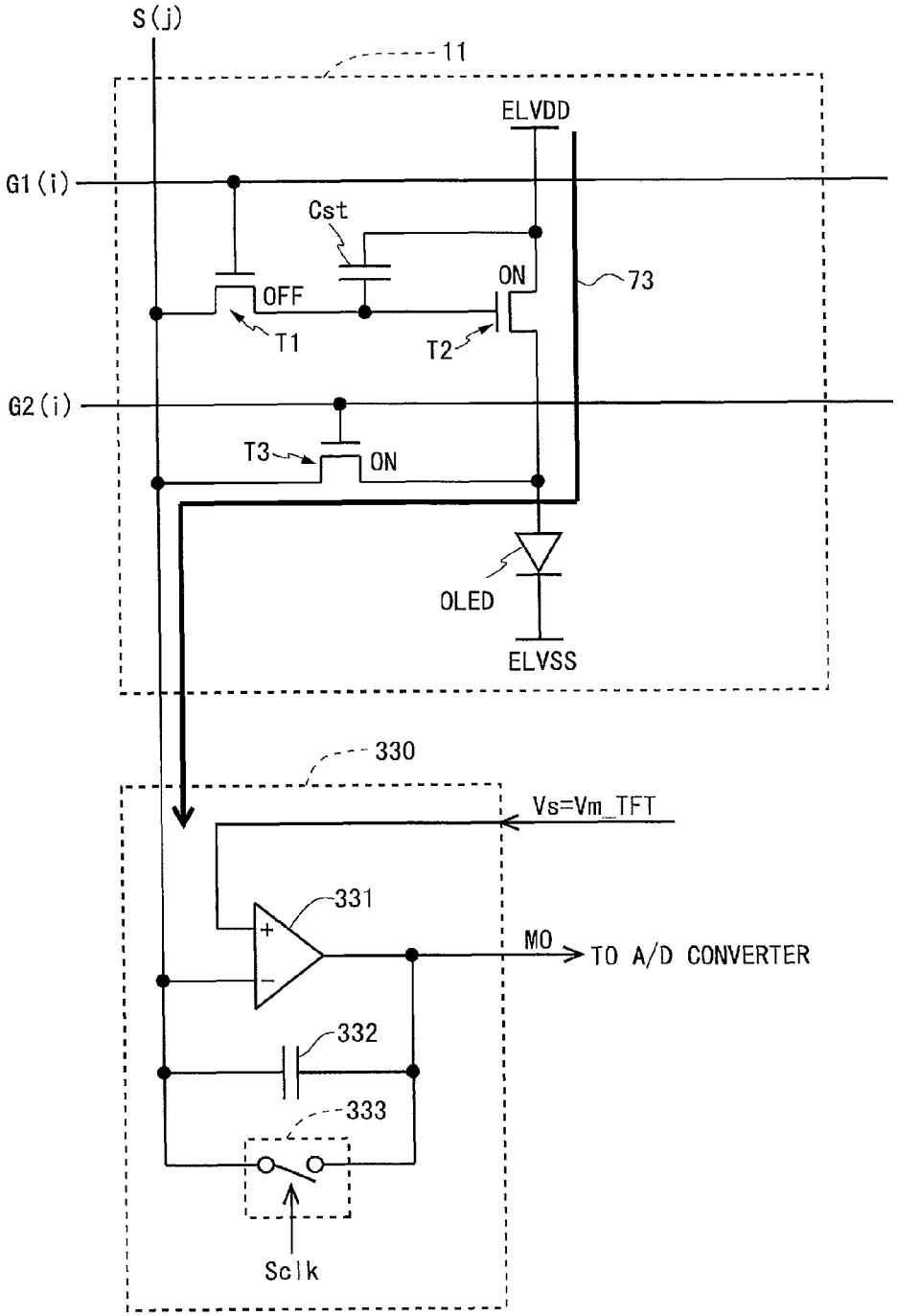
FIG. 12 is a diagram for explaining a flow of the current in a TFT characteristic detection period in the embodiment.

Thus, in the TFT characteristic detection period Tb, the current flowing through the transistor T2 is outputted to the data line S(j) via the transistor T3 as shown by an arrow denoted by reference numeral 73 in FIG. 12. In such a way, the current (sink current) outputted to the data line S(j) is measured by the output and current-monitor circuit 330. In such a manner as described above, a magnitude of the current flowing between the drain and source of this transistor T2 in a state where the voltage between the gate and source of the transistor T2 is set to a predetermined magnitude (Vmg−Vm_TFT) is measured, and the TFT characteristics are detected.

In the OLED characteristic detection period Tc, the scanning line G1(i) is maintained in the inactive state, and the monitor control line G2(i) is maintained in the active state. Therefore, in this period, the transistor T1 is maintained in the OFF state, and the transistor T3 is maintained in the ON state. Moreover, as mentioned above, in this period, the data line S(j) is given the potential Vm_oled.

Here, the value of the potential Vm_oled is set so that the above Expression (2) and the next Expression (5) are established.

$$ELVSS+Vth(oled)<Vm_oled \quad (5)$$

Moreover, when a breakdown voltage of the transistor T2 is defined as Vbr(T2), the value of the potential Vm_oled is set so that the following Expression (6) is established.

$$Vm_oled<Vmg+Vbr(T2) \quad (6)$$

As described above, in the OLED characteristic detection period Tc, the data line S(j) is given the potential Vm_oled that satisfies the above Expressions (2), (5) and (6). Based on the above Expressions (2) and (6), the transistor T2 becomes the OFF state in the OLED characteristic detection period Tc. Moreover, based on the above Expression (5), the current flows through the organic EL element OLED in the OLED characteristic detection period Tc.

Figure 13:
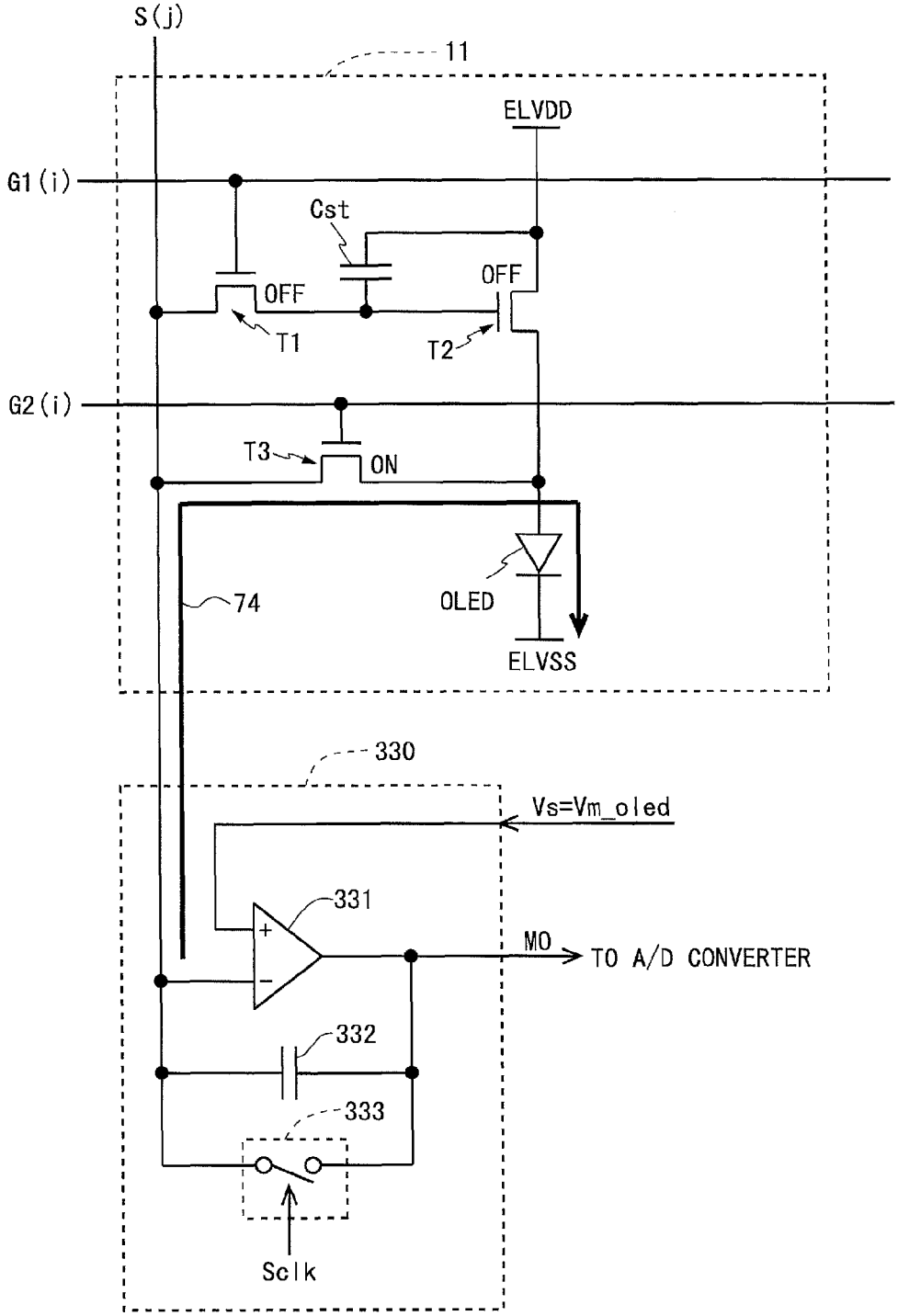
FIG. 13 is a diagram for explaining a flow of the current in an OLED characteristic detection period in the embodiment.

Thus, in the OLED characteristic detection period Tc, the current flows from the data line S(j) through the organic EL element OLED via the transistor T3 as shown by an arrow denoted by reference numeral 74 in FIG. 13, and the organic EL element OLED emits light. In this state, the current flowing through the data line S(j) is measured by the output and current-monitor circuit 330. In such a manner, the magnitude of the current flowing through the organic EL element OLED is measured in a state where the voltage between the anode and cathode of the organic EL element OLED is set to a predetermined magnitude (Vm_oled−ELVSS), and the OLED characteristics are detected.

Note that the value of the potential Vmg, the value of the potential Vm_TFT and the value of the potential Vm_oled are determined in consideration of a current measurable range in the adopted output and current-monitor 330, and the like as well as the above Expressions (1) to (6).

Here, a description is made of a change of the ON/OFF state of the switch 333 in the output and current-monitor circuit 330. When the switch 333 is switched from the OFF state to the ON state, electric charges accumulated in the capacitor 332 are discharged. Thereafter, when the switch 333 is switched from the ON state to the OFF state, the capacitor 332 starts to be charged. Then, the output and current-monitor circuit 330 operates as an integrating circuit. Note that the switch 333 is maintained in the OFF state during a period while the current flowing through the data line S is attempted to be measured. Specifically, first, in the TFT characteristic detection period Tb, after the switch 333 is turned to the ON state to give the data line S the potential Vm_TFT, the switch 333 is turned to the OFF state, and the current flowing through the data line S is measured. Next, in the OLED characteristic detection period Tc, after the switch 333 is turned to the ON state to give the data line S the potential Vm_oled, the switch 333 is turned to the OFF state, and the current flowing through the data line S is measured.

Figure 14:
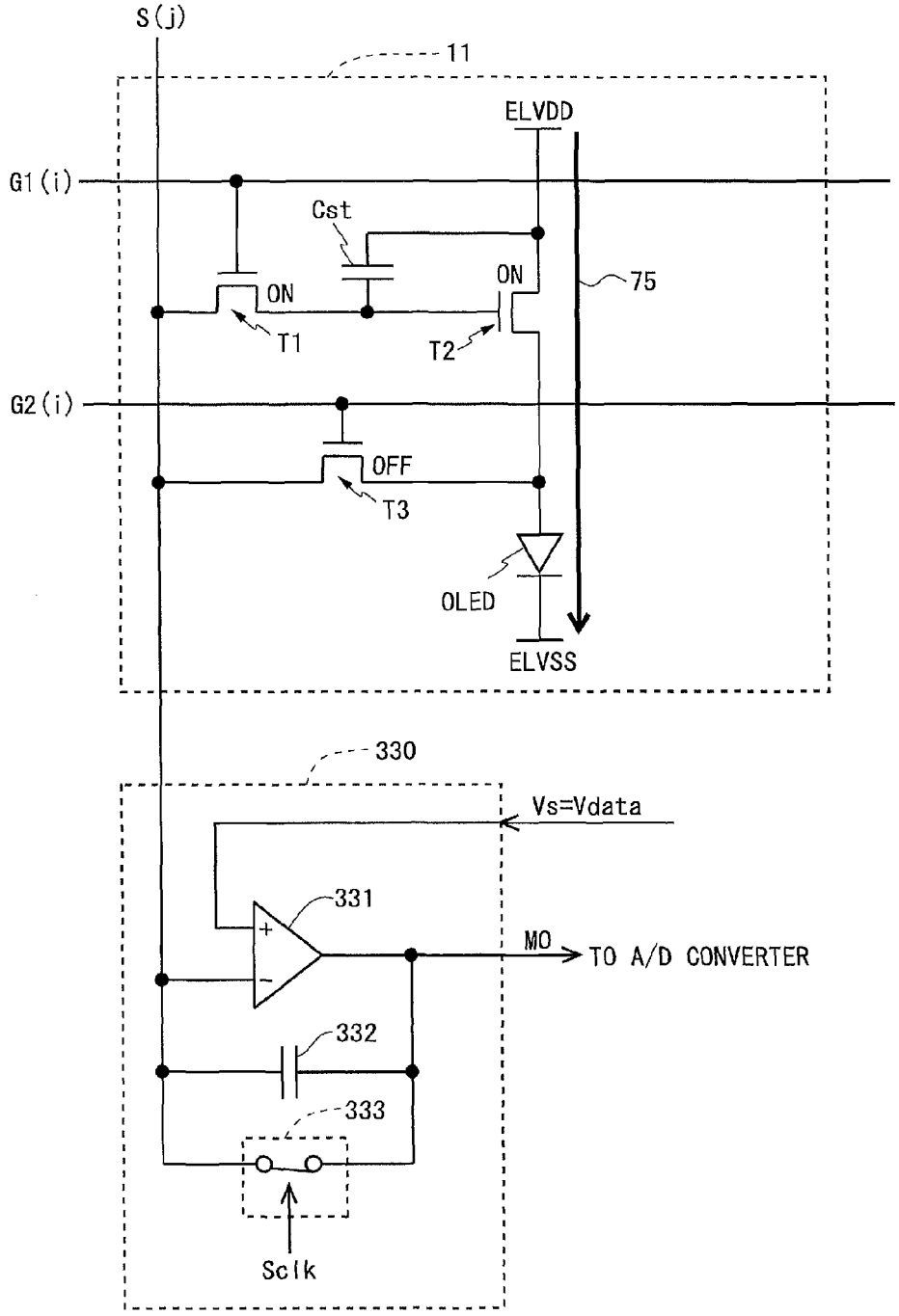
FIG. 14 is a diagram for explaining a flow of the current in a light emission preparation period in the embodiment.

In the light emission preparation period Td, the scanning line G1(i ) is set to the active state, and the monitor control line G2(i) is set to the inactive state. Thus, the transistor T1 becomes the ON state, and the transistor T3 becomes the OFF state. Moreover, in this period, the data line S(j) is given a data potential D(i,j) in accordance with the target brightness. By writing that is based on this data potential. D(i,j), the capacitor Cst is charged, and the transistor T2 becomes the ON state. Thus, in the light emission preparation period Td, as shown by an arrow denoted by reference numeral 75 in FIG. 14, the drive current is supplied to the organic EL element OLED via the transistor T2. In such a way, the organic EL element OLED emits light with brightness in accordance with the drive current.

Figure 15:
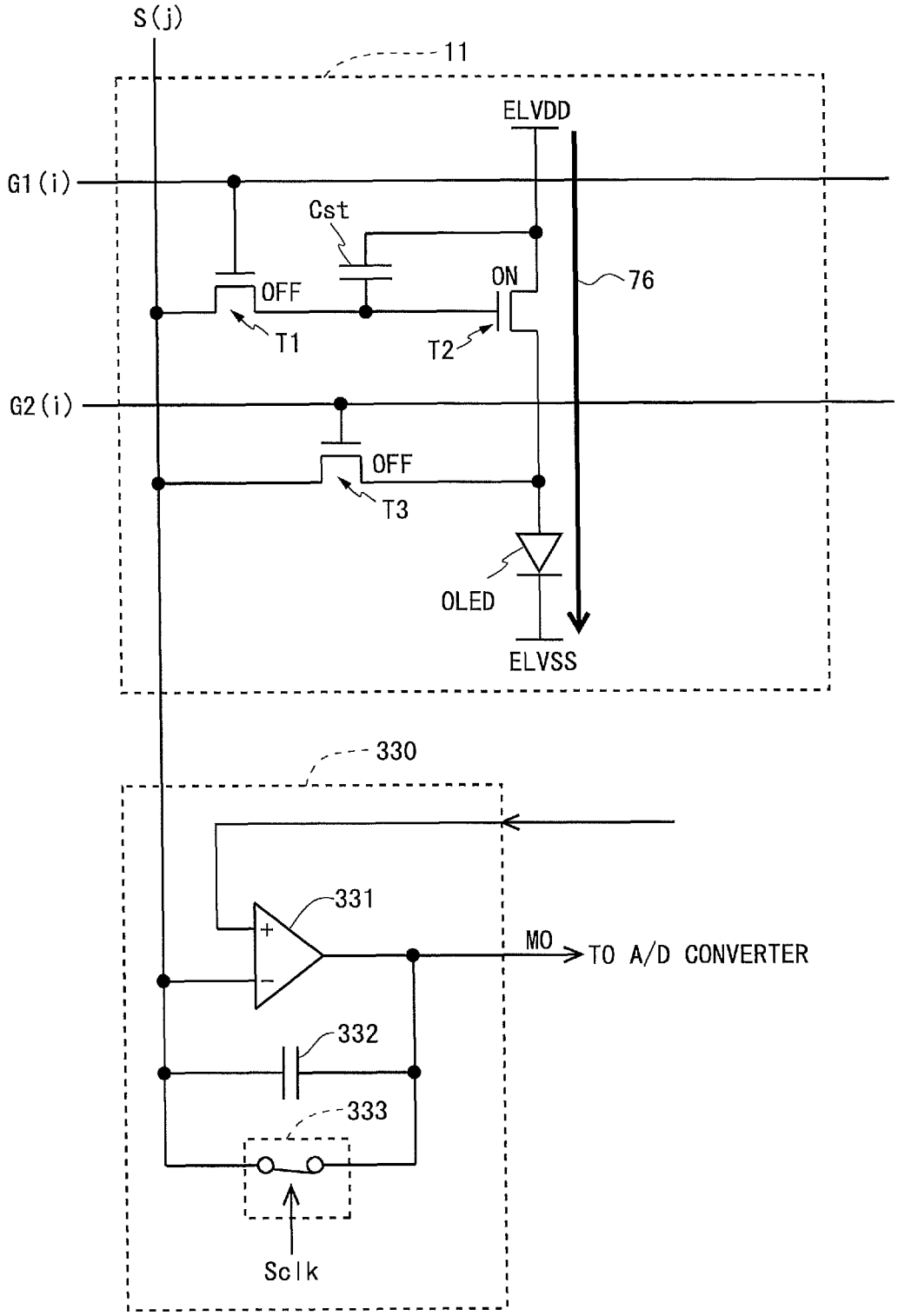
FIG. 15 is a diagram for explaining a flow of the current in a light emission period in the embodiment.

In the light emission period TL, the scanning line G1(i) is set to the inactive state, and the monitor control line G2(i) is maintained in the inactive state. Thus, the transistor T1 becomes the OFF state, and the transistor T3 is maintained in the OFF state. While the transistor T1 becomes the OFF state, the transistor T2 is maintained in the ON state since the capacitor Cst is charged by the writing that is based on the data potential D(i,j) in accordance with the target brightness during the light emission preparation period Td. Hence, in the light emission period TL, as shown by an arrow denoted by reference numeral 76 in FIG. 15, the drive current is supplied to the organic EL element OLED via the transistor T2. In such a way, the organic EL element OLED emits light with brightness in accordance with the drive current. That is to say, in the light emission period TL, the organic EL element OLED emits light in response to the target brightness. Incidentally, when the transistor T1 becomes the OFF state, then ideally, the gate potential of the transistor T2 is held. However, in actual, due to secondary effects such as charge injection by the transistor T1, feedthrough of the scanning line G1(i), and electric charge distribution with a parasitic capacitance, the gate potential of the transistor T2 causes a variation from the written potential. Meanwhile, also immediately before the TFT characteristic detection period Tb that precedes the light emission period TL, the transistor T1 becomes the OFF state, and the gate of the transistor T2 turns to a held state, and accordingly, influences of the secondary effects become substantially equal between the TFT characteristic detection period Tb and the light emission period TL. Hence, even when magnitudes of the influences caused by these secondary effects vary for each of the pixels (by variations of values of the parasitic capacitance, and the like), the detection of the TFT characteristics is performed in consideration of the secondary effects, and the correction is implemented therefor. Hence, the variations of the secondary effects for each of the pixels can be mutually canceled.

Figure 16:
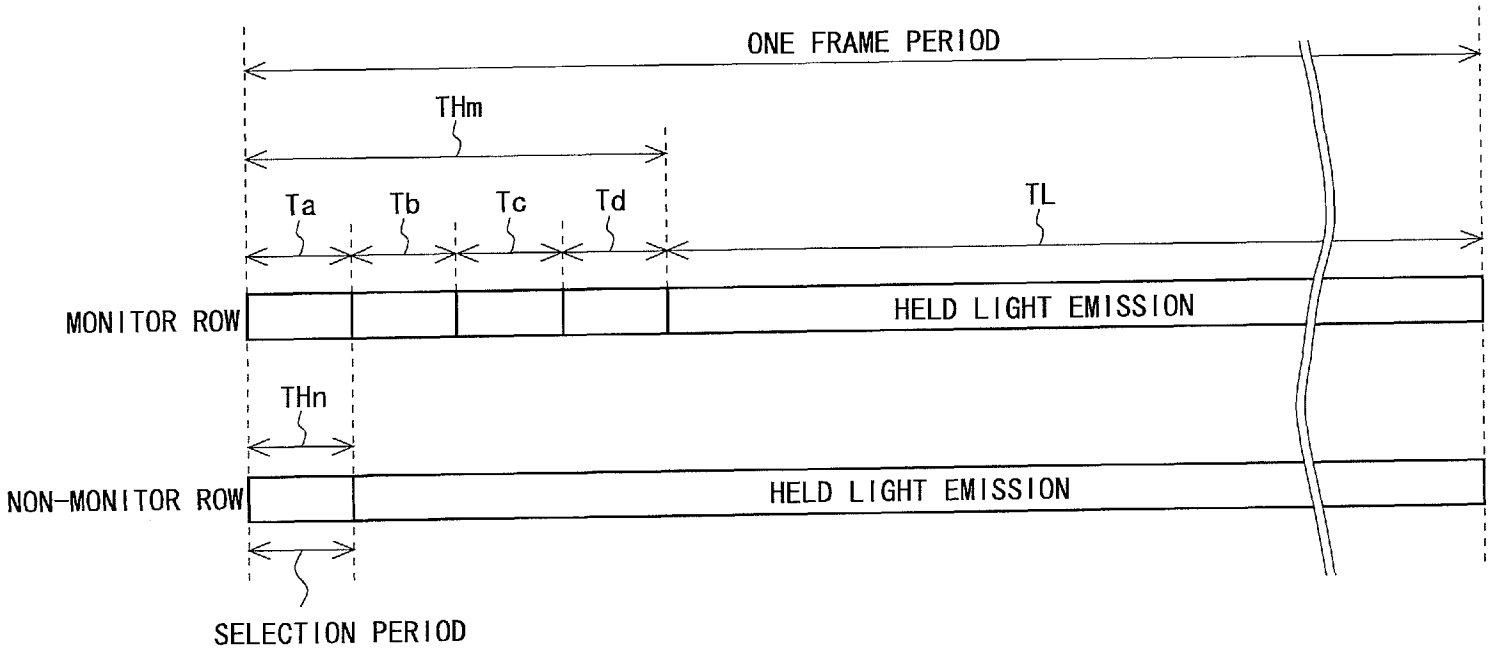
FIG. 16 is a diagram of comparing one frame period in the monitor row and one frame period in a non-monitor row with each other in the embodiment.

As described above, in the non-monitor row, processing for allowing the organic EL element OLED to emit light is performed in a similar way to a general display device. In contrast, in the monitor row, after processing for detecting the TFT characteristics and the OLED characteristics is performed, the processing for allowing the organic EL element OLED to emit light is performed. Hence, as grasped from FIG. 16, a length of the light emission period in the monitor row becomes shorter than a length of the light emission period in the non-monitor row. Therefore, a magnitude of the data potential D(i,j) applied to the data line S(j) in the light emission preparation period Td is adjusted so that integrated brightness in the frame period becomes equal to brightness that appears in the non-monitor row. In detail, a data potential corresponding to a gradation voltage a little larger than a gradation voltage in the non-monitor row is given to the data line S(j) in the light emission preparation period Td. In other words, when any organic EL element OLED is defined as a focus-target organic EL element, in a case where the focus-target organic EL element is included in the monitor row, then in the light emission preparation period Td, the source driver 30 gives the data line S(j) a data potential equivalent to the gradation voltage larger than the gradation voltage in a case where the focus-target organic EL element is included in the non-monitor row. In such a way, a decrease of display quality is suppressed.

Note that, in this embodiment, the monitor row changes every time when the frame changes as shown in FIG. 8; however, the present invention is not limited to this. The same row may be defined as the monitor row over a plurality of the frames. Such processing for the characteristic detection is repeatedly performed in one row in this way, whereby an effect that an S/N ratio is enhanced is obtained. Moreover, in this embodiment, only one row is defined as the monitor row in each of the frames; however, the present invention is not limited to this. Within a range where the display quality is not damaged, the plurality of rows may be defined as such monitor rows in each frame, or the characteristic detection for all of the rows may be executed continuously at arbitrary timing in a period immediately after a power supply of a panel is turned ON, in a period where the power supply is OFF, or in a period while no display is made.

<3.3 Update of Correction Data in Correction Data Storage Unit>

Figure 17:
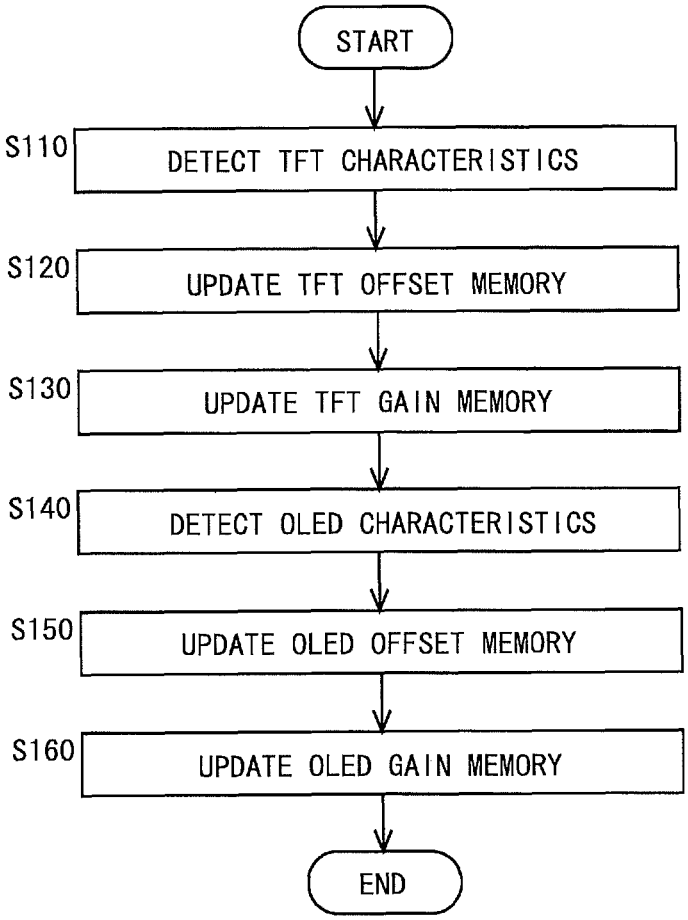
FIG. 17 is a flowchart for explaining a procedure of updating correction data in a correction data storage unit in the embodiment.

Next, a description is made of how to update the correction data (the offset value stored in the TFT offset memory 51*a*, the offset value stored in the OLED offset memory 51*b*, the gain value stored in the TFT gain memory 52*a*, and the deterioration correction coefficient stored in the OLED gain memory 52*b*) stored in the correction data storage unit 50. FIG. 17 is a flowchart for explaining a procedure of updating the correction data in the correction data storage unit 50. Note that, here, a focus is made on the correction data corresponding to one pixel.

First, the TFT characteristics are detected in the TFT characteristic detection period Tb (Step S110). By this Step S110, the offset value and the gain value for correcting the video signal are obtained. Then, the offset value obtained in Step S110 is stored as a new offset value in the TFT offset memory 51*a* (Step S120). Moreover, the gain value obtained in Step S110 is stored as a new gain value in the TFT gain memory 52*a* (Step S130). Thereafter, the OLED characteristics are detected in the OLED characteristic detection period Tc (Step S140). By this Step S140, the offset value and the deterioration correction coefficient for correcting the video signal are obtained. Then, the offset value obtained in Step S140 is stored as a new offset value in the OLED offset memory 51*b* (Step S150). Moreover, the deterioration correction coefficient obtained in Step S140 is stored as a new deterioration correction coefficient in the OLED gain memory 52*b* (Step S160). In such a manner as described above, the correction data corresponding to one pixel is updated. In this embodiment, the TFT characteristics and the OLED characteristics for one row in each frame are detected, and accordingly, for one frame period, there are updated m pieces of the offset values in the TFT offset memory 51*a*, m pieces of the gain values in the TFT gain memory 52*a*, m pieces of the offset values in the OLED offset memory 51*b*, and m pieces of the deterioration correction coefficients in the OLED gain memory 52*b*.

Note that, in this embodiment, characteristic data is realized by the data (offset values, gain values, deterioration correction coefficients) obtained on the basis of detection results in Step S110 and Step S140.

Incidentally, as mentioned above, in the OLED characteristic detection period Tc, there is measured the magnitude of the current flowing through the organic EL element OLED based on the constant voltage (Vm_oled−ELVSS). As such a detection current as a measurement result thereof is being smaller, a deterioration degree of the organic EL element is larger. Hence, the data in the OLED offset memory 51*b* and the OLED gain memory 52*b* are updated so that the offset value becomes larger and the deterioration correction coefficient becomes larger as the detection current is being smaller.

<3.4 Correction of Video Signal>

In this embodiment, in order to compensate for the deterioration of the drive transistor and the deterioration of the organic EL element OLED, the video signal sent from the outside is corrected by using the correction data stored in the correction data storage unit 50. While referring to FIG. 18, a description is made below of this correction of the video signal.

Figure 18:
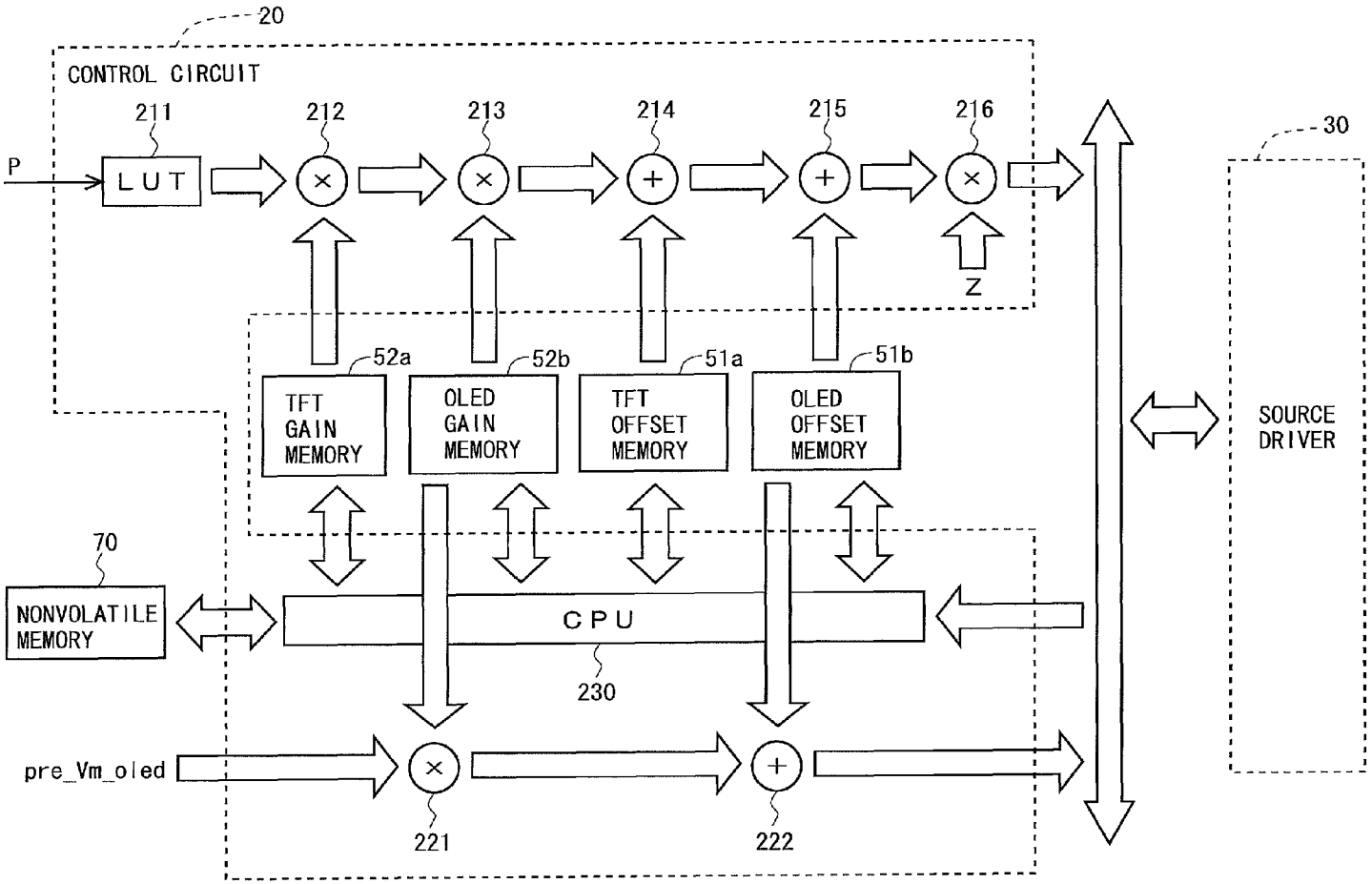
FIG. 18 is a diagram for explaining correction of a video signal in the embodiment.

As shown in FIG. 18, in the control circuit 20, as constituents for correcting the video signal, there are provided an LUT 211, a multiplier unit 212, a multiplier unit 213, an adder unit 214, and an adder unit 215, and a multiplier unit 216. Moreover, in the control circuit 20, a multiplier unit 221 and an adder unit 222 are provided as constituents for correcting the potential Vm_oled given to the data line S in the OLED characteristic detection period Tc. A CPU 230 in the control circuit 20 performs control for the operations of the above-described respective constituent, data update/readout for the respective memories (the TFT offset memory 51*a*, the TFT gain memory 52*a*, the OLED offset memory 51*b*, and the OLED gain memory 52*b*) in the correction data storage unit 50, data update/readout for a nonvolatile memory 70, data transfer with the source driver 30, and the like. Note that, in this embodiment, a video signal correction unit is realized by the LUT 211, the multiplier unit 212, the multiplier unit 213, the adder unit 214, the adder unit 215, and the multiplier unit 216.

In such a configuration as described above, the video signal sent from the outside is corrected in the following manner. First, by using the LUT 211, gamma correction is implemented for the video signal sent from the outside. That is to say, a gradation P indicated by the video signal is converted into a control voltage Vc by the gamma correction. The multiplier unit 212 receives the control voltage Vc and a gain value B1 read out from the TFT gain memory 52*a*, and outputs a value "Vc·B1" obtained by multiplying them. The multiplier unit 213 receives the value "Vc·B1", which is outputted from the multiplier unit 212, and a deterioration correction coefficient B2, which is read out from the OLED gain memory 52*b*, and outputs a value "Vc·B1·B2" obtained by multiplying them. The adder unit 214 receives the value "Vc·B1·B2", which is outputted from the multiplier unit 213, and an offset value Vt1, which is read out from the TFT offset memory 51*a*, and outputs a value "Vc·B1·B2+Vt1", which is obtained by adding them. The adder unit 215 receives the value "Vc·B1·B2+Vt1", which is outputted from the adder unit 214, and an offset value Vt2, which is read out from the OLED offset memory 51*b*, and outputs a value "Vc·B1·B2+Vt1+Vt2", which is obtained by adding them. The multiplier unit 216 receives the value "Vc·B1·B2+Vt1+Vt2", which is outputted from the adder unit 215, and a coefficient Z for compensating for an attenuation of the data potential, which is caused by the parasitic capacitance in the pixel circuit 11, and outputs a value "Z(Vc·B1·B2+Vt1+Vt2)" obtained by multiplying them. A value "Z(Vc·B1·B2+Vt1+Vt2)" obtained in such a manner as described above is sent as the data signal DA from the control circuit 20 to the source driver 30. The potential Vmg given to the data line S in the detection preparation period Ta is also corrected by similar processing to that for the video signal. Note that it is not necessarily necessary to provide the multiplier unit 216 that performs the processing for multiplying the value, which is outputted from the adder unit 215, by the coefficient Z for compensating for the attenuation of the data potential.

Moreover, the potential Vm_oled given to the data line S in the OLED characteristic detection period Tc is corrected in the following manner. The multiplier unit 221 receives pre_Vm_oled (uncorrected Vm_oled) and a deterioration correction coefficient B2, which is read out from the OLED gain memory 52*b*, and outputs a value "pre_Vm_oled·B2", which is obtained by multiplying them. The adder unit 222 receives the value "pre_Vm_oled·B2", which is outputted from the multiplier unit 221, and an offset value Vt2, which is read out from the OLED offset memory 51*b*, and outputs a value "pre_Vm_oled·B2+Vt2", which is obtained by adding them. The value "pre_Vm_oled·B2+Vt2" obtained in such a manner as described above is sent as data, which indicates the potential Vm_oled of the data line S in the OLED characteristic detection period TC, from the control circuit 20 to the source driver 30.

<3.5 Summary of Drive Method>

Figure 19:
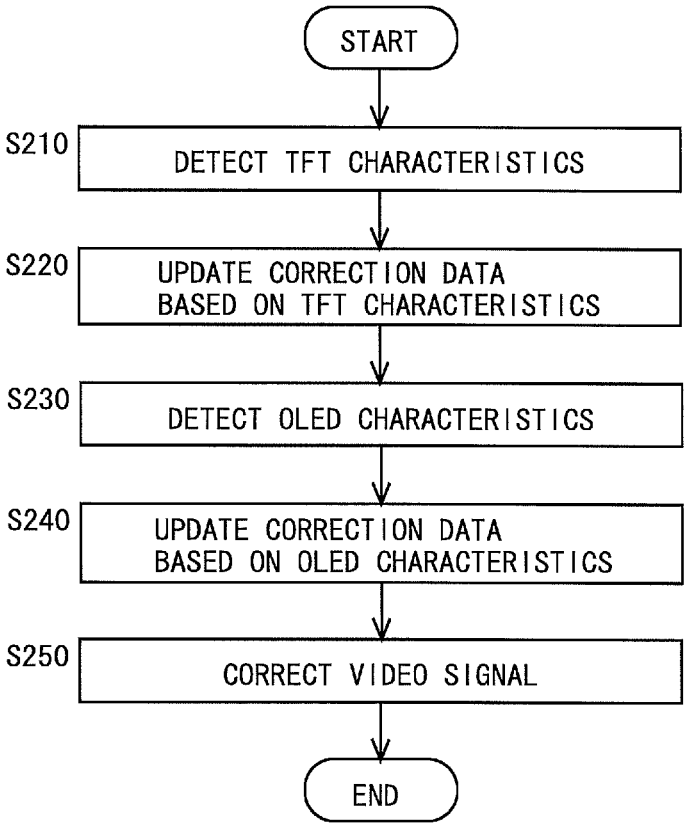
FIG. 19 is a flowchart for explaining an outline of operations related to detection of TFT characteristics and OLED characteristics in the embodiment.

FIG. 19 is a flowchart for explaining an outline of the operations related to the detection of the TFT characteristics and the OLED characteristics. First, the TFT characteristics are detected in the TFT characteristic detection period Tb (Step S210). Then, the TFT offset memory 51*a* and the TFT gain memory 52*a* are updated by using a detection result in Step S210 (Step 220). Next, the OLED characteristics are detected in the OLED characteristic detection period Tc (Step S230). Then, the OLED offset memory 51*b* and the OLED gain memory 52*b* are updated by using a detection result in Step S230 (Step S240). Thereafter, the video signal sent from the outside is corrected by using the correction data stored in the TFT offset memory 51*a*, the TFT gain memory 52*a*, the OLED offset memory 51*b* and the OLED gain memory 52*b* (Step S250).

Note that, in this embodiment, a correction data storing step is realized by Step S220 and Step S240, and a video signal correction step is realized by Step S250.

<4. Effects>

Figure 20:
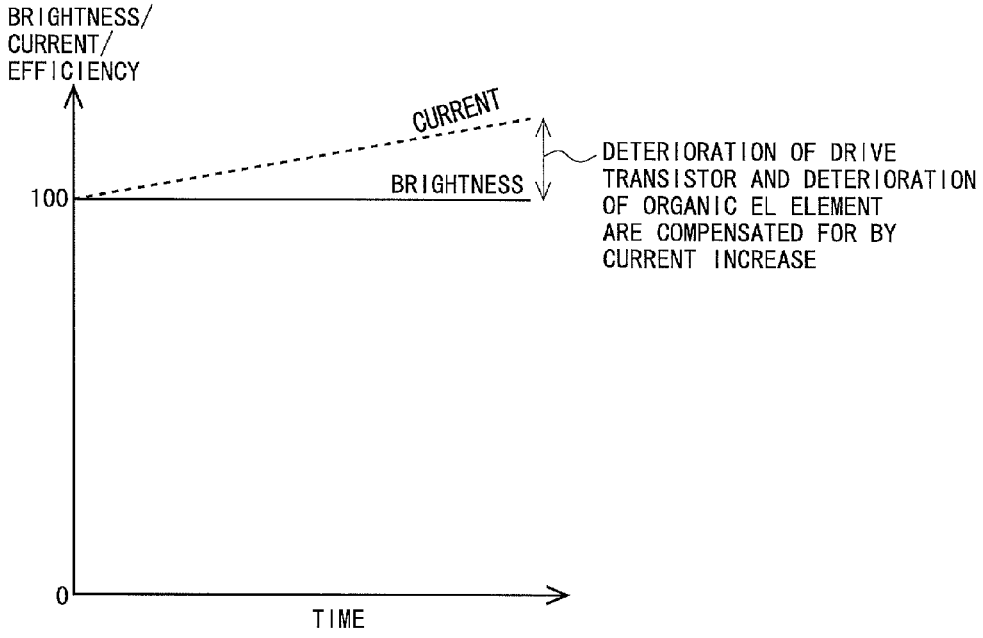
FIG. 20 is a graph for explaining an effect in the embodiment.
Figure 21:
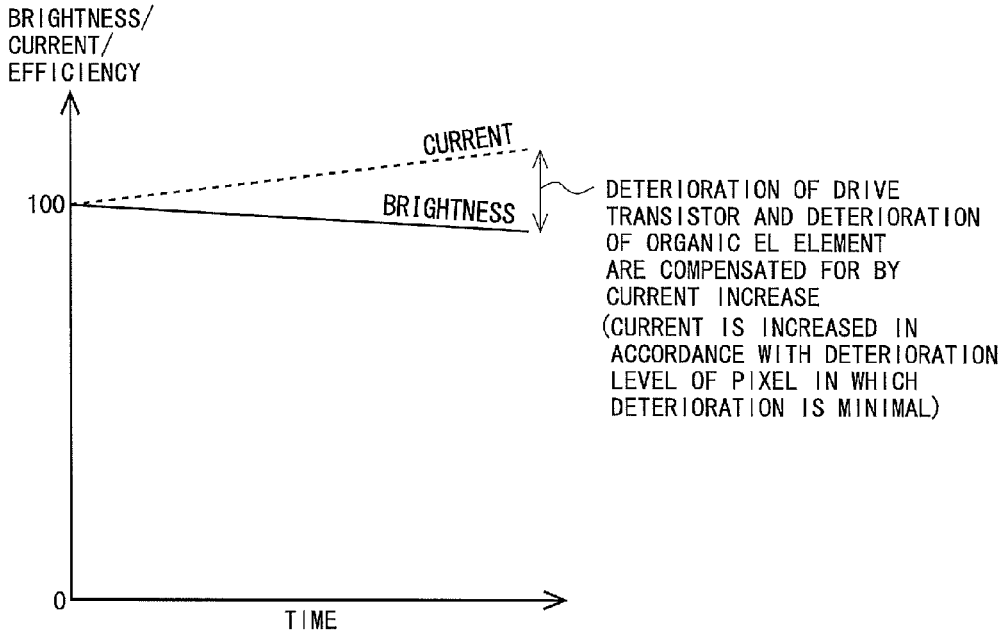
FIG. 21 is a graph for explaining an effect in the embodiment.

According to this embodiment, in each of the frames, the TFT characteristics and the OLED characteristics are detected for one row. The one horizontal scanning period THm in the monitor row is set longer than the one horizontal scanning period THn in the non-monitor row, and in the monitor row, the TFT characteristics and the OLED characteristics are detected during the one horizontal scanning period THm. Then, the video signal sent from the outside is corrected by using the correction data obtained in consideration of both of the detection result of the TFT characteristics and the detection result of the OLED characteristics. The data potential that is based on the video signal thus corrected is applied to the data line S, and accordingly, in the event of allowing the organic EL element OLED in each pixel circuit 11 to emit light, the drive current with such a magnitude that compensates for the deterioration of the drive transistor (transistor T2) and the deterioration of the organic EL element OLED is supplied to the organic EL element OLED (refer to FIG. 20). Moreover, the current is increased in accordance with a deterioration level of a pixel with a smallest deterioration as shown in FIG. 21, whereby it becomes possible to compensate for the burn-in. Here, each of the data lines S in this embodiment is not only used as the signal line that transfers the brightness signal for allowing the organic EL element OLED in the pixel circuit 11 to emit light at the desired brightness, but also used as the characteristic detecting signal line (the signal line that gives the pixel circuit 11 the characteristic detecting control potentials (Vmg, Vm_TFT, Vm_oled), and the signal line that becomes a route of the current measurable by the output and current-monitor circuit 330, the current representing the characteristics). That is to say, it is not necessary to provide a new signal line in the display unit 10 in order to detect the TFT characteristics and the OLED characteristics. Hence, while suppressing the increase of the circuit scale, it becomes possible to simultaneously compensate for both of the deterioration of the drive transistor (transistor T2) and the deterioration of the organic EL element OLED.

Moreover, in this embodiment, the oxide TFTs (specifically, TFTs each having the Tn-Ga—Zn—O-based semiconductor layer) are adopted for the transistors T1 to T3 in the pixel circuit 11, and accordingly, an effect that a sufficient S/N ratio can be ensured is obtained. A description of this is made below. Note that, here, the TFT having the In—Ga—Zn—O-based semiconductor layer is referred to as an "In—Ga—Zn—O-TFT". When the In—Ga—Zn—O-TFT and an LTPS (Low Temperature Poly silicon)-TFT are compared with each other, an OFF current of the In—Ga—Zn—O-TFT is extremely smaller than that of the LTPS-TFT. For example, in a case where the LTPS-TFT is adopted for the transistor T3 in the pixel circuit 11, the OFF current becomes approximately 1 pA at most. In contrast, in a case where the In—Ga—Zn—O-TFT is adopted for the transistor T3 in the pixel circuit 11, the OFF current becomes approximately 10 fA at most. Hence, for example, an OFF current for 1000 rows becomes approximately 1 nA at most in the case where the LTPS-TFT is adopted, and becomes approximately 10 pA at most in the case where the In—Ga—Zn—O-TFT is adopted. The detection current becomes approximately 10 to 100 nA no matter which of the LTPS-TFT and the In—Ga—Zn—O-TFT may be adopted. Incidentally, each of the data lines S is connected to the transistors T3 in the pixel circuits 11 in all of the rows in the column corresponding thereto. Hence, the S/N ratio of the data line S when the characteristic detection is performed depends on a sum of leakage currents of the transistors T3 in the non-monitor rows. Specifically, the S/N ratio of the data line S when the characteristic detection is performed is represented by "detection current/(leakage current×number of non-monitor rows)". Based on the above description, for example, in an organic EL display device including a display unit 10 of "Landscape FHD", the S/N ratio becomes approximately 10 in the case where the LTPS-TFT is adopted, and in contrast, the S/N ratio becomes approximately 1000 in the case where the In—Ga—Zn—O-TFT is adopted. As described above, in this embodiment, a sufficient S/N ratio can be ensured in the event of detecting the current.

<5. Modification Examples>

A description is made below of modification examples of the above-described embodiment. Note that, in the following, a description is made in detail only of different points from those of the above-described embodiment, and a description of similar points to those of the above-described embodiment is omitted.

<5.1 First Modification Example>

In the above-described embodiment, it is premised that the data lines S in the display unit 10 and the output and current-monitor circuits 330 in the source driver 30 correspond to each other in the one-to-one relationship. However, the present invention is not limited to this, and such a configuration (a configuration in this modification example) can also be adopted, in which one output and current-monitor circuit 330 corresponds to a plurality of data lines S. Note that a method of distributing one output, which comes from the source driver, to the plurality of data lines S as in this modification example is referred to as a "source shared driving (SSD) method" and the like.

Figure 22:
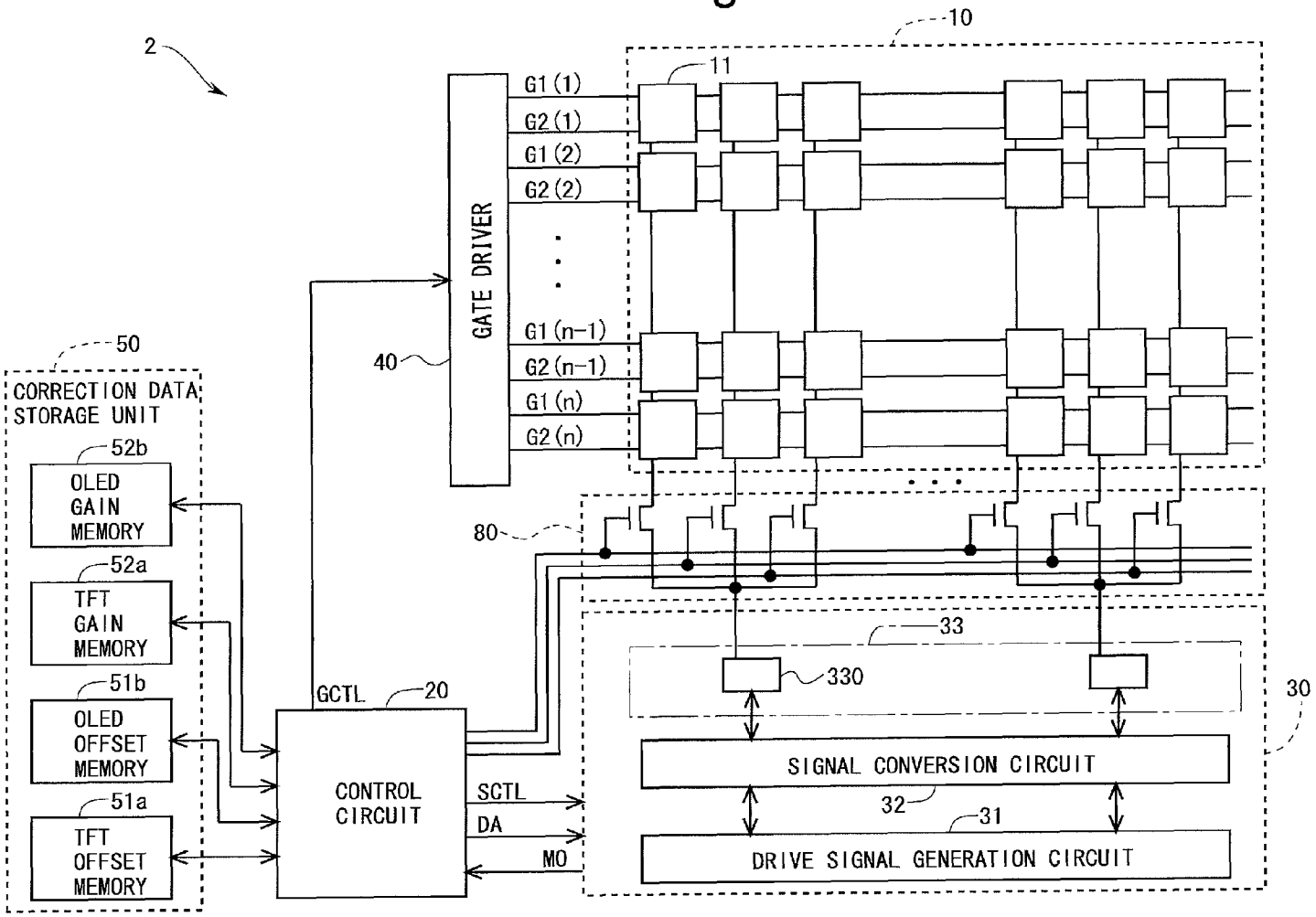
FIG. 22 is a block diagram showing an overall configuration of an organic EL display device in a first modification example of the embodiment.

FIG. 22 is a block diagram showing an overall configuration of an organic EL display device 2 in this modification example. As grasped from FIG. 22, in this modification example, one output and current-monitor circuit 330 is provided for three data lines S. Moreover, in this modification example, a connection control unit 80 for controlling electrical connection states between the output and current-monitor circuit 330 and the data lines S are provided between the display unit 10 and the source driver 30.

Figure 23:
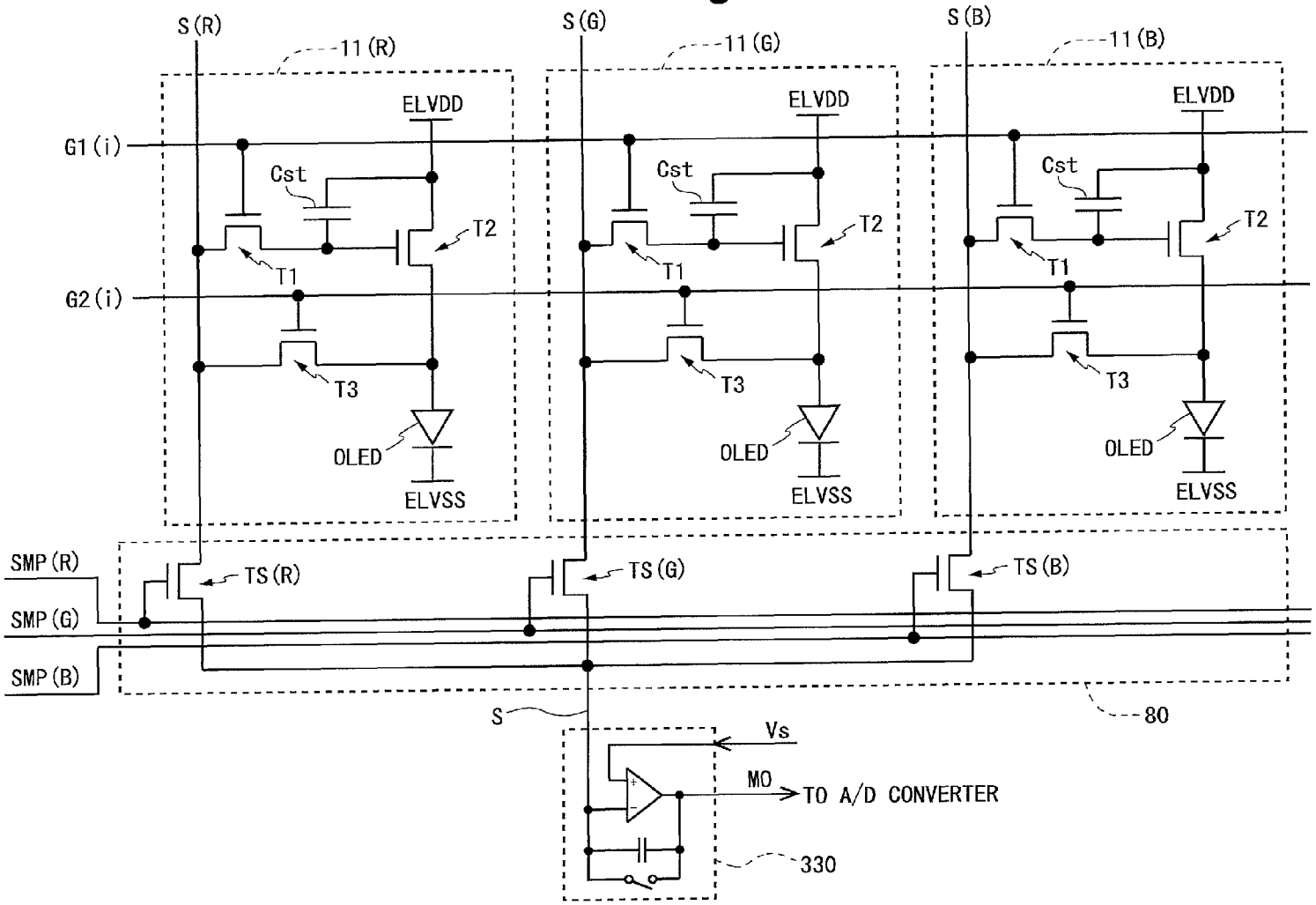
FIG. 23 is a diagram showing a detailed configuration of a connection control unit in the first modification example of the embodiment.

As shown in FIG. 23, the connection control unit 80 includes: a transistor TS(R) for controlling an electrical connection state between the output and current-monitor circuit 330 and a red-oriented data line S(R); a transistor TS(G) for controlling an electrical connection state between the output and current-monitor circuit 330 and a green-oriented data line S(G); and a transistor TS(B) for controlling an electrical connection state between the output and current-monitor circuit 330 and a blue-oriented data line S(B). An ON/OFF state of the transistor TS(R) is controlled by a control signal SMP(R). An ON/OFF state of the transistor TS(G) is controlled by a control signal SMP(G). An ON/OFF state of the transistor TS(B) is controlled by a control signal SMP(B). The red-oriented data line S(R) is connected to a red-oriented pixel circuit 11(R), the green-oriented data line S(G) is connected to a green-oriented pixel circuit 11(G), and the blue-oriented data line S(B) is connected to a blue-oriented pixel circuit 11(B).

Figure 24:
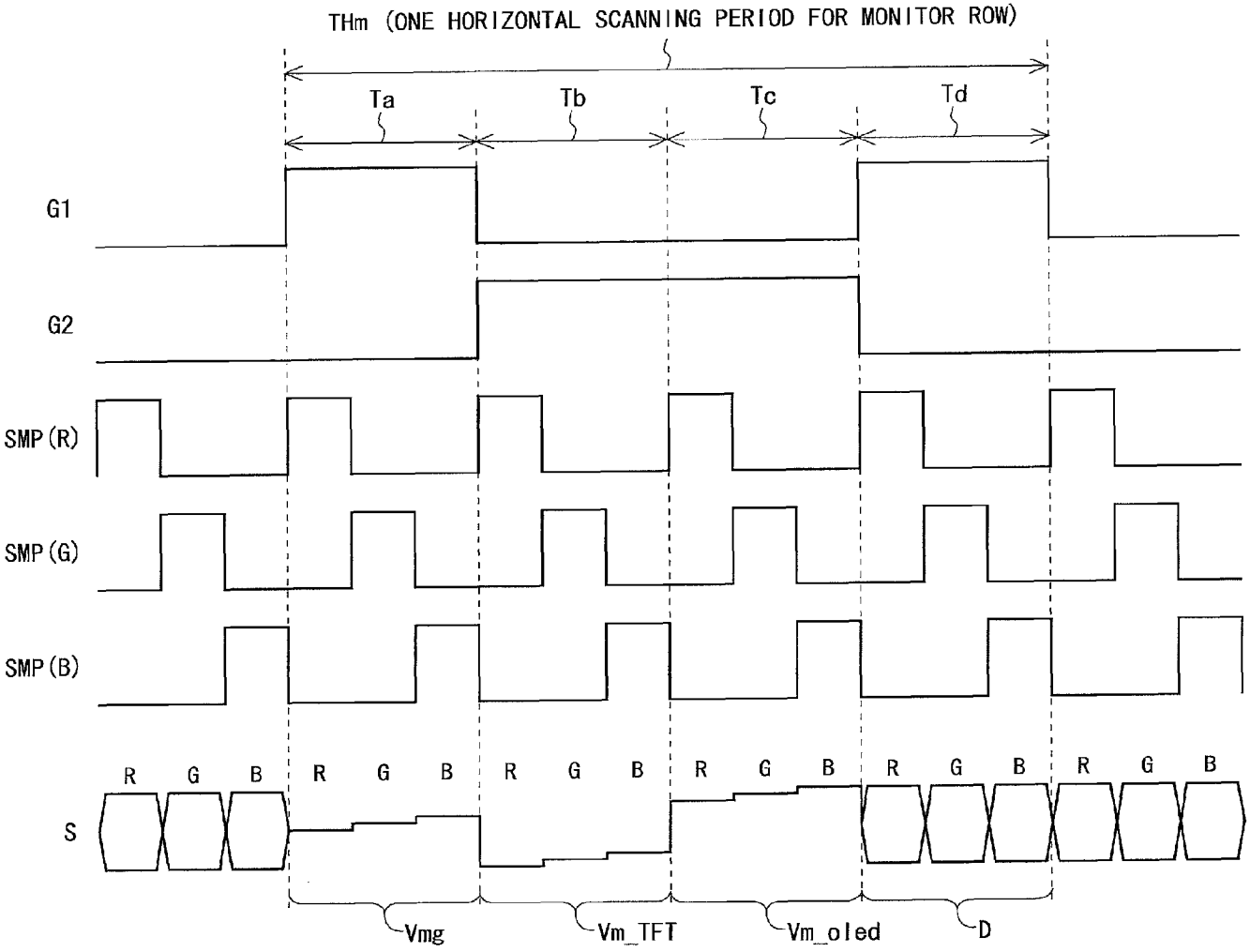
FIG. 24 is a timing chart for explaining details of one horizontal scanning period for a monitor row in the first modification example of the embodiment.
Figure 25:
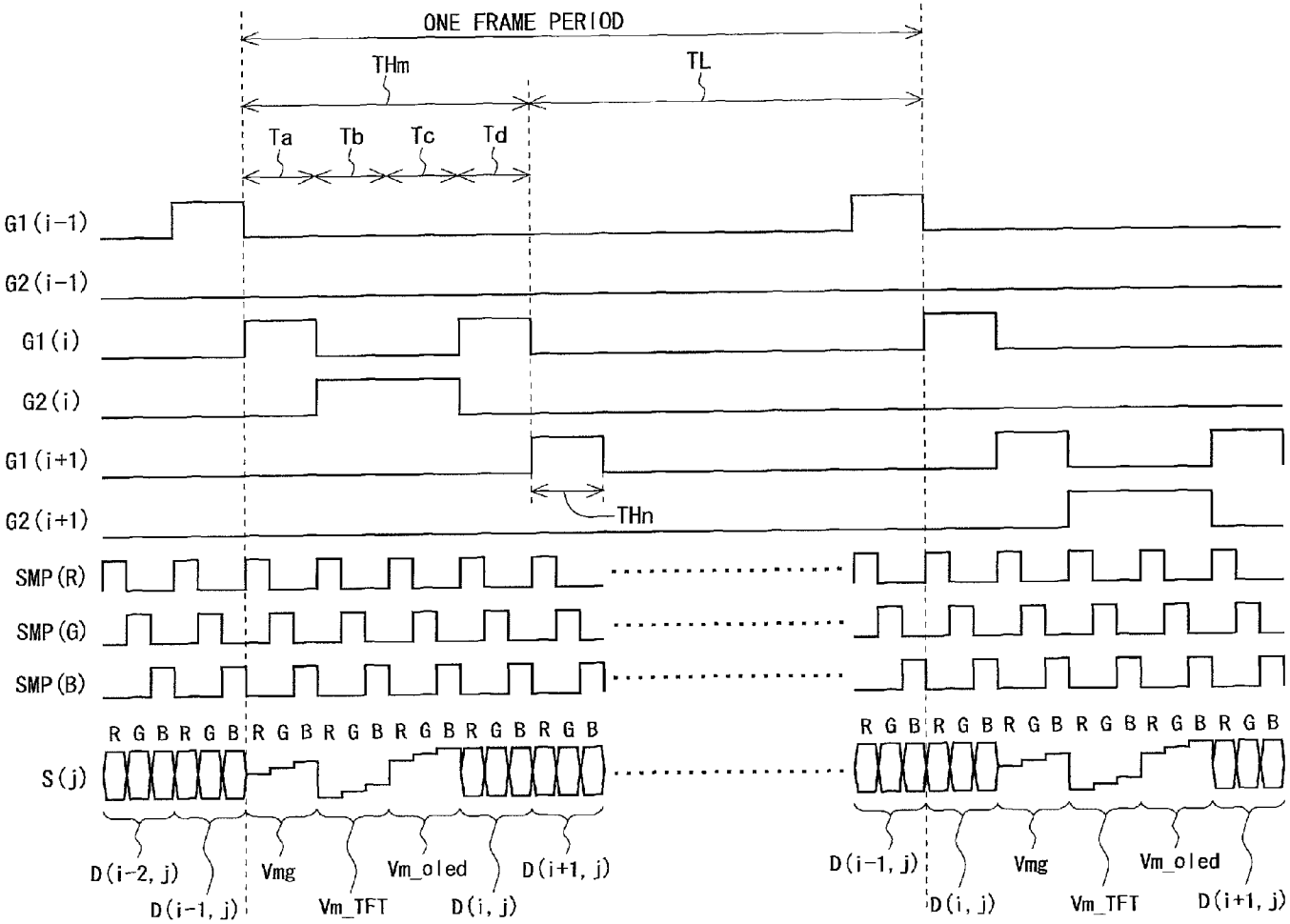
FIG. 25 is a timing chart for explaining operations of a pixel circuit 11 (defined to be a pixel circuit on an i-th row and a j-th column) included in a monitor row in the first modification example of the embodiment.

FIG. 24 is a timing chart for explaining details of one horizontal scanning period THm for the monitor row in this modification example. FIG. 25 is a timing chart for explaining operations of the pixel circuit 11 (defined to be a pixel circuit 11 on the i-th row and the j-th column) included in the monitor row in this modification example. In a similar way to the above-described embodiment, the one horizontal scanning period THm for the monitor row is composed of the detection preparation period Ta, the TFT characteristic detection period Tb, the OLED characteristic detection period Tc and the light emission preparation period Td. In the detection preparation period Ta, the scanning line G1 is set to the active state, and the monitor control line G2 is set to the inactive state. In the TFT characteristic detection period Tb, the scanning line G1 is set to the inactive state, and the monitor control line G2 is set to the active state. In the OLED characteristic detection period Tc, the scanning line GL is maintained in the inactive state, and the monitor control line G2 is maintained in the active state. In the light emission preparation period Td, the scanning line G1 is set to the active state, and the monitor control line G2 is set to the inactive state.

As grasped from FIG. 24 and FIG. 25, each of the detection preparation period Ta, the TFT characteristic detection period Tb, the OLED characteristic detection period Tc and the light emission preparation period Td is divided into three periods. For each, the control signal SMP(R) becomes the high level in a first one-third period, the control signal SMP(G) becomes the high level in a second one-third period, and the control signal SMP(B) becomes the high level in a last one-third period. Hence, for each of the detection preparation period Ta, the TFT characteristic detection period Tb, the OLED characteristic detection period Tc and the light emission preparation period Td, the output and current-monitor circuit 330 and the red-oriented data line S(R) are electrically connected to each other by the transistor TS(R) becoming the ON state in the first one-third period, the output and current-monitor circuit 330 and the green-oriented data line S(G) are electrically connected to each other by the transistor TS(G) becoming the ON state in the second one-third period, and the output and current-monitor circuit 330 and the blue-oriented data line S(B) are electrically connected to each other by the transistor TS(B) becoming the ON state in the last one-third period.

The potentials given to the data line S from the output and current-monitor circuit 330 are as follows. In the detection preparation period Ta, as the potential Vmg, a red-oriented potential, a green-oriented potential and a blue-oriented potential are sequentially given to the data line S from the output and current-monitor circuit 330. In the TFT characteristic detection period Tb, as the potential Vm_TFT, a red-oriented potential, a green-oriented potential and a blue-oriented potential are sequentially given to the data line S from the output and current-monitor circuit 330. In the OLED characteristic detection period Tc, as the potential Vm_oled, a red-oriented potential, a green-oriented potential and a blue-oriented potential are sequentially given to the data line S from the output and current-monitor circuit 330. In the light emission preparation period Td, as the data potential D, a red-oriented potential, a green-oriented potential and a blue-oriented potential are sequentially given to the data line S from the output and current-monitor circuit 330.

Thus, in the detection preparation period Ta, writing to the red-oriented pixel circuit 11(R), which is based on the red-oriented potential, writing to the green-oriented pixel circuit 11(G), which is based on the green-oriented potential, and writing to the blue-oriented pixel circuit 11(B), which is based on the blue-oriented potential, are sequentially performed. In the TFT characteristic detection period Tb, characteristic detection of the transistor T2 in the red-oriented pixel circuit 11(R), characteristic detection of the transistor T2 in the green-oriented pixel circuit 11(G), and characteristic detection of the transistor T2 in the blue-oriented pixel circuit 11(B) are sequentially performed. In the OLED characteristic detection period Tc, characteristic detection of the organic EL element OLED in the red-oriented pixel circuit 11(R), characteristic detection of the organic EL element OLED in the green-oriented pixel circuit 11(G), and characteristic detection of the organic EL element OLED in the blue-oriented pixel circuit 11(B) are sequentially performed. In the light emission preparation period Td, writing in accordance with the target brightness to the red-oriented pixel circuit 11(R), writing in accordance with the target brightness to the green-oriented pixel circuit 11(G), and writing in accordance with the target brightness to the blue-oriented pixel circuit 11(B) are sequentially performed.

According to this modification example, also in the organic EL display device adopting the SSD method, it becomes possible to simultaneously compensate for both of the deterioration of the drive transistor (transistor T2) and the deterioration of the organic EL element OLED while suppressing the increase of the circuit scale.

<5.2 Second Modification Example>

Figure 26:
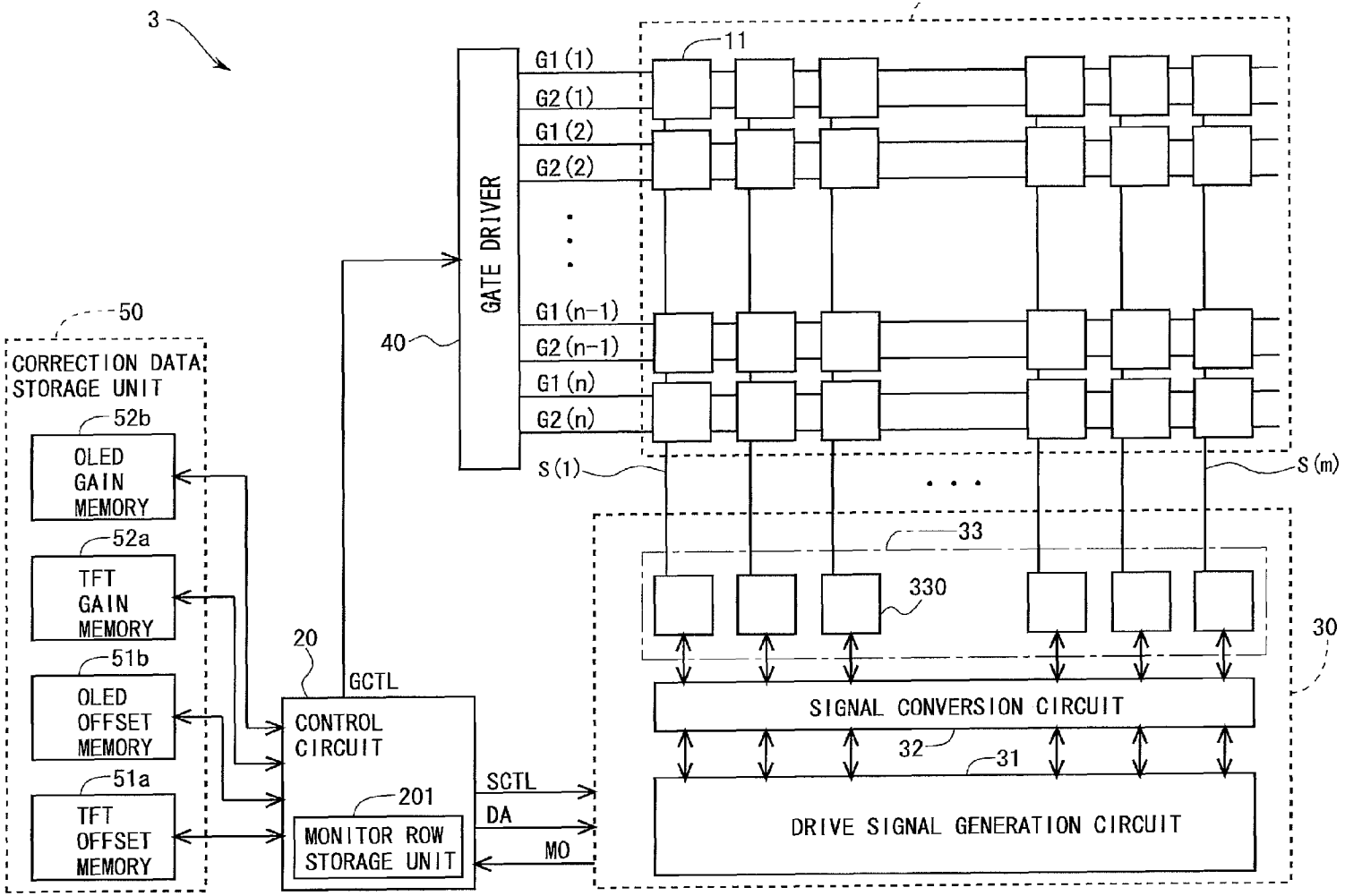
FIG. 26 is a block diagram showing an overall configuration of an organic EL display device in a second modification example of the embodiment.

According to the above-described embodiment, when a short-time operation of the organic EL display device 1 is repeated, a large difference in number of detection times of the TFT characteristics and the OLED characteristics occurs between upper rows of the display unit 10 and lower rows of the display unit 10. Accordingly, in an organic EL display device 3 according to this modification example, as shown in FIG. 26, a monitor row storage unit 201 for storing the monitor row is provided in the control circuit 20. In such a configuration, in an event where the power supply is turned OFF, information for identifying a row where the TFT characteristics and the OLED characteristics are detected last is stored in the monitor row storage unit 201. After the power supply is turned ON, the TFT characteristics and the OLED characteristics are detected from a row next to the row that is identified based on the information stored in the monitor row storage unit 201. Note that, in this example, a monitor region storage unit is realized by the monitor row storage unit 201.

Thus, according to this modification example, the difference in number of detection times of the TFT characteristics and the OLED characteristics is prevented from occurring between the upper rows of the display unit 10 and the lower rows of the display unit 10. Therefore, it becomes possible to perform the compensation, which is made for the deterioration of the drive transistor (transistor T2) and the deterioration of the organic EL element OLED, uniformly on the entire screen, and the occurrence of the brightness variations is prevented effectively.

Note that a row for which the TFT characteristics and the OLED characteristics are detected first after the power supply is turned ON is not limited to the row next to the row that is identified based on the information stored in the monitor row storage unit 201, and may be a row in vicinity of the row that is identified based on the information stored in the monitor row storage unit 201. For example, there may be a row for which the characteristic detection operation is duplicately performed immediately before the power supply is turned OFF and immediately after the power supply is turned ON.

Moreover, information for identifying a column for which the TFT characteristics and the OLED characteristics are detected last may be stored, and information for identifying both of the row and the column, for which the TFT characteristics and the OLED characteristics are detected last, may be stored.

<5.3 Third Modification Example>

Figure 27:
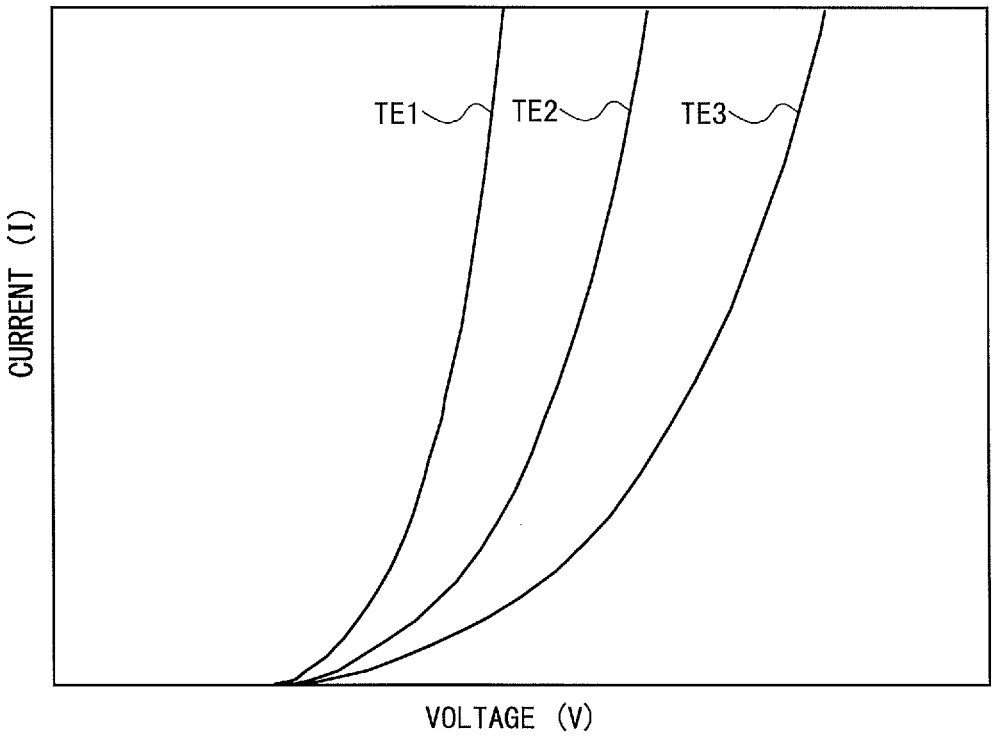
FIG. 27 is a graph for explaining temperature dependency of current-voltage characteristics of the organic EL element.

FIG. 27 is a graph for explaining temperature dependency of current-voltage characteristics of the organic EL element. FIG. 27 shows current-voltage characteristics of the organic EL element at a temperature TE1, current-voltage characteristics of the organic EL element at a temperature TE2, and current-voltage characteristics of the organic EL element at a temperature TE3. Note that "TE1>TE2>TE3" is established. As grasped from FIG. 27, in order to supply a predetermined current to the organic EL element, it is necessary to raise the voltage as the temperature is becoming lower. As seen above, the current-voltage characteristics of the organic EL element depend on the temperature to a great extent. Accordingly, it is preferable to adopt a configuration (configuration of this modification example) capable of compensating for a temperature change.

Figure 28:
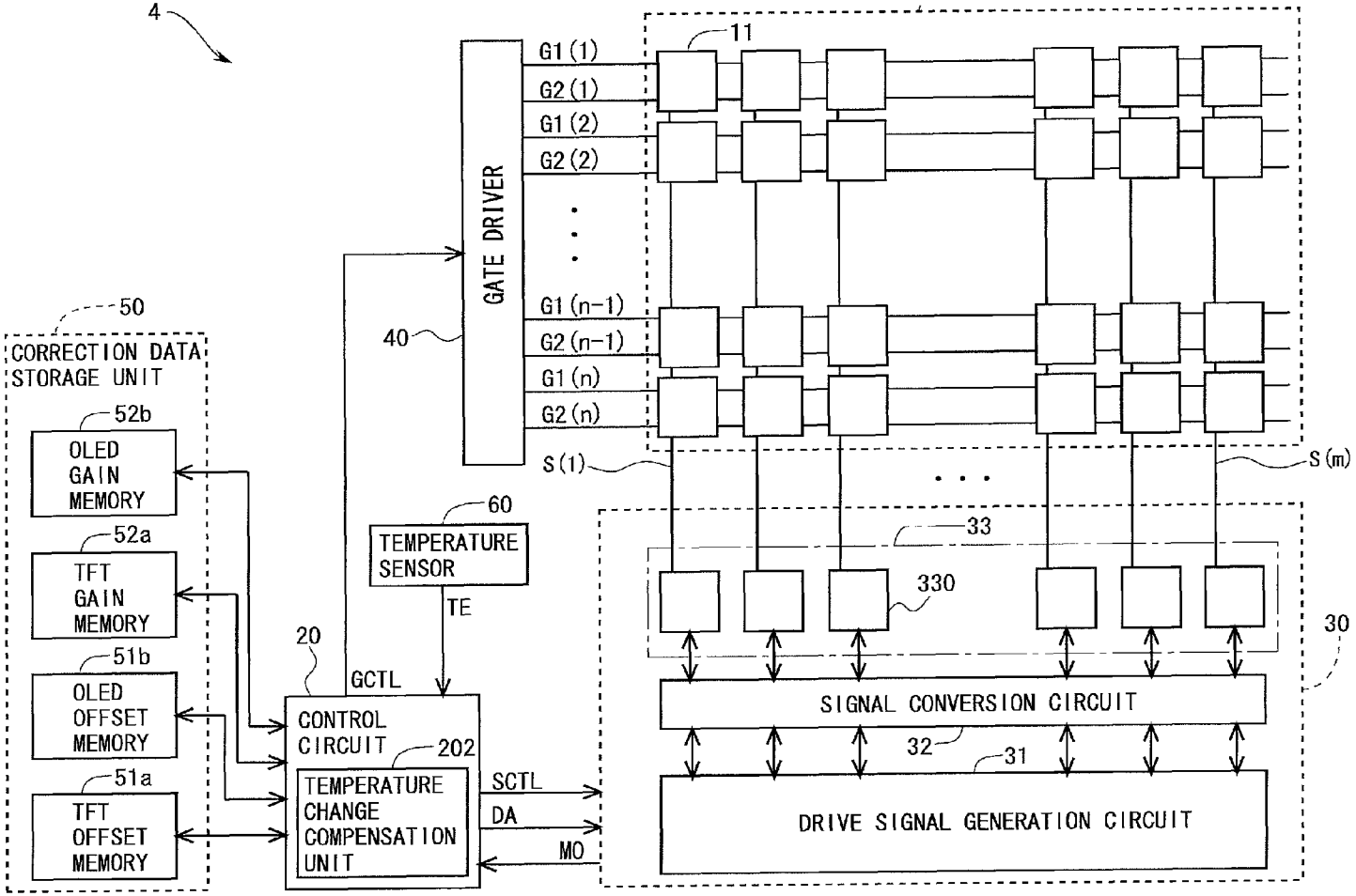
FIG. 28 is a block diagram showing an overall configuration of an organic EL display device in a third modification example of the embodiment.

FIG. 28 is a block diagram showing an overall configuration of an organic EL display device 4 in this modification example. In this modification example, a temperature sensor 60 is provided in addition to the constituents in the above-described embodiment. A temperature detection unit is realized by this temperature sensor 60. Moreover, a temperature change compensation unit 202 is provided in the control circuit 20. The temperature sensor 60 continually gives the control circuit 20 temperature information TE as a result of measuring the temperature. The temperature change compensation unit 202 corrects the monitor data MO, which is given from the source driver 30, based on the temperature information TE. In detail, the temperature change compensation unit 202 converts a value of the monitor data MO, which corresponds to a temperature at the detection time, into a value corresponding to a certain standard temperature, and updates the offset value in the OLED offset memory 51*b* and the deterioration correction coefficient in the OLED gain memory 52*b* based on a value obtained by such conversion.

Figure 29:
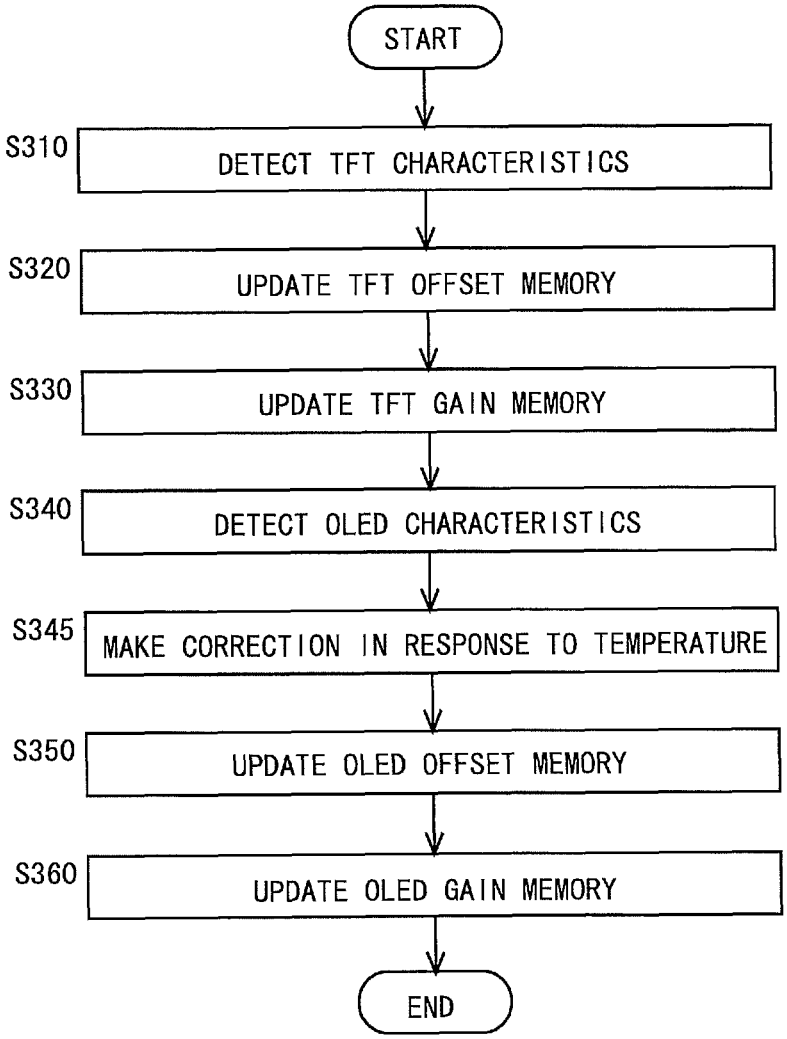
FIG. 29 is a flowchart for explaining a procedure of updating correction data in a correction data storage unit in the third modification example of the embodiment.

FIG. 29 is a flowchart for explaining a procedure of updating the correction data (the offset value stored in the TFT offset memory 51*a*, the offset value stored in the OLED offset memory 51*b*, the gain value stored in the TFT gain memory 52*a*, and the deterioration correction coefficient stored in the OLED gain memory 52*b*) in the correction data storage unit 50 in this modification example. Note that processing of Step S310 to S340 in this modification example (FIG. 29) is the same as the processing of Step S110 to Step S140 in the above-described embodiment (FIG. 17), and processing of Step S350 and Step S360 in this modification example (FIG. 29) is the same as the processing of Step S150 and Step S160 in the above-described embodiment (FIG. 17). In this modification example, after the OLED characteristics are detected, and before the offset value and the deterioration correction coefficient are updated, the offset value and the deterioration correction coefficient are corrected based on the temperature information TE given by the temperature sensor 60 (Step S345).

As seen above, according to this modification example, the video signal sent from the outside is corrected by the correction data in which the temperature change is taken into consideration. Therefore, in the organic EL display device, it becomes possible to simultaneously compensate for both of the deterioration of the drive transistor (transistor T2) and the deterioration of the organic EL element OLED irrespective of the change of the temperature.

<5.4 Fourth Modification Example>

<5.4.1 Outline>

In the above-described embodiment, in each frame, both of the TFT characteristics and the OLED characteristics are detected for one row. However, the present invention is not limited to this, and such a configuration (configuration of this modification example) can also be adopted, in which, in each frame, the TFT characteristics are detected for one row, or alternatively, the OLED characteristics are detected for one row.

In this modification example, when the OLED characteristics are detected for a first row in a certain frame, the OLED characteristics are detected for a second row in a next frame, and the OLED characteristics are detected for a third row in a frame next to the next frame. Thereafter, the OLED characteristics are sequentially detected for fourth to n-th rows. After the OLED characteristics are detected for the n-th row, the TFT characteristics are detected for the first row. Then, the TFT characteristics are sequentially detected for second to n-th rows. As described above, the detection of the TFT characteristics and the detection of the OLED characteristics are performed in different frames. In such a manner as described above, in each frame, either of an operation for detecting the TFT characteristics (hereinafter referred to as "TFT characteristic detection operations") and an operation for detecting the OLED characteristics (hereinafter referred to as "OLED characteristic detection operations") is performed for the monitor row, and the usual operation is performed for the non-monitor rows. That is to say, when the frame in which the detection of the OLED characteristics for the first row is performed is defined as the (k+1)-th frame, then the operations in the respective rows change as shown in FIG. 30. Note that, from the (k+1)-th frame to the (k+n)-th frame, the TFT characteristic detection operation is not performed in any row. Note that, from the (k+n+1)-th frame to the (k+2n)-th frame, the OLED characteristic detection operation is not performed in any row.

After the OLED characteristic detection operation is performed in the monitor row, the OLED offset memory 51*b* and the OLED gain memory 52*b* are updated based on the detection result. After the TFT characteristic detection operation is performed in the monitor row, the TFT offset memory 51*a* and the TFT gain memory 52*a* are updated based on the detection result. The correction of the video signal is performed in a similar way to the above-described embodiment.

<5.4.2 Drive Method>

<5.4.2.1 Operations of Pixel Circuit>

Figure 31:
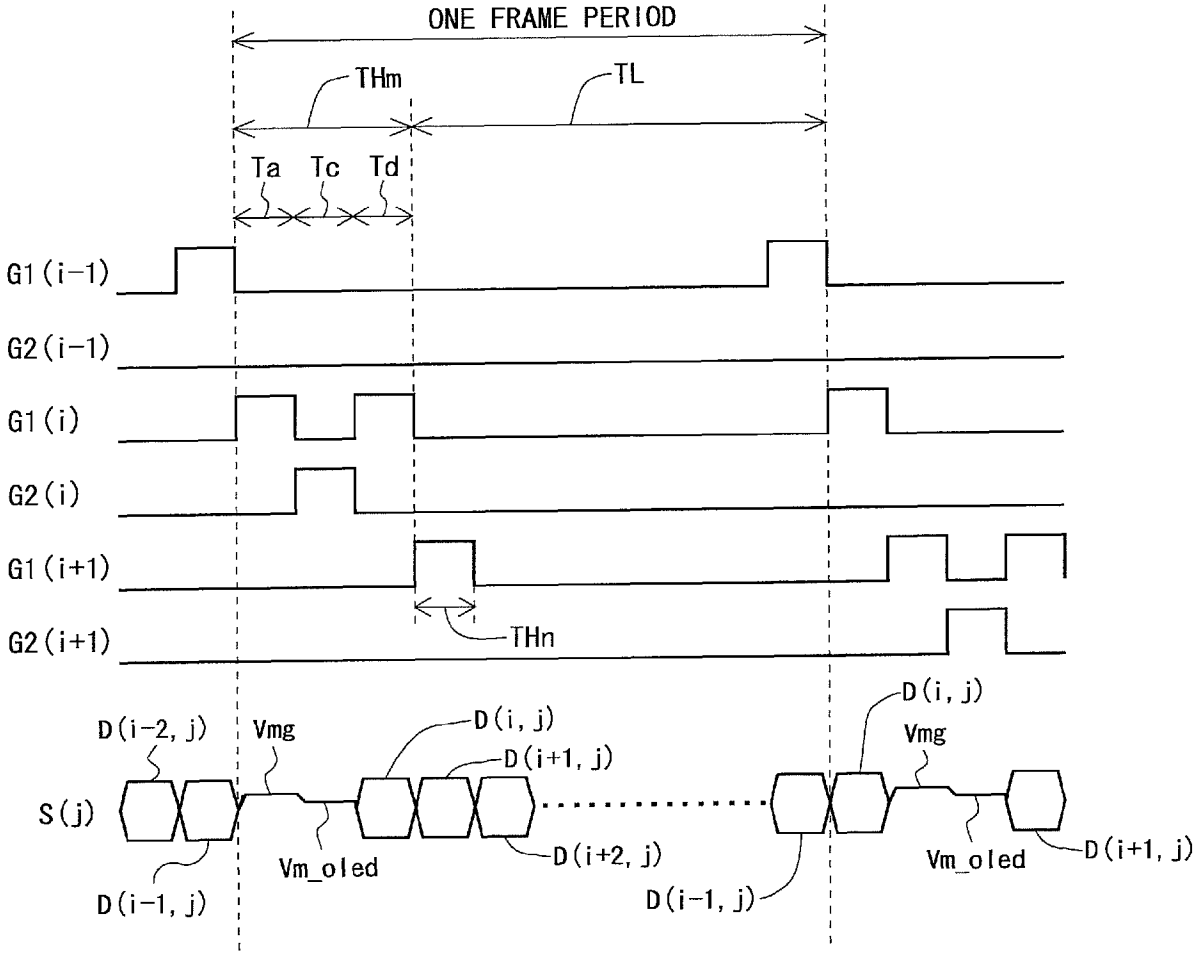
FIG. 31 is a timing chart for explaining details of one horizontal scanning period for a monitor row (that is, a timing chart in a frame in which an OLED characteristic detection operation is performed in the monitor row) in the fourth modification example of the embodiment.
Figure 32:
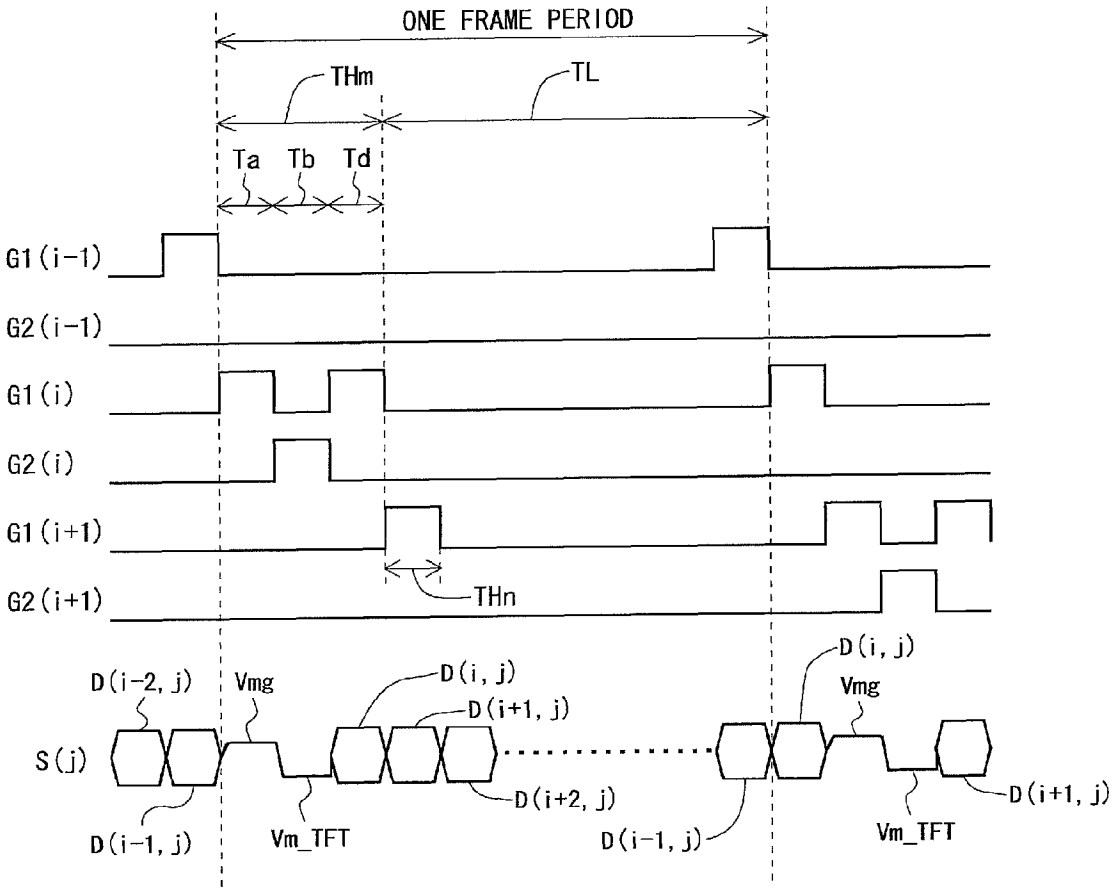
FIG. 32 is a timing chart for explaining details of one horizontal scanning period for the monitor row (that is, a timing chart in a frame in which a TFT characteristic detection operation is performed in the monitor row) in the fourth modification example of the embodiment.

While referring to FIG. 31 and FIG. 32, a description is made of a drive method in this modification example. FIG. 31 and FIG. 32 are timing charts for explaining operations of the pixel circuit 11 (defined to be a pixel circuit 11 on the i-th row and the j-th column) included in the monitor row. FIG. 31 is a timing chart in the frame in which the OLED characteristic detection operation is performed in the monitor row, and FIG. 32 is a timing chart in the frame in which the TFT characteristic detection operation is performed in the monitor row. Note that, in the non-monitor row, the usual operation is performed in a similar way to the above-described embodiment in each frame. A description is made below of operations of the pixel circuit 11 included in the monitor row.

First, a description is made of the operations in the frame in which the OLED characteristic detection operation is performed in the monitor row. As shown in FIG. 31, in this frame, the one horizontal scanning period THm for the monitor row is composed of the detection preparation period Ta, the OLED characteristic detection period Tc and the light emission preparation period Td.

In the detection preparation period Ta, the scanning line G1(i) is set to the active state, and the monitor control line G2(i) is maintained in the inactive state. Moreover, in this period, the data line S(j) is given the potential Vmg. Thus, in this period, the capacitor Cst in the pixel circuit 11 is charged by the writing that is based on the potential Vmg.

In the OLED characteristic detection period Tc, the scanning line G1(i) is set to the inactive state, and the monitor control line G2(i) is set to the active state. Therefore, in this period, the transistor T1 becomes the OFF state, and the transistor T3 becomes the ON state. Moreover, in this period, the data line S(j) is given the potential Vm_oled.

Here, when the light emission threshold voltage of the organic EL element OLED, which is obtained based on the offset value stored in the OLED offset memory 51*b*, is defined as Vth(oled), and the breakdown voltage of the transistor T2 is defined as Vbr(T2), then the value of the potential. Vmg and the value of the potential V_oled are set so that the above Expressions (2), (5) and (6) are established. Based on the above Expressions (2) and (6), the transistor T2 becomes the OFF state in the OLED characteristic detection period Tc. Moreover, based on the above Expression (5), the current flows through the organic EL element OLED in the OLED characteristic detection period Tc.

Thus, in the OLED characteristic detection period Tc, the current flows from the data line S(j) through the organic EL element OLED via the transistor T3 as shown by the arrow denoted by reference numeral 74 in FIG. 13, and the organic EL element OLED emits light. In this state, the current flowing through the data line S(j) is measured by the output and current-monitor circuit 330. In such a manner as described above, the OLED characteristics are detected.

In the light emission preparation period Td, the scanning line G1(i) is set to the active state, and the monitor control line G2(i) is set to the inactive state. Accordingly, the transistor T1 becomes the ON state, and the transistor T3 becomes the OFF state. Moreover, in this period, the data line S(j) is given the data potential D(i,j) in accordance with the target brightness. Thus, in this period, the capacitor Cst in the pixel circuit 11 is charged by the writing that is based on the data potential D(i,j).

In the light emission period TL, the scanning line G1(i) is set to the inactive state, and the monitor control line G2(i) is maintained in the inactive state. Accordingly, the transistor T1 becomes the OFF state, and the transistor T3 is maintained in the OFF state. While the transistor T1 becomes the OFF state, the transistor T2 is maintained in the ON state since the capacitor Cst is charged by the writing that is based on the data potential D(i,j) in accordance with the target brightness during the light emission preparation period Td. Hence, in the light emission period TL, as shown by the arrow denoted by reference numeral 76 in FIG. 15, the drive current is supplied to the organic EL element OLED via the transistor T2. Thus, the organic EL element OLED emits light with brightness in accordance with the drive current. That is to say, in the light emission period TL, the organic EL element OLED emits light in response to the target brightness.

Next, a description is made of the operations in the frame in which the TFT characteristic detection operation is performed in the monitor row. Note that the operations in the detection preparation period Ta, the light emission preparation period Td and the light emission period TL are similar to those in the frame in which the OLED characteristic detection operation is performed in the monitor row, and accordingly, a description thereof is omitted.

In the TFT characteristic detection period Tb, the scanning line G1(i) is set to the inactive state, and the monitor control line G2(i) is set to the active state. Therefore, in this period, the transistor T1 becomes the OFF state, and the transistor T3 becomes the ON state. Moreover, in this period, the data line S(j) is given the potential Vm_TFT.

Here, when the threshold voltage of the transistor T2, which is obtained based on the offset value stored in the TFT offset memory 51*a*, is defined as Vth(T2), the light emission threshold voltage of the organic EL element OLED, which is obtained based on the offset value stored in the OLED offset memory 51*b*, is defined as Vth(oled), and the breakdown voltage of the organic EL element OLED is defined as Vbr(oled), then the value of the potential Vmg and the value of the potential V_TFT are set so that the above Expressions (1), (3) and (4) are established. Based on the above Expression (1), the transistor T2 becomes the ON state in the TFT characteristic detection period Tb. Moreover, based on the above Expressions (3) and (4), the current does not flow through the organic EL element OLED in the TFT characteristic detection period Tb.

Thus, in the TFT characteristic detection period Tb, the current flowing through the transistor T2 is outputted to the data line S(j) via the transistor T3 as shown by the arrow denoted by reference numeral 73 in FIG. 12. In such a way, the current (sink current) outputted to the data line S(j) is measured by the output and current-monitor circuit 330. In such a manner as described above, the TFT characteristics are detected.

<5.4.2.2 Update of Correction Data in Correction Data Storage Unit>

Figure 33:
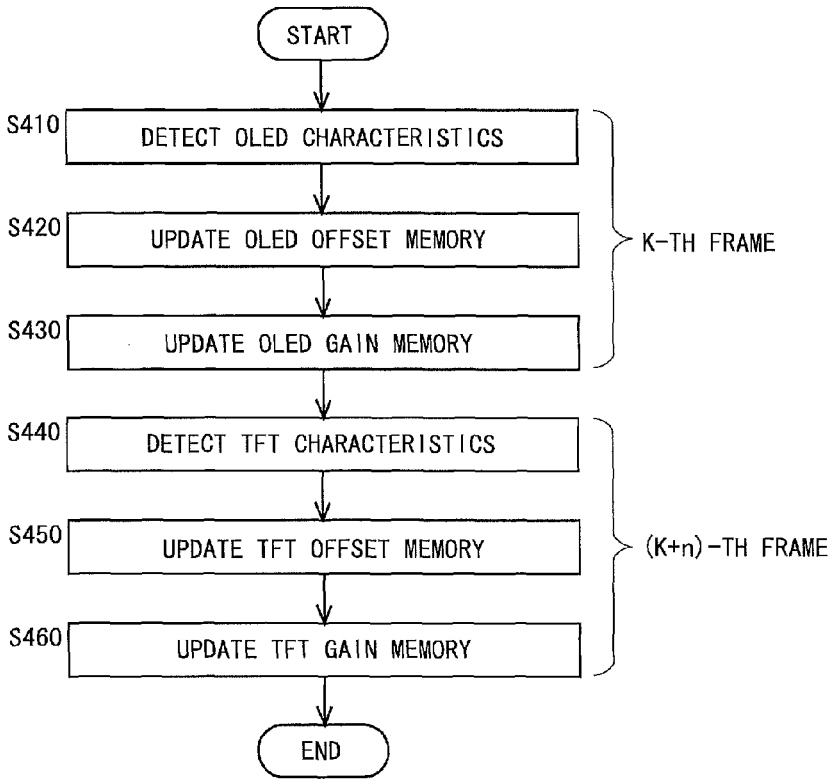
FIG. 33 is a flowchart for explaining a procedure of updating correction data in a correction data storage unit in the fourth modification example of the embodiment.

Next, a description is made of the update of the correction data (the offset value stored in the TFT offset memory 51*a*, the offset value stored in the OLED offset memory 51*b*, the gain value stored in the TFT gain memory 52*a*, and the deterioration correction coefficient stored in the OLED gain memory 52*b*) in the correction data storage unit 50. FIG. 33 is a flowchart for explaining a procedure of updating the correction data in the correction data storage unit 50. Note that, here, a focus is made on the correction data corresponding to one pixel. Incidentally, as grasped from FIG. 30, in this modification example, when a focus is made on any one pixel, the detection of the TFT characteristics is performed in an n-th frame from the frame in which the detection of the OLED characteristics is performed. Accordingly, here, it is assumed that the OLED characteristics are detected in a K-th frame, and that the TFT characteristics are detected in a (K+n)-th frame.

First, in the K-th frame, the OLED characteristics are detected in the OLED characteristic detection period Tc (Step S410). By this Step S410, the offset value and the deterioration correction coefficient for correcting the video signal are obtained. Then, the offset value obtained in Step S410 is stored as a new offset value in the OLED offset memory 51*b* (Step S420). Moreover, the deterioration correction coefficient obtained in Step S410 is stored as a new deterioration correction coefficient in the OLED gain memory 52*b* (Step S430). Thereafter, in the (K+n)-th frame, the TFT characteristics are detected in the TFT characteristic detection period Tb (Step S440). By this Step S440, the offset value and the gain value for correcting the video signal are obtained. Then, the offset value obtained in Step S440 is stored as a new offset value in the TFT offset memory 51*a* (Step S450). Moreover, the gain value obtained in Step S440 is stored as a new gain value in the TFT gain memory 52*a* (Step S460).

In such a manner as described above, the offset value and the gain value, which correspond to one pixel, are updated. In this modification example, in each frame, either of the detection of the OLED characteristics for one row and the detection of the TFT characteristics for one row is performed. Hence, the m pieces of offset values in the OLED offset memory 51*b* and the m pieces of deterioration correction coefficients in the OLED gain memory 52*b* are updated for one frame in the frame in which the OLED characteristics are detected, and the m pieces of offset values in the TFT offset memory 51*a* and the m pieces of gain values in the TFT gain memory 52*a* are updated for one frame in the frame in which the TFT characteristics are detected.

<5.4.3 Effects>

According to this modification example, for each of the pixels, the detection of the OLED characteristics and the detection of the TFT characteristics are alternately performed every n frames (n is the number of rows which compose the pixel matrix). Then, in a similar way to the above-described embodiment, the video signal sent from the outside is corrected by using the correction data obtained in consideration of both of the detection result of the OLED characteristics and the detection result of the TFT characteristics. Therefore, in the event of allowing the organic EL element OLED in each of the pixel circuits 11*a* to emit light, the drive current with such a magnitude that compensates for the deterioration of the drive transistor (transistor T2) and the deterioration of the organic EL element OLED is supplied to the organic EL element OLED. Here, also in this modification example, the data line S is not only used as the signal line that transfers the brightness signal for allowing the organic EL element OLED in the pixel circuit 11 to emit light at the desired brightness, but is also used as the characteristic detecting signal line. Hence, while suppressing the increase of the circuit scale, it becomes possible to simultaneously compensate for both of the deterioration of the drive transistor (transistor T2) and the deterioration of the organic EL element OLED.

<5.5 Fifth Modification Example>

Figure 34:
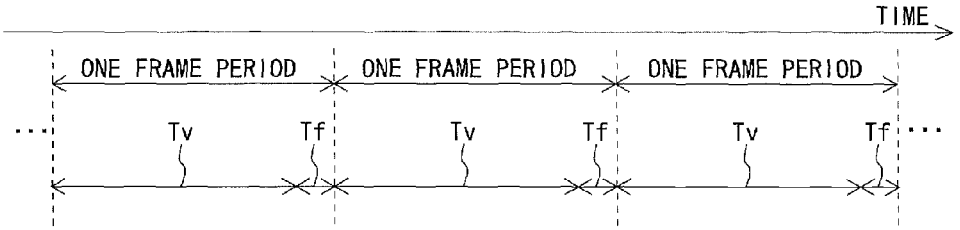
FIG. 34 is a diagram for explaining a configuration of one frame period.

In general, in the organic EL display device, one frame period is composed of: a vertical scanning period that is a period where the video signal is sequentially written into the pixels in order from a head row to a last row; and a vertical retrace line period (vertical synchronization period) that is a period provided in order to return the writing of the video signal from the last row to the head row. Then, during the operation of the organic EL display device, the vertical scanning period Tv and the vertical retrace line period Tf are alternately repeated as shown in FIG. 34. Incidentally, in the above-described embodiment, the detection of the TFT characteristics and the detection of the OLED characteristics are performed during the vertical scanning period Tv. However, the present invention is not limited to this, and such a configuration (a configuration in this modification example) can also be adopted, in which the detection of the TFT characteristics and the detection of the OLED characteristics are performed during the vertical retrace line period Tf.

In this modification example, when it is assumed that the detection of the TFT characteristics and the OLED characteristics for the first row is performed, for example, during the vertical retrace line period Tf in a (k+1)-th frame, then the detection of the TFT characteristics and the OLED characteristics for the second row is performed during the vertical retrace line period Tf in a (k+2)-th frame, the detection of the TFT characteristics and the OLED characteristics for the third row is performed during the vertical retrace line period Tf in a (k+3)-th frame, and the detection of the TFT characteristics and the OLED characteristics for the n-th row is performed during the vertical retrace line period Tf in a (k+n)-th frame. That is to say, every time the frame changes, the monitor row also changes. Note that, during the vertical scanning period Tv, similar operations to those of the general organic EL display device are performed.

Figure 35:
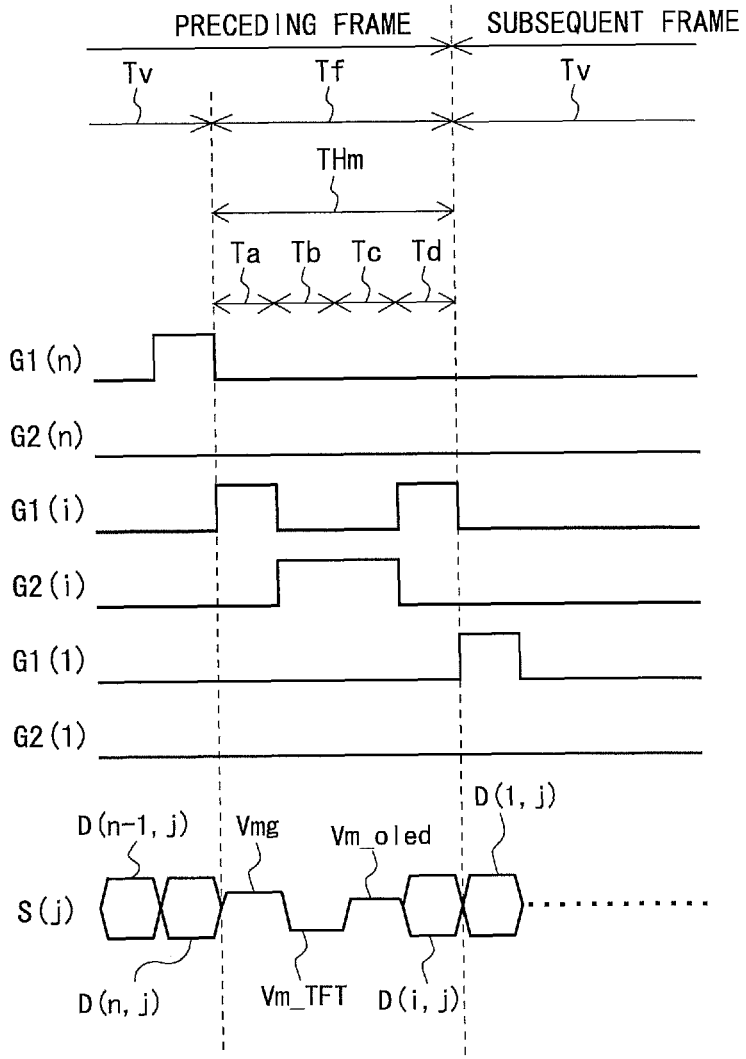
FIG. 35 is a timing chart for explaining operations of a pixel circuit (defined to be a pixel circuit on an i-th row and a j-th column) included in a monitor row during a vertical retrace line period in a fifth modification example of the embodiment.

FIG. 35 is a timing chart for explaining operations of the pixel circuit 11 (defined to be the pixel circuit 11 on the i-th row and the j-th column), which is included in the monitor row, during the vertical retrace line period Tf. As shown in FIG. 35, in this modification example, the vertical retrace line period Tf includes a detection preparation period Ta, a TFT characteristic detection period Tb, an OLED characteristic detection period Tc, and a light emission preparation period Td.

In the detection preparation period Ta, the TFT characteristic detection period Tb, the OLED characteristic detection period Tc and the light emission preparation period Td during the vertical retrace line period Tf in this modification example, similar operations to those in the detection preparation period Ta, the TFT characteristic detection period Tb, the OLED characteristic detection period Tc and the light emission preparation period Td in the above-described embodiment are performed, respectively. In such a manner as described above, it is also possible to detect the TFT characteristics and the OLED characteristics not during the vertical scanning period Tv but during the vertical retrace line period Tf.

Incidentally, in the non-monitor row, the writing in accordance with the target brightness is performed in the selection period during the vertical scanning period Tv, and light emission of the organic EL element OLED, which is based on the writing, is continued for substantially one frame period. In contrast, in the monitor row, while the writing is performed in the selection period during the vertical scanning period Tv, the light emission of the organic EL element is temporarily discontinued when the vertical retrace line period Tf comes. Therefore, in order that the organic EL element OLED emits light in the monitor row after the vertical retrace line period Tf is ended, the writing that is based on the data potential D(i,j) is performed in the light emission preparation period Td during the vertical retrace line period Tf.

Figure 36:
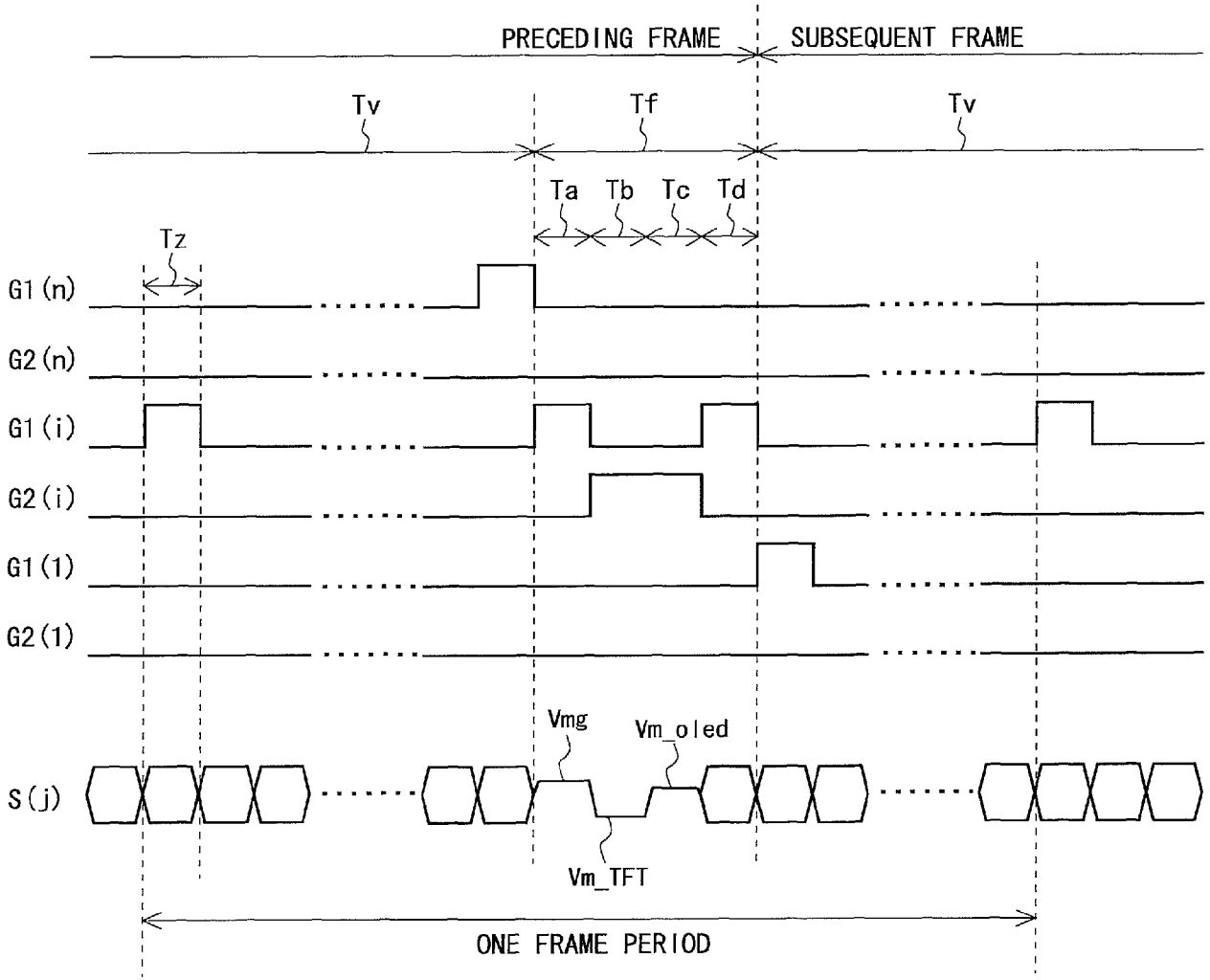
FIG. 36 is a timing chart for explaining operations of the pixel circuit (defined to be a pixel circuit on an i-th row and a j-th column) included in the monitor row during one frame period in the fifth modification example of the embodiment.

That is to say, in the monitor row, as shown in FIG. 36, first, the organic EL element OLED emits light based on writing in a selection period during a vertical scanning period Tv of a preceding frame. Thereafter, the organic EL element OLED is temporarily turned OFF during the vertical retrace line period Tf. Thereafter, the organic EL element OLED emits light based on the writing in the light emission preparation period Td during the vertical retrace line period Tf. With regard to this, in order that the writing that is based on the data potential D(i,j) can be enabled during the light emission preparation period Td, it is necessary to hold the corresponding data after the writing in the selection period during the vertical scanning period Tv. With regard to this, the data to be held is no more than data equivalent to one line, and accordingly, an increase of a memory capacity is slight. In contrast, in the above-described embodiment, the length of one horizontal scanning period differs between the monitor row and the non-monitor row, and accordingly, a line memory equivalent to several ten lines are sometimes required depending on timing of the data transfer from the control circuit 20. Thus, according to this modification example, a required memory capacity is reduced in comparison with the above-described embodiment.

Note that, in consideration that the light emission of the organic EL element OLED in the monitor row is temporarily discontinued during the vertical retrace line period Tf, the data line S may be given in advance a data potential, which is equivalent to a gradation voltage larger than an original gradation voltage, in a selection period (period denoted by reference symbol Tz in FIG. 36) during the vertical scanning period Tv. In other words, when any organic EL element OLED is defined as the focus-target organic EL element, in the case where the focus-target organic EL element is included in the monitor row, the source driver 30 gives the data line S(j) the data potential, which is equivalent to the gradation voltage larger than the gradation voltage in the case where the focus-target organic EL element is included in the non-monitor row, in the selection period during the vertical scanning period Tv. In such a way, the decrease of the display quality is suppressed.

<6. Others>

The present invention is not limited to the above-described embodiment and the above-described modification examples, and can be embodied while being modified in various ways within the scope without departing from the spirit of the present invention. For example, an organic EL display device to which the present invention is applicable should not be limited to the one including the pixel circuit 11 which is exemplified in the above-described embodiment. The pixel circuit may have a configuration other than the configuration, which is exemplified in the above-described embodiment, as long as at least the electro-optical element (organic EL element OLED) which is controlled by the current, the transistors T1 to T3 and the capacitor Cst are provided.

DESCRIPTION OF REFERENCE CHARACTERS

1~4: ORGANIC EL DISPLAY DEVICE
10: DISPLAY UNIT
11: PIXEL CIRCUIT
20: CONTROL CIRCUIT
30: SOURCE DRIVER
31: DRIVE SIGNAL GENERATION CIRCUIT
32: SIGNAL CONVERSION CIRCUIT
33: OUTPUT UNIT
40: GATE DRIVER
50: CORRECTION DATA STORAGE UNIT
51*a*: TFT OFFSET MEMORY
51*b*: OLED OFFSET MEMORY
52*a*: TFT GAIN MEMORY
52*b*: OLED GAIN MEMORY
60: TEMPERATURE SENSOR
201: MONITOR ROW STORAGE UNIT
202: TEMPERATURE CHANGE COMPENSATION UNIT
330: OUTPUT/CURRENT MONITOR CIRCUIT
T1~T3: TRANSISTOR

Cst: CAPACITOR

G1(1)~G1(n): SCANNING LINE

G2(1)~G2(n): MONITOR CONTROL LINE

S(1)~S(m): DATA LINE

ELVDD: HIGH-LEVEL POWER SUPPLY VOLTAGE, HIGH-LEVEL POWER SUPPLY LINE

ELVSS: LOW-LEVEL POWER SUPPLY VOLTAGE, LOW-LEVEL POWER SUPPLY LINE

Ta: DETECTION PREPARATION PERIOD

Tb: TFT CHARACTERISTIC DETECTION PERIOD

Tc: OLED CHARACTERISTIC DETECTION PERIOD

Td: LIGHT EMISSION PREPARATION PERIOD

TL: LIGHT EMISSION PERIOD

The invention claimed is:

1. An active matrix-type display device comprising:

a display unit including: a pixel matrix of n rows and m columns (n and m are integers of 2 or more), which is composed of n×m pieces of pixel circuits each including an electro-optical element in which brightness is controlled by a current and including a drive transistor for controlling a current to be supplied to the electro-optical element; scanning lines provided to correspond to respective rows of the pixel matrix; monitor control lines provided to correspond to the respective rows of the pixel matrix; and data lines provided to correspond to respective columns of the pixel matrix;

a pixel circuit drive unit configured to drive the scanning lines, the monitor control lines and the data lines so that characteristic detection processing for detecting characteristics of characteristic detection-target circuit elements including at least either of the electro-optical element and the drive transistor is performed in a frame period, and that each electro-optical element emits light in response to target brightness;

a correction data storage unit configured to store characteristic data, which are obtained based on results of the characteristic detection processing, as correction data for correcting video signals; and a video signal correction unit configured to correct the video signals based on the correction data stored in the correction data storage unit, and to generate data signals to be supplied to the n×m pieces of pixel circuits, wherein each of the pixel circuits includes:

the electro-optical element;

an input transistor, in which a control terminal is connected to one of the scanning lines, a first conductive terminal is connected to one of the data lines, and a second conductive terminal is connected to the control terminal of the drive transistor;

a monitor control transistor, in which a control terminal is connected to one of the monitor control lines, a first conductive terminal is connected to the second conductive terminal of the drive transistor and to the anode of the electro-optical element, and a second conductive terminal is connected to one of the data lines;

the drive transistor in which a first conductive terminal is given a drive power supply potential; and a first capacitor in which one end is connected to a control terminal of the drive transistor in order to hold a potential of the control terminal of the drive transistor, wherein, when a row in which the characteristic detection processing is performed in the frame period is defined as a monitor row, and each of rows other than the monitor row is defined as a non-monitor row, the frame period includes a characteristic detection processing period composed of: a detection preparation period where a preparation for detecting characteristics of the characteristic detection-target circuit elements is performed in the monitor row; a current measurement period where the characteristics of the characteristic detection-target circuit elements are detected by measuring currents flowing through the data lines; and a light emission preparation period where a preparation for allowing the electro-optical element to emit light is performed in the monitor row, the pixel circuit drive unit drives the scanning lines so that the input transistor becomes an ON state during the detection preparation period and the light emission preparation period, and that the input transistor becomes an OFF state during the current measurement period, the pixel circuit drive unit drives the monitor control lines so that the monitor control transistor becomes an OFF state during the detection preparation period and the light emission preparation period, and that the monitor control transistor becomes an ON state during the current measurement period, the pixel circuit drive unit gives the data lines a first predetermined potential during the detection preparation period, the first predetermined potential being determined based on the characteristics of the electro-optical element and the characteristics of the drive transistor, the pixel circuit drive unit gives the data lines a second predetermined potential during the current measurement period, the second predetermined potential serving for allowing a current in accordance with the characteristics of each of the characteristic detection-target circuit elements to flow through each of the data lines, and the pixel circuit drive unit gives the data lines a potential in accordance with a target brightness of the electro-optical element during the light emission preparation period.

2. The display device according to claim 1, wherein the pixel circuit drive unit includes output and current-monitor circuits having a function to apply the data signals to the data lines, and a function to measure the currents flowing through the data lines, each of the output and current-monitor circuits includes:

an operational amplifier, in which a non-inverting input terminal is given one of the data signals, and an inverting input terminal is connected to one of the data lines;

a second capacitor, in which one end is connected to one of the data lines, and other end is connected to an output terminal of the operational amplifier; and a switch, in which one end is connected to one of the data lines, and other end is connected to the output terminal of the operational amplifier, and each of the output and current-monitor circuits measure currents flowing through the data lines by allowing the switch to be turned to OFF state after giving the data lines the second predetermined potential by allowing the switch to be turned to ON state, in the current measurement period.

3. The display device according to claim 2, wherein one output and current-monitor circuit is provided for a plurality of the data lines, and the plurality of data lines are electrically connected sequentially to the output and current-monitor circuits every predetermined period.

4. The display device according to claim 1, wherein the characteristic detection processing period is provided in a vertical scanning period.

5. The display device according to claim 4, wherein, when any electro-optical element is defined as a focus-target electro-optical element, in a case where the focus-target electro-optical element is included in the monitor row, the pixel circuit drive unit gives the data lines a potential of a data signal during the light emission preparation period, the potential being equivalent to a gradation voltage larger than a gradation voltage in a case where the focus-target electro-optical element is included in the non-monitor row.

6. The display device according to claim 1, wherein the characteristic detection processing period is provided in a vertical retrace line period.

7. The display device according to claim 6, wherein, when any electro-optical element is defined as a focus-target electro-optical element, in a case where the focus-target electro-optical element is included in the monitor row, the pixel circuit drive unit gives the data lines a potential of a data signal in an event of performing writing of the data signals to pixel circuits included in the monitor row in a vertical scanning period, the potential being equivalent to a gradation voltage larger than a gradation voltage in a case where the focus-target electro-optical element is included in the non-monitor row.

8. The display device according to claim 1, wherein the characteristic detection processing is performed for only one row of the pixel matrix for one frame period.

9. The display device according to claim 1, wherein there are: a frame in which detection of the characteristics of only the drive transistor as the characteristic detection-target circuit elements is performed: and a frame in which detection of the characteristics of only the electro-optical element as the characteristic detection-target circuit elements is performed.

10. The display device according to claim 1, wherein the current measurement period is composed of: a drive transistor characteristic detection period where a current measurement for detecting the characteristics of the drive transistor is performed; and an electro-optical element characteristic detection period where a current measurement for detecting the characteristics of the electro-optical element is performed, and the pixel circuit drive unit gives the data lines different potentials between the drive transistor characteristic detection period and the electro-optical element characteristic detection period, as the second predetermined potential.

11. The display device according to claim 10, wherein, when a potential given to one of the data lines in the detection preparation period is defined as Vmg, a potential given to one of the data lines in the drive transistor characteristic detection period is defined as Vm_TFT, and a potential given to one of the data lines in the electro-optical element characteristic detection period is defined as Vm_oled, a value of Vmg is determined to satisfy following expressions:

$$Vmg > Vm_TFT + Vth(T2)$$

$$Vmg < Vm_\text{oled} + Vth(T2)$$

where Vth(T2) is a threshold voltage of the drive transistor.

12. The display device according to claim 10, wherein, when a potential given to one of the data lines in the detection preparation period is defined as Vmg, and a potential given to one of the data lines in the drive transistor characteristic detection period is defined as Vm_TFT, a value of Vm_TFT is determined to satisfy following expressions:

$$Vm_TFT < Vmg - Vth(T2)$$

$$Vm_TFT < ELVSS + Vth(\text{oled})$$

where Vth(T2) is a threshold voltage of the drive transistor, Vth(oled) is a light emission threshold voltage of the electro-optical element, and ELVSS is a potential of a cathode of the electro-optical element.

13. The display device according to claim 10, wherein, when a potential given to one of the data lines in the detection preparation period is defined as Vmg, and a potential given to one of the data lines in the electro-optical element characteristic detection period is defined as Vm_oled, a value of Vm_oled is determined to satisfy following expressions:

$$Vm_\text{oled} > Vmg - Vth(T2)$$

$$Vm_\text{oled} > ELVSS + Vth(\text{oled})$$

where Vth(T2) is a threshold voltage of the drive transistor, Vth(oled) is a light emission threshold voltage of the electro-optical element, and ELVSS is a potential of a cathode of the electro-optical element.

14. The display device according to claim 10, wherein, when a potential given to one of the data lines in the detection preparation period is defined as Vmg, a potential given to one of the data lines in the drive transistor characteristic detection period is defined as Vm_TFT, and a potential given to one of the data lines in the electro-optical element characteristic detection period is defined as Vm_oled, values of Vmg, Vm_TFT and Vm_oled are determined to satisfy following relationships:

$$Vm_TFT < Vmg - Vth(T2)$$

$$Vm_TFT < ELVSS + Vth(\text{oled})$$

$$Vm_\text{oled} > Vmg - Vth(T2)$$

$$Vm_\text{oled} > ELVSS + Vth(\text{oled})$$

where Vth(T2) is a threshold voltage of the drive transistor, Vth(oled) is a light emission threshold voltage of the electro-optical element, and ELVSS is a potential of a cathode of the electro-optical element.

15. The display device according to claim 1, further comprising:

a temperature detection unit configured to detect a temperature; and a temperature change compensation unit configured to implement, for the characteristic data, a correction that is based on the temperature detected by the temperature detection unit, wherein data subjected to the correction by the temperature change compensation unit is stored as the correction data in the correction data storage unit.

16. The display device according to claim 1, further comprising:

a monitor region storage unit configured to store information for identifying a region where the characteristic detection processing is performed last in an event where a power supply is turned OFF, wherein, after the power supply is turned ON, the characteristic detection processing is performed from a region in a vicinity of a region obtained based on information stored in the monitor region storage unit.

17. A drive method of a display device including: a pixel matrix of n rows and m columns (n and m are integers of 2 or more), which is composed of n×m pieces of pixel circuits each including an electro-optical element in which brightness is controlled by a current and including a drive transistor for controlling a current to be supplied to the electro-optical element; scanning lines provided to correspond to respective rows of the pixel matrix; monitor control lines provided to correspond to the respective rows of the pixel matrix; and data lines provided to correspond to respective columns of the pixel matrix, the drive method comprising:

a pixel circuit driving step of driving the scanning lines, the monitor control lines and the data lines so that characteristic detection processing for detecting characteristics of characteristic detection-target circuit elements including at least either of the electro-optical element and the drive transistor is performed in a frame period, and that each electro-optical element emits light in response to target brightness;

a correction data storing step of storing characteristic data, which are obtained based on results of the characteristic detection processing, as correction data for correcting video signals, in a correction data storage unit prepared in advance; and a video signal correction step of correcting the video signals based on the correction data stored in the correction data storage unit, and generating data signals to be supplied to the n×m pieces of pixel circuits, wherein each of the pixel circuits includes:

the electro-optical element;

an input transistor, in which a control terminal is connected to one of the scanning lines, a first conductive terminal is connected to one of the data lines, and a second conductive terminal is connected to the control terminal of the drive transistor; a monitor control transistor, in which a control terminal is connected to one of the monitor control lines, a first conductive terminal is connected to the second conductive terminal of the drive transistor and to the anode of the electro-optical element, and a second conductive terminal is connected to one of the data lines;

the drive transistor in which a first conductive terminal is given a drive power supply potential; and a first capacitor in which one end is connected to a control terminal of the drive transistor in order to hold a potential of the control terminal of the drive transistor, wherein, when a row in which the characteristic detection processing is performed in the frame period is defined as a monitor row, and each of rows other than the monitor row is defined as a non-monitor row, the frame period includes a characteristic detection processing period composed of: a detection preparation period where a preparation for detecting characteristics of the characteristic detection-target circuit elements is performed in the monitor row; a current measurement period where the characteristics of the characteristic detection-target circuit elements are detected by measuring currents flowing through the data lines; and a light emission preparation period where a preparation for allowing the electro-optical element to emit light is performed in the monitor row, in the pixel circuit driving step, the scanning lines are driven so that the input transistor becomes an ON state during the detection preparation period and the light emission preparation period, and that the input transistor becomes an OFF state during the current measurement period, the monitor control lines are driven so that the monitor control transistor becomes an OFF state during the detection preparation period and the light emission preparation period, and that the monitor control transistor becomes an ON state during the current measurement period, the data lines are given a first predetermined potential during the detection preparation period, the first predetermined potential being determined based on the characteristics of the electro-optical element and the characteristics of the drive transistor, the data lines are given a second predetermined potential during the current measurement period, the second predetermined potential serving for allowing a current in accordance with the characteristics of each of the characteristic detection-target circuit elements to flow through each of the data lines, and the data lines are given a potential in accordance with a target brightness of the electro-optical element during the light emission preparation period.

* * * * *